US010921075B2

(12) United States Patent
Brown et al.

(10) Patent No.: US 10,921,075 B2
(45) Date of Patent: Feb. 16, 2021

(54) MAGAZINE FOR FIREARM

(71) Applicant: Sturm, Ruger & Company, Inc., Southport, CT (US)

(72) Inventors: Nathan Brown, Kernersville, NC (US); Matthew S. Willson, Walnut Cove, NC (US); Dean M. Cousino, McLeansville, NC (US); Maksim Sakalouski, Summerfield, NC (US)

(73) Assignee: STURM, RUGER & COMPANY, INC., Southport, CT (US)

( * ) Notice: Subject to any disclaimer, the term of this patent is extended or adjusted under 35 U.S.C. 154(b) by 0 days.

(21) Appl. No.: 16/506,553

(22) Filed: Jul. 9, 2019

(65) Prior Publication Data

US 2020/0096272 A1 Mar. 26, 2020

Related U.S. Application Data

(60) Provisional application No. 62/695,432, filed on Jul. 9, 2018.

(51) Int. Cl.
*F41A 9/69* (2006.01)

(52) U.S. Cl.
CPC ..... *F41A 9/69* (2013.01)

(58) Field of Classification Search
CPC ..... F41A 9/69
(Continued)

(56) References Cited

U.S. PATENT DOCUMENTS 527,869 A * 10/1894 Mauser ..... F41A 9/65 42/50
1,260,991 A * 3/1918 Hammond ..... F41A 17/38 42/18

(Continued)

FOREIGN PATENT DOCUMENTS

GB 166581 7/1921
RU 2583240 C1 5/2016

(Continued)

OTHER PUBLICATIONS

International Search Report and Written Opinion issued in International Application No. PCT/US19/41033 dated Nov. 13, 2019.

*Primary Examiner* — Samir Abdosh
(74) *Attorney, Agent, or Firm* — The Belles Group, P.C.

(57) ABSTRACT

A magazine for a firearm such as long guns comprises a housing defining a cavity for holding a double staggered stack of cartridges and spring-biased tiltable follower for dispensing the cartridges into the action of the firearm. Features include an accordion type flat spring specially configured to fold into a flat condition in which adjacent bends of the spring are arranged side-by-side to reduce the folded height of the spring. The follower includes bosses slideable in mating vertical housing slots to guide the follower upward/downward motion and allow front to rear tilting action. A coupling mechanism includes a plurality of interlocking mounting teeth forming a selectively interlocked arrangement for detachably assembling the floor plate to magazine housing. A resilient snap fit tab on the floor plate secures the coupling. The magazine is longitudinally elongated and configured to fit flushly with the underside of the firearm when mounted.

31 Claims, 40 Drawing Sheets

(58) Field of Classification Search
USPC ..... 42/50
See application file for complete search history.

(56) References Cited

U.S. PATENT DOCUMENTS

| | | | | |
|---|---|---|---|---|
| 1,462,972 | A | 7/1923 | Lewis | |
| 2,441,735 | A * | 5/1948 | Warner | F41A 9/70 42/50 |
| 2,642,688 | A | 6/1953 | Johnson, Jr. | |
| 2,655,753 | A | 10/1953 | Salas | |
| 2,745,203 | A | 5/1956 | Ruple | |
| 2,997,803 | A | 8/1961 | Florence | |
| 3,235,994 | A | 2/1966 | Grippo | |
| 3,373,521 | A | 3/1968 | Into | |
| 3,395,479 | A * | 8/1968 | Collins | F41A 9/70 42/50 |
| 3,494,216 | A | 2/1970 | Haskins | |
| 3,509,654 | A | 5/1970 | Vorgrimler | |
| 3,574,264 | A | 4/1971 | Simmons, Sr. et al. | |
| 3,577,860 | A * | 5/1971 | Jestrabek | F41A 9/70 42/50 |
| 3,726,038 | A * | 4/1973 | Bredbury | F41A 9/70 42/50 |
| 3,803,739 | A | 4/1974 | Haines et al. | |
| 3,964,199 | A | 6/1976 | Musgrave | |
| 3,999,319 | A | 12/1976 | Musgrave | |
| 4,139,959 | A | 2/1979 | Howard et al. | |
| 4,252,302 | A | 2/1981 | Musgrave | |
| 4,258,495 | A | 3/1981 | Musgrave | |
| 4,314,419 | A | 2/1982 | Koon, Jr. | |
| 4,329,802 | A * | 5/1982 | Coonan | F41A 9/67 42/50 |
| 4,413,437 | A * | 11/1983 | Anderson | F41A 9/65 42/50 |
| 4,588,093 | A | 5/1986 | Field | |
| 4,811,510 | A | 3/1989 | Chesnut | |
| 5,345,660 | A * | 9/1994 | Howard | B29C 33/76 29/401.1 |
| 5,664,355 | A | 9/1997 | Ronkainen | |
| 5,956,878 | A | 9/1999 | Yang | |
| 6,367,188 | B1 | 4/2002 | Vargas | |
| 7,093,386 | B1 | 8/2006 | Vieweg | |
| 7,117,622 | B2 | 10/2006 | Freed et al. | |
| 7,530,191 | B2 | 5/2009 | Szabo | |
| 7,621,063 | B2 | 11/2009 | Fitzpatrick et al. | |
| 7,698,844 | B2 | 4/2010 | Gruber et al. | |
| 7,735,252 | B1 | 6/2010 | Laney et al. | |
| 7,797,871 | B2 | 9/2010 | Bubits | |
| 7,854,083 | B1 | 12/2010 | Aalto | |
| 7,958,660 | B2 | 6/2011 | Fitzpatrick et al. | |
| 7,963,062 | B1 | 6/2011 | Rotharmel et al. | |
| 8,028,455 | B1 * | 10/2011 | Battaglia | F41A 9/71 42/49.02 |
| 8,042,297 | B2 | 10/2011 | Emde | |
| 8,061,071 | B2 | 11/2011 | Fitzpatrick et al. | |
| 8,156,675 | B2 | 4/2012 | Heath | |
| 8,166,692 | B2 * | 5/2012 | Fitzpatrick | F41A 9/70 42/50 |
| 8,225,541 | B2 | 7/2012 | Bigley et al. | |
| 8,448,364 | B2 | 5/2013 | Davidson | |
| 8,667,724 | B2 * | 3/2014 | Zheng | F41A 9/70 42/50 |
| 8,689,475 | B2 | 4/2014 | Battaglia | |
| 8,839,543 | B2 | 9/2014 | Fitzpatrick et al. | |
| 8,943,727 | B2 | 2/2015 | Russell | |
| 9,228,788 | B1 | 1/2016 | Simon et al. | |
| 9,255,749 | B2 | 2/2016 | Faifer | |
| 9,347,720 | B2 | 5/2016 | Fitzpatrick et al. | |
| 9,347,721 | B2 | 5/2016 | Larson, Jr. | |
| 9,372,040 | B2 | 6/2016 | Zheng | |
| 9,383,151 | B2 * | 7/2016 | Ballard | F41A 9/65 |
| 9,383,152 | B2 | 7/2016 | Nakayama et al. | |
| 9,470,464 | B2 | 10/2016 | Kielsmeier et al. | |
| 9,494,375 | B2 | 11/2016 | Mikroulis | |
| 9,506,706 | B2 * | 11/2016 | Higley | F41A 9/65 |
| 9,612,069 | B2 | 4/2017 | Bennett et al. | |
| 9,618,285 | B2 | 4/2017 | Leimer | |
| 9,746,264 | B2 | 8/2017 | Fitzpatrick et al. | |
| 9,772,153 | B1 | 9/2017 | Findlay et al. | |
| 2009/0107022 | A1 * | 4/2009 | Fitzpatrick | F41A 9/70 42/50 |
| 2010/0281737 | A1 * | 11/2010 | Cahill | F41A 9/71 42/50 |
| 2013/0086834 | A1 * | 4/2013 | Battaglia | F41A 9/71 42/49.02 |
| 2013/0167420 | A1 * | 7/2013 | Zheng | F41A 9/70 42/50 |
| 2014/0196340 | A1 | 7/2014 | Dugger | |
| 2014/0366417 | A1 * | 12/2014 | Zheng | F41A 9/71 42/50 |
| 2016/0025436 | A1 * | 1/2016 | Higley | F41A 9/65 42/49.01 |
| 2016/0076841 | A1 * | 3/2016 | Ballard | F41A 9/65 42/50 |
| 2017/0153376 | A1 | 6/2017 | Nakayama et al. | |
| 2017/0307319 | A1 * | 10/2017 | Jarboe | F41A 9/70 |
| 2018/0094886 | A1 * | 4/2018 | Corso | F41A 9/70 |

FOREIGN PATENT DOCUMENTS

| | | |
|---|---|---|
| WO | WO 2016/091246 A1 | 6/2016 |
| WO | WO 2018/005290 A1 | 1/2018 |

* cited by examiner

MAGAZINE FOR FIREARM

CROSS-REFERENCE TO RELATED APPLICATIONS

The present application claims the benefit of priority to U.S. Provisional Application No. 62/695,432 filed Jul. 9, 2018, the entirety of which is incorporated herein by reference.

The present invention generally relates to firearms, and more particularly to magazines detachably mounted to firearms.

BACKGROUND

Non-rotary magazines of the box type used for long guns generally include a body case or housing) defining an internal cavity which holds a vertical stack of ammunition cartridges. The magazine may be removably detached to the underside of the firearm below the action. The cartridges in the magazine are typically arranged in a vertical stack. The bottom end of the case is closed and top end forms an opening for loading cartridge into the magazine and dispensing them into the breech area of the firearm action. A follower biased in an upward direction by a spring mechanism urges the stack of cartridges upwards towards the top opening. A pair of laterally spaced feed lips formed on or attached to the magazine case at the top end engages the uppermost cartridge to retain the spring-based cartridges in the magazine. When the action is cycled by discharging the firearm or manually, the bolt or breech block strips and chambers the uppermost cartridge from the magazine.

Some box type magazines have a relatively large profile and project a significant distance below the mid-stock of the rifle or shotgun (i.e. portion of stock partially encasing the receiver). This is visually and physically obtrusive which may interfere with handling of the firearm.

An improved firearm magazine having a compact and low profile design without sacrificing capacity is desired. Smooth and reliable feeding of individual cartridges from the magazine into the action of the firearm is further desirable.

SUMMARY

The present disclosure provides an improved ammunition magazine for a long gun such as without limitation a rifle or shotgun. The present magazine includes a compact, low profile housing which sits substantially flush with underside of the mid-stock to which it is detachably mounted. Several unique features of the magazine disclosed herein contribute to the low profile design, smooth and reliable cartridge feeding, and overall functionality of the magazine. For example, the main spring has a unique configuration and folding features which produces a low profile when fully compressed, thereby enabling the provision of a compact magazine design without reduced shell or cartridge capacity. The follower may be a tilting design with a specially contoured cartridge support surface which advantageously provides positive cartridge feeding action without hang-ups or jams. In one embodiment, the magazine has a main case or housing configured to hold a plurality of cartridges in a vertical double/staggered stack to single feed design arrangement. The magazine has a capacity for holding four cartridge rounds in one implementation such as short action calibers (.243 Winchester, .308 Winchester, 7 mm-08 Remington, 6 mm Creedmoor, and 6.5 Creedmoor). However, other embodiments may hold more or less and different size cartridges.

In one aspect, a magazine for a firearm comprises: a housing defining a horizontal centerline axis, a vertical centerline axis perpendicular thereto, and an interior cavity configured to hold a plurality of ammunition cartridges; the housing including an open top end, a bottom end, a front wall, a rear wall, and pair of opposing lateral right and left sidewalls extending between the front and rear walls; a compressible main spring disposed in the cavity; an elongated follower disposed in the cavity and biased in an upwards direction by the main spring, the follower being moveable between a lower position and an upper position for dispensing cartridges; a guide boss protruding laterally outwards from each one of a pair of lateral sides of the follower, each guide boss slideably engaging a corresponding vertical guide slot formed in the sidewalls of the housing for guiding upwards and downwards movement of the follower; wherein the follower is angularly tiltable relative to the housing of the magazine about a lateral pivot axis defined by the guide bosses. Each vertical guide slot may have a closed top end to restrict a vertical range of movement of the follower and an open bottom end for insertion of the guide bosses into the guide slots in some embodiments. The guide bosses may be cylindrical. The follower is movable between a horizontal position and an angled position.

In another aspect, a magazine for a firearm comprises: a housing defining a longitudinal axis, a vertical centerline axis, and an interior cavity configured to hold a spring biased stack of ammunition cartridges; the housing including an open top end, a bottom end, a front wall, a rear wall, and pair of opposing lateral sidewalls extending between the front and rear walls; the sidewalls of the housing each including a plurality of longitudinally spaced apart mounting teeth; a floor plate detachably coupled to the bottom end of the magazine, the floor plate including a plurality of longitudinally spaced apart mounting teeth mutually engageable with the mounting teeth on each of the sidewalls of the magazine; the floor plate longitudinally slideable forward and rearward on the housing between a locked position in which the mounting teeth of the floor plate are engaged with the mounting teeth of the housing, and an unlocked position in which the mounting teeth of the floor plate are disengaged from the mounting teeth of the housing; wherein the floor plate is removable form the housing when in the unlocked position, and the floor plate is not removable from the housing when in the locked position.

In another aspect, a method for assembling a firearm magazine comprises: providing a magazine housing defining a horizontal centerline axis, a vertical centerline axis, and an interior cavity configured to hold a spring biased stack of ammunition cartridges, the housing comprising a front wall, a rear wall, and a pair of opposing lateral sidewalls each including a first plurality of first mounting teeth separated by first gaps; providing a floor plate comprising opposing lateral sidewalls each including a second plurality of second mounting teeth separated by second gaps; positioning the floor plate below the magazine housing; vertically inserting the second teeth of the floor plate through the first gaps of the magazine housing by moving the floor plate and magazine housing together; sliding the floor plate forward on the magazine housing; and positioning the second teeth of the floor plate above the first teeth of the magazine housing; wherein the floor plate cannot be vertically withdrawn from the magazine housing.

BRIEF DESCRIPTION OF THE DRAWINGS

The features of the exemplary embodiments will be described with reference to the following drawings where like elements are labeled similarly, and in which.

Figure 1:
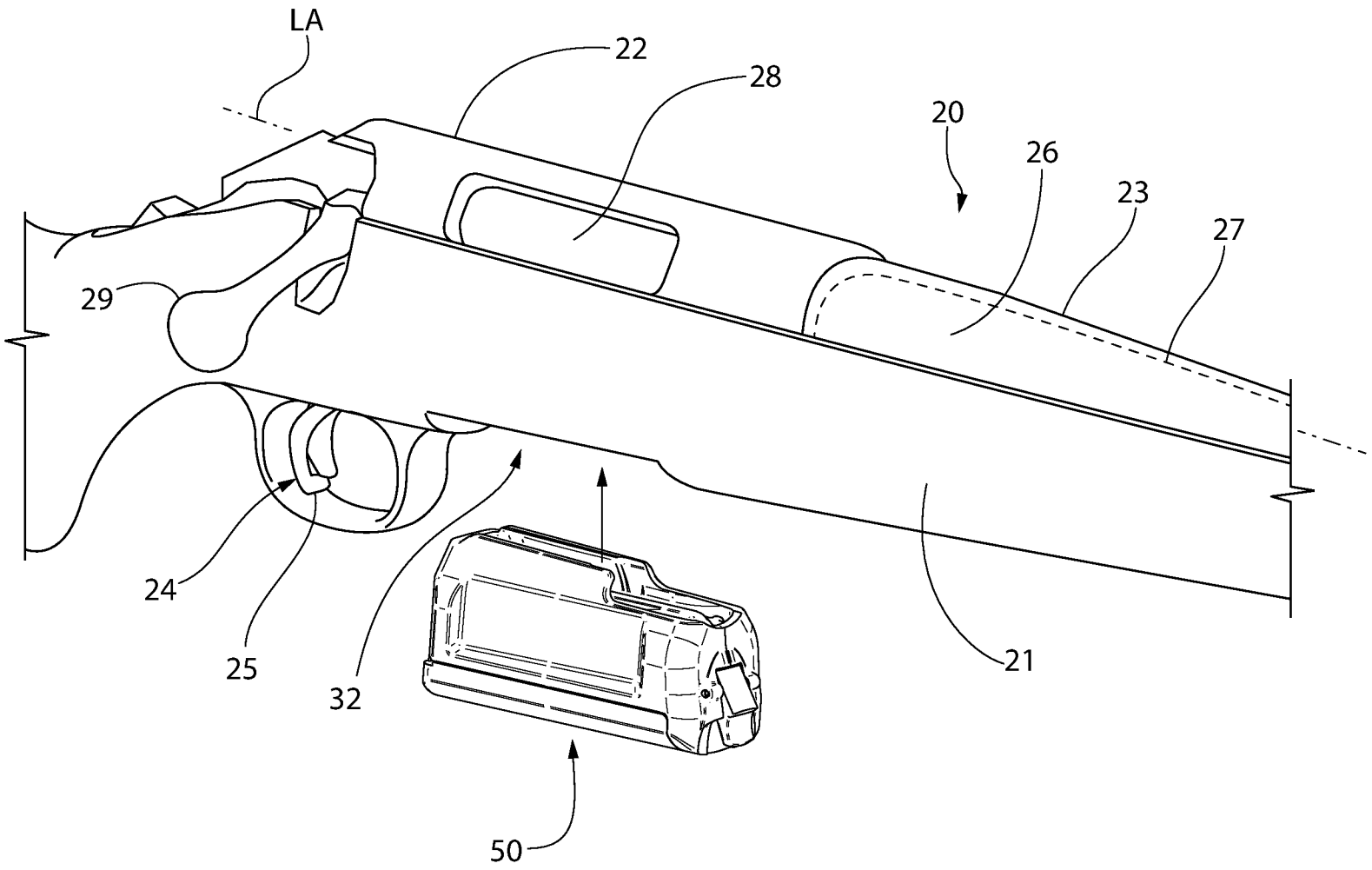
FIG. 1 is a perspective view of a firearm with magazine according to the present disclosure.

All drawings are schematic and not necessarily to scale. Parts given a reference numerical designation in one figure may be considered to be the same parts where they appear in other figures without a numerical designation for brevity unless specifically labeled with a different part number and/or described herein.

DETAILED DESCRIPTION

The features and benefits of the invention are illustrated and described herein by reference to exemplary ("example") embodiments. This description of exemplary embodiments is intended to be read in connection with the accompanying drawings, which are to be considered part of the entire written description. Accordingly, the disclosure expressly should not be limited to such exemplary embodiments illustrating some possible non-limiting combination of features that may exist alone or in other combinations of features.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

The terms "shell," "cartridge," and "round" are used interchangeably herein in reference to describing firearm ammunition, and therefore should not to be construed as limiting the invention or the claims appended hereto. For convenience and brevity, further description of ammunition which follows will generally use the non-limiting term of "cartridge."

A detachable firearm magazine according to a non-limiting embodiment may be used in semi-automatic/autoloading and bolt action long guns such as rifles or shotguns, or other types of firearms including some pistols. In the illustrated embodiment of a firearm, the magazine is shown as configured for use in a manually operated centerfire bolt action rifle. It will be appreciated, however, that the magazine may also be adapted for use in a rimfire rifle as well as the other types of firearms noted above. Accordingly, the type of firearm and ammunition does not necessarily limit the scope or applicability of the invention which has broad use.

FIGS. 1-17 show one non-limiting embodiment of a detachable box style magazine according to the present disclosure for a firearm, which incorporates several features that collectively provide a compact magazine design with reliable cartridge feed mechanism.

Figure 2:
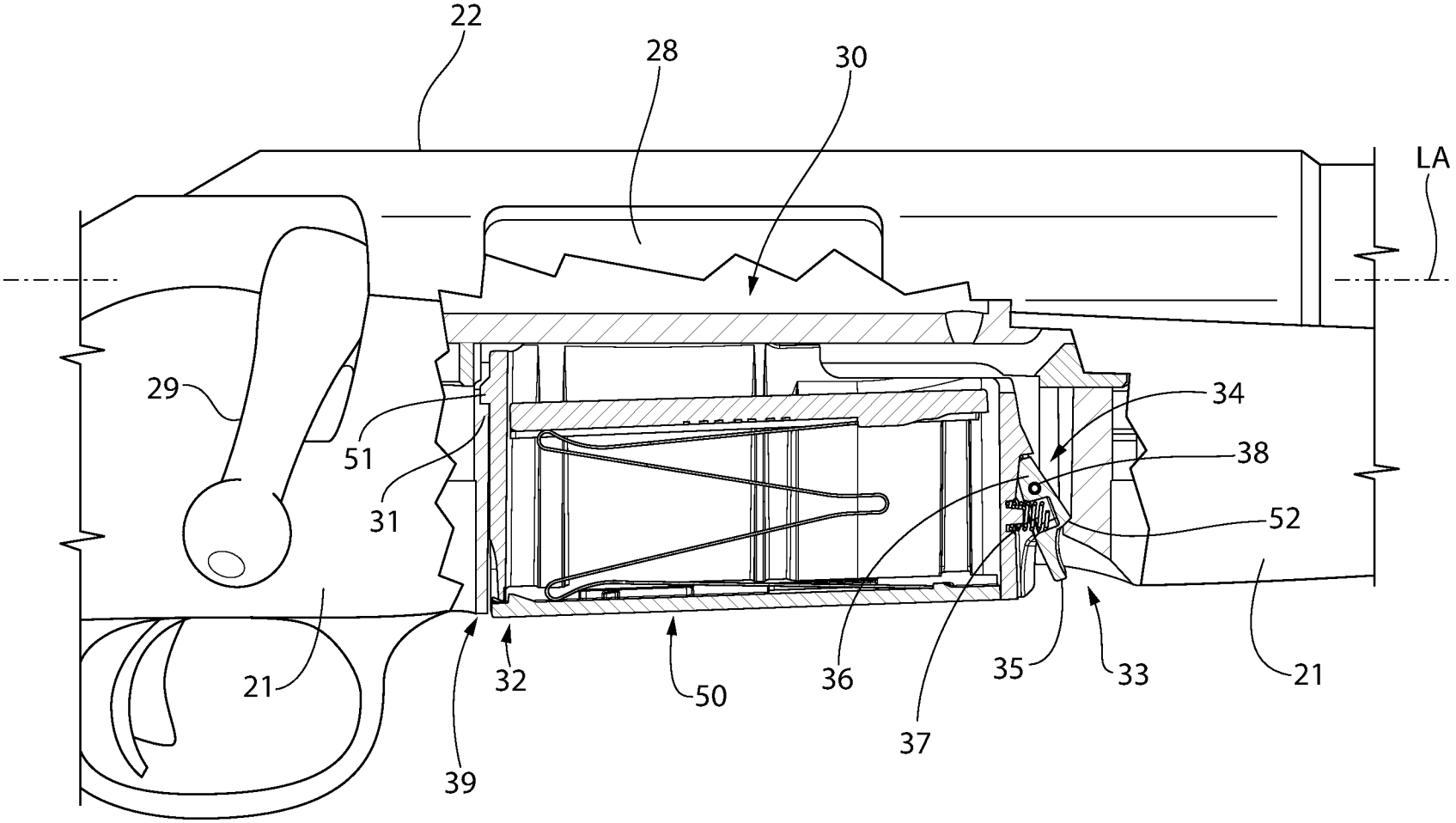
FIG. 2 is a side partial cross-sectional view of the breech area of the firearm.

Referring initially to FIGS. 1 and 2, a firearm 20 includes a chassis or stock 21 which supports a receiver 22 and barrel 23 which may be detachably or permanently coupled to the receiver. Barrel 23 defines a longitudinal axis LA coinciding with the axial centerline of a longitudinally-extending bore 27 which defines the projectile passageway from the rear breech end to front muzzle end of the barrel. The rear end of the bore is diametrically enlarged and defines the chamber 26 configured for supporting and holding an ammunition cartridge C which may be uploaded into the action by the present magazine 50. The area in the receiver at the open rear entrance to the chamber 26 defines the breech area 30 which communicates with magazine 50 for uploading cartridges into the firearm.

A generally cylindrical bolt 28 (visible through the cartridge ejection port of the receiver 222 is slideably mounted inside a longitudinal chamber of the receiver for rearward and forward movement via manual operation of the bolt handle 29 to both eject the spent cartridge casing after firing, and load a fresh cartridge into the barrel chamber 26. The front of the bolt 28 defines the breech face for forming a closed breech when in battery with the barrel 23 when the bolt is in the forward position, or an open breech spaced axially rearward for unloading/loading cartridges via the magazine 50. A trigger-actuated firing mechanism 24 mounted in the receiver 22 includes a movable trigger 24 for discharging the firearm. The firing mechanism 24 operably cooperates with a cockable spring-biased striking member such as a hammer (not shown) which in turn strikes a firing pin to strike and detonate a chambered cartridge C. Such features and operation are well known in the art.

Magazine 50 may include front and rear retention features which removably and detachably mount the magazine to the stock 21 of the firearm. Referring to FIGS. 1-5 and 28-30, magazine 50 is vertically located and secured to firearm 20 at rear by a rear retention tab 31 formed in stock 21 at the rear of magazine well 32, and a latch mechanism comprising a spring loaded pivotably movable latch lever 34 at the front mounted to the front wall 57 of the magazine adjacent to the magazine well. Magazine 50 includes a stepped rear mounting protrusion or tab 51 on rear wall 58 which engages rear retention tab 31 of the stock disposed inside the downwardly open magazine well 32. Latch lever 34 engages a stepped front mounting protrusion or tab 52 inside the front of the magazine well. Lever 34 is vertically elongated and includes an upper retention end 36 configured with downward facing retention surface 36-1 arranged to engage stock mounting tab 52 and a lower operating end 35 accessible via a downwardly open recess 33 in the bottom of the stock 21 adjoining the magazine well 32.

Figure 5:
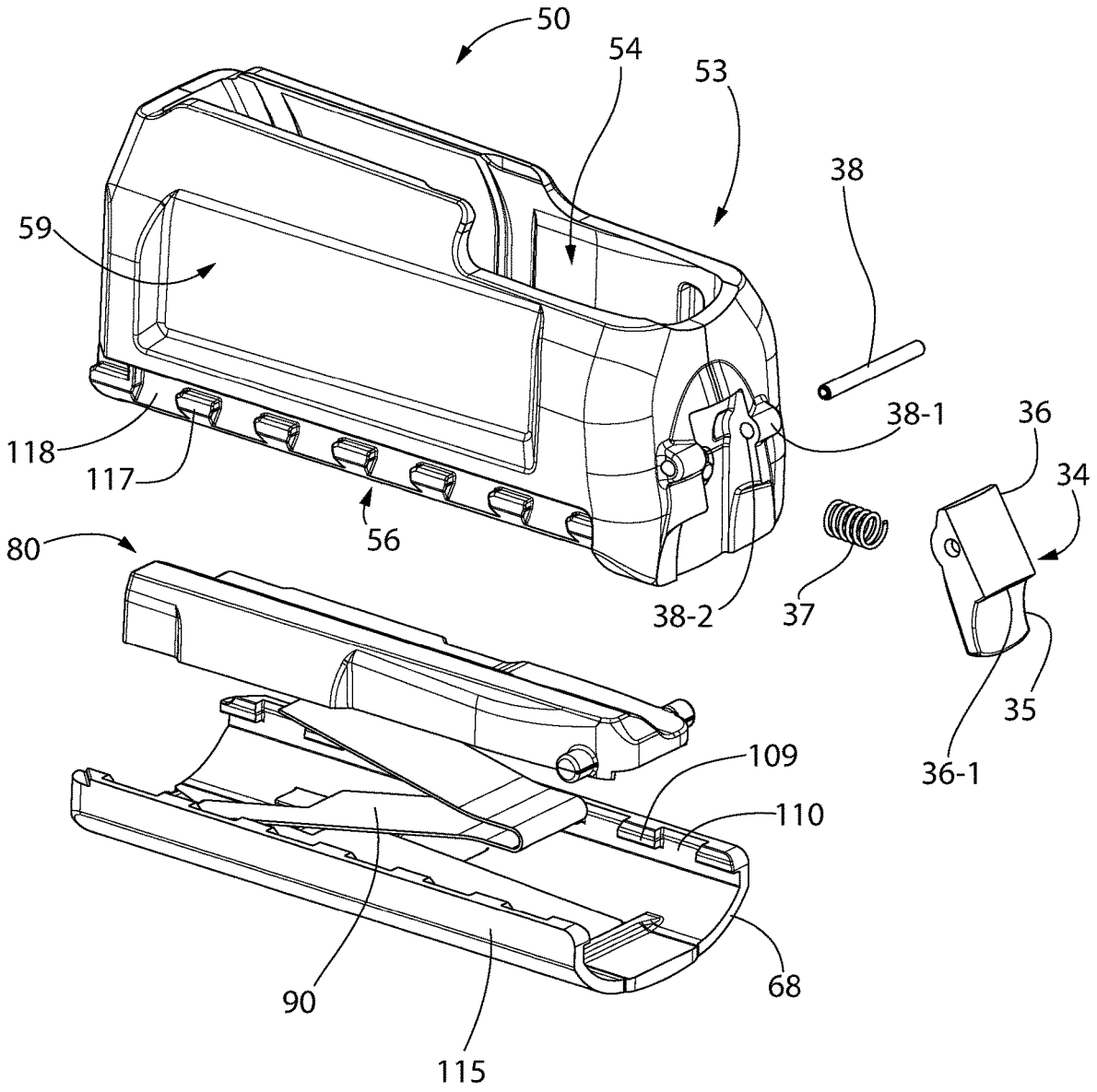
FIG. 5 is a partial front exploded perspective view of the magazine showing the cartridge feeding mechanism comprising the floor plate, main spring, and tiltable follower pre-assembled.
Figure 6:
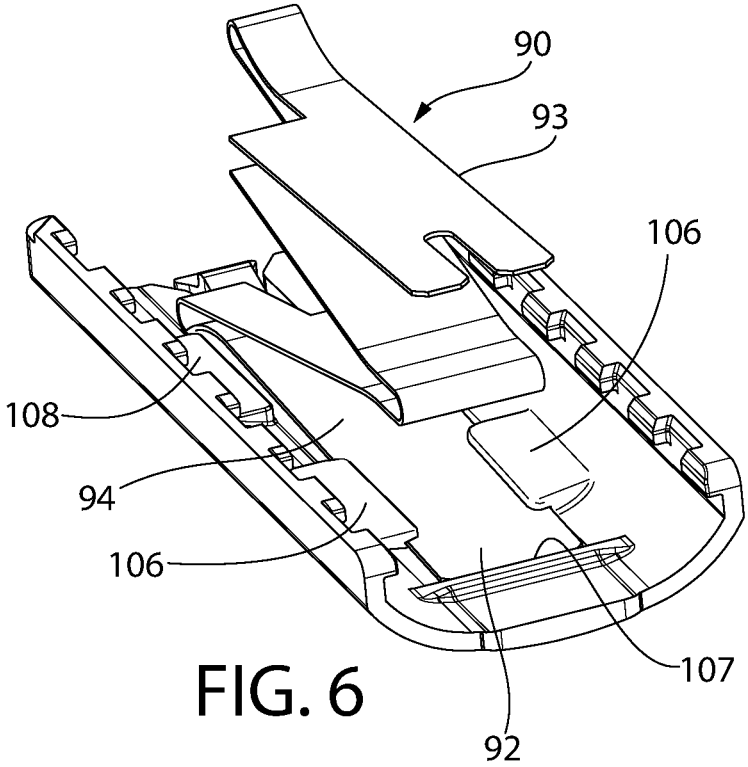
FIG. 6 is a front perspective view of the floor plate and spring.
Figure 7:
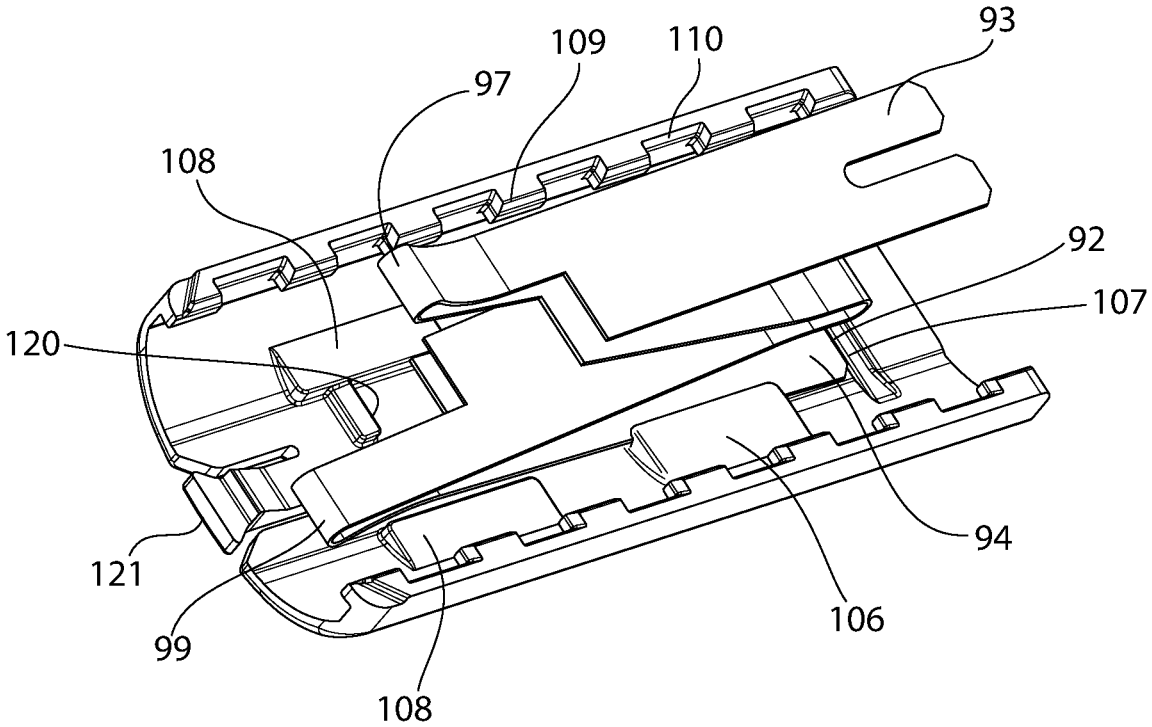
FIG. 7 is a rear perspective view thereof.
Figure 8:
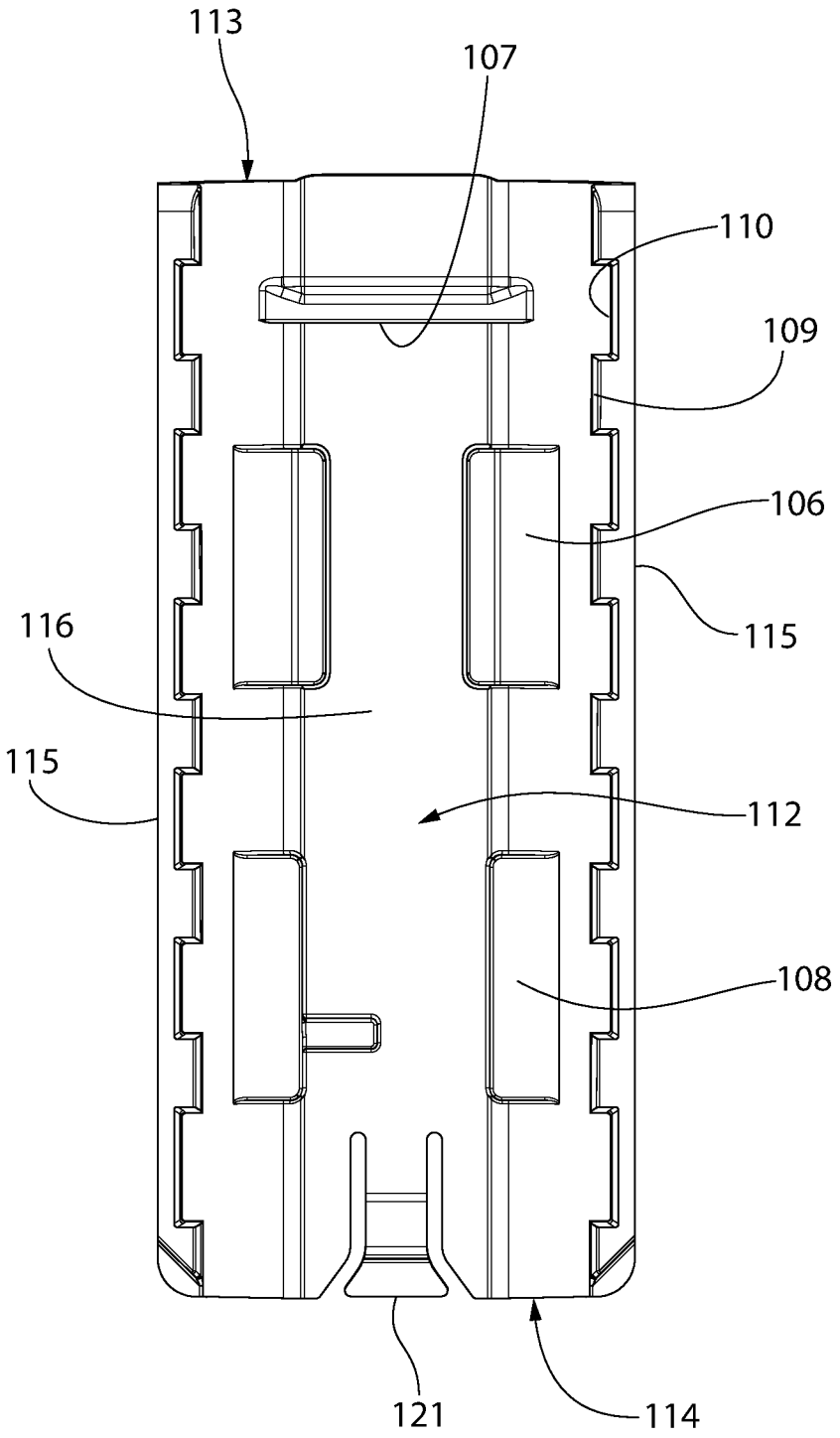
FIG. 8 is a top view of the floor plate.
Figure 9:
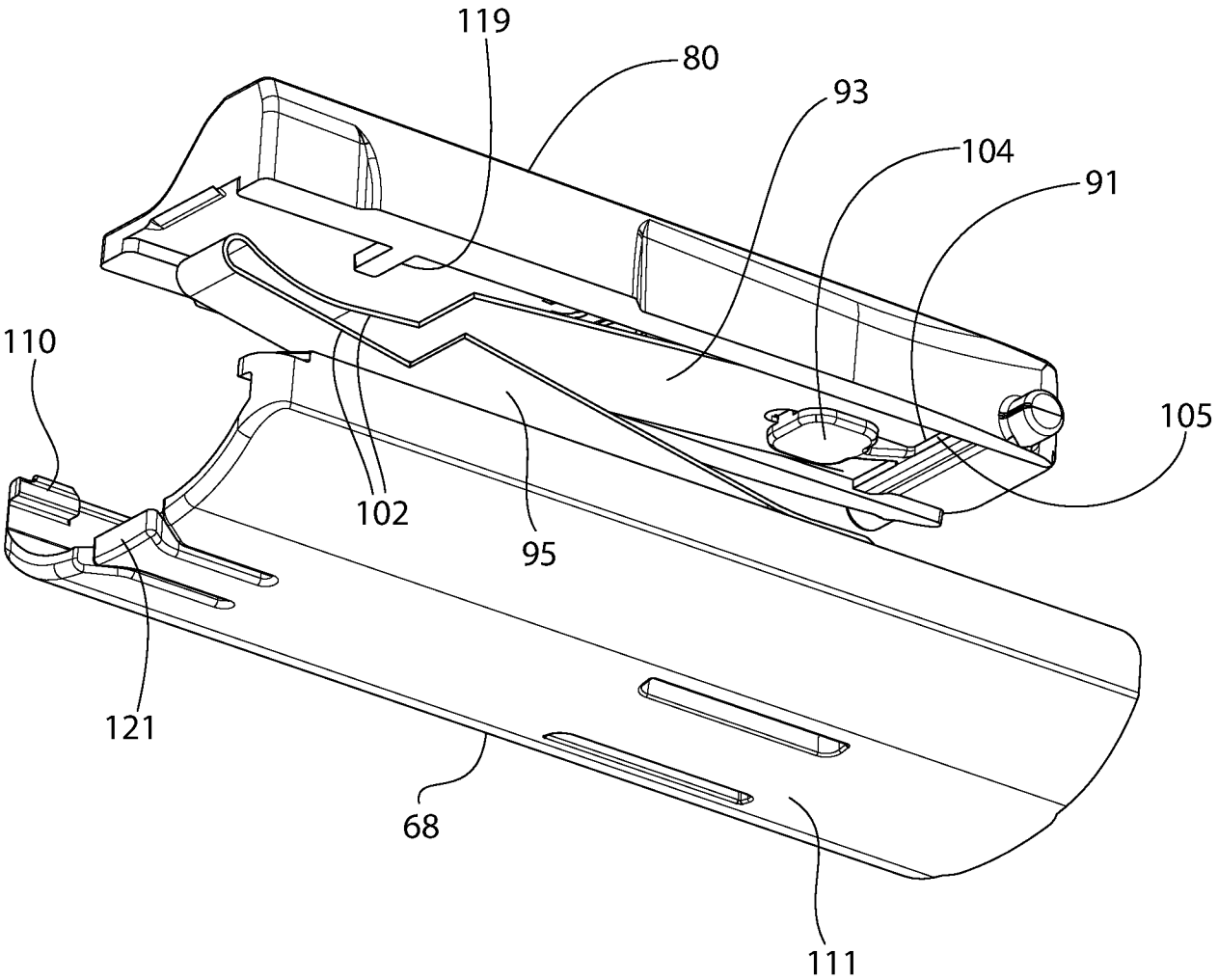
FIG. 9 is a bottom perspective view of the cartridge feeding mechanism.
Figure 10:
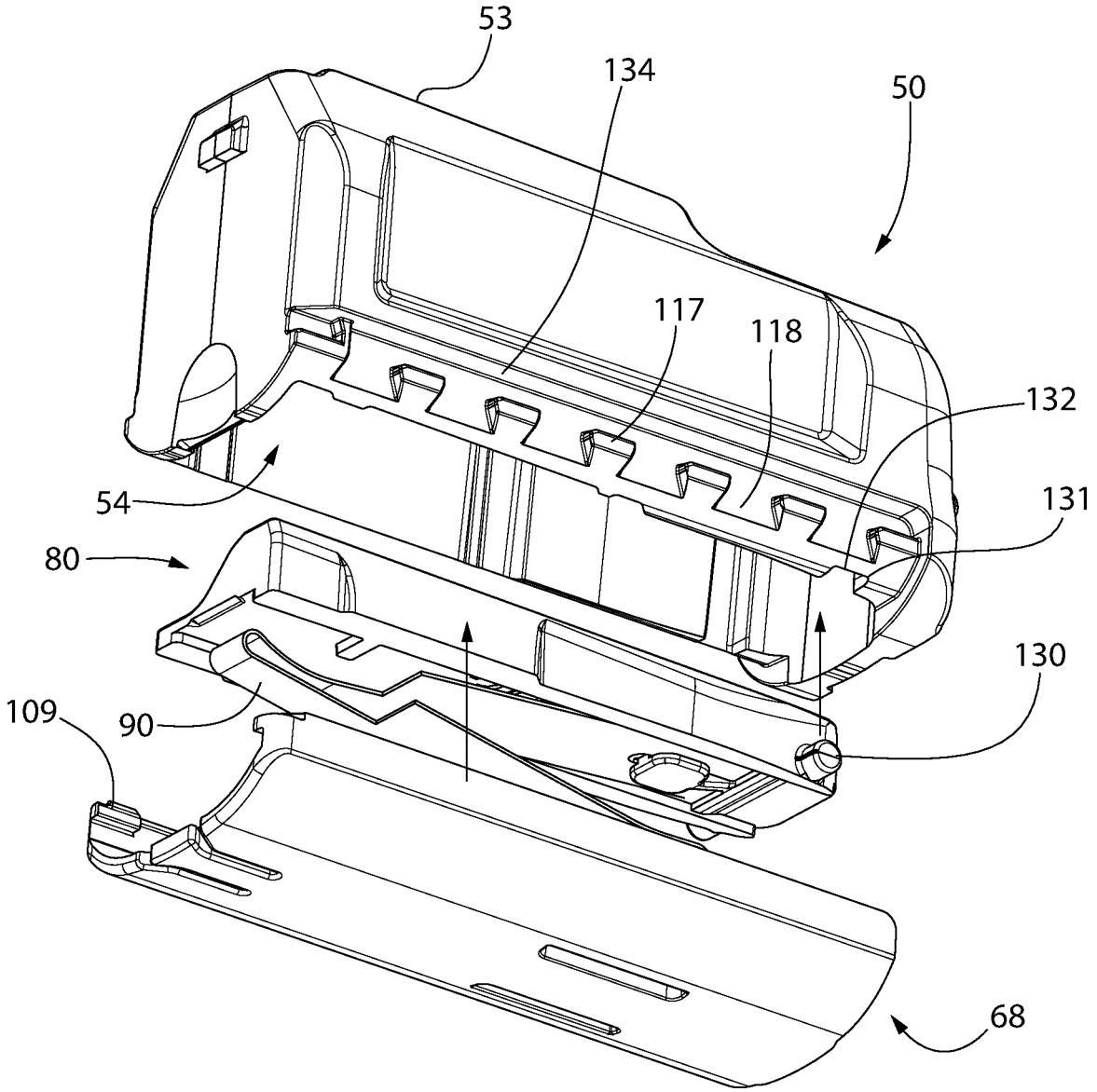
FIG. 10 is a bottom exploded perspective view of the magazine.

Latch lever 34 is mounted to front wall 57 of magazine 50 via a laterally oriented pivot pin 38 received in a pair of laterally open pin apertures 38-2 defined by mounting protrusions 38-1 (see, e.g. FIG. 5). Latch lever 43 is pivotably movable about pivot pin 38 (which defines a latch lever pivot axis) between latched and unlatched positions. Latch spring 37 automatically biases the latch lever 34 (i.e. upper retention end 36) forwards and towards the latched position engaged with magazine mounting tab 52 of the stock. Moving the lower operating end 35 of the lever rearward rotates the retention end 36 in turn forward to the unlatched position of the latch lever to disengage mounting tab 52 therefrom for releasing the magazine 50 from the stock to load loading fresh cartridges into the magazine.

When the magazine 50 is fully mounted to the stock 21 of firearm 20 as shown in FIG. 2, the bottom surface of the magazine may be substantially flush with the underside bottom surface 39 of the stock adjacent to the magazine well 32 in one embodiment. This facilitates handling, holding, and aiming of the firearm without interference from a downwardly projecting magazine. The term "substantially" connotes that there may be some slight insignificant variances in the flush mounting due to tolerance stack when affixing one component (e.g. magazine) to another component (e.g. stock) resulting from manufacturing and fit-up tolerances.

Magazine 50 will now be further described. For convenience of description which follows and reference, the magazine may be considered as defining a vertical centerline axis Cv and a horizontal centerline axis Ch extending perpendicular thereto and in an axial direction parallel to longitudinal axis LA of the firearm. The vertical and horizontal centerline axes Cv, Ch intersect at the geometric centerline of the magazine. The term "longitudinal" as used herein connotes a direction or orientation along the elongated horizontal length of the firearm or magazine. The term "transverse" connotes a direction which is at an angle to and would cross the longitudinal axis LA or horizontal centerline axis Ch.

Figure 44:
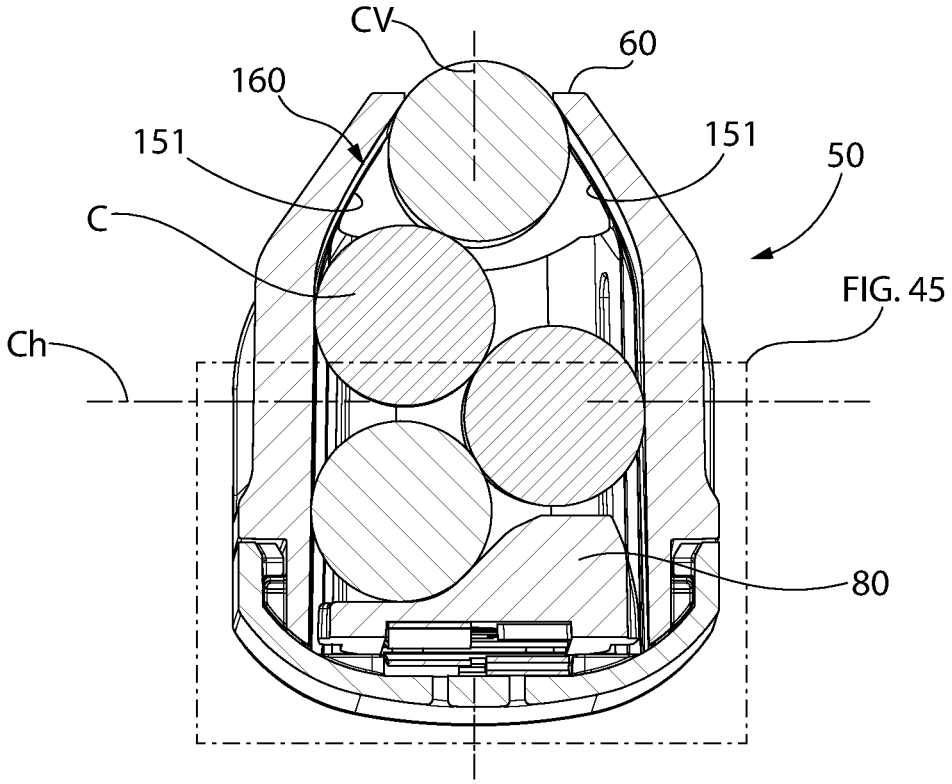
FIG. 44 is a rear cross-sectional view thereof.

Referring initially and generally to FIGS. 1-5 and 28-39, the magazine 50 has a longitudinally elongated case or housing 53 forming a body that defines an internal cavity 54 configured for holding a plurality of cartridges C. Magazine 50 has greater longitudinal length than lateral width or height. Cavity 54 extends from the top to bottom ends and front to rear ends of the magazine defining a substantially hollow housing construction. Cartridges C may be arranged and held in vertically stacked relationship comprised of a double staggered column or stack of cartridges (i.e. each cartridge is laterally offset slightly from the superseding cartridge below, as shown in FIG. 44). In one embodiment, a 60° angle may be formed between the axes of the three cartridges in the lower staggered portion of the cartridge stack in the magazine.

Figure 43:
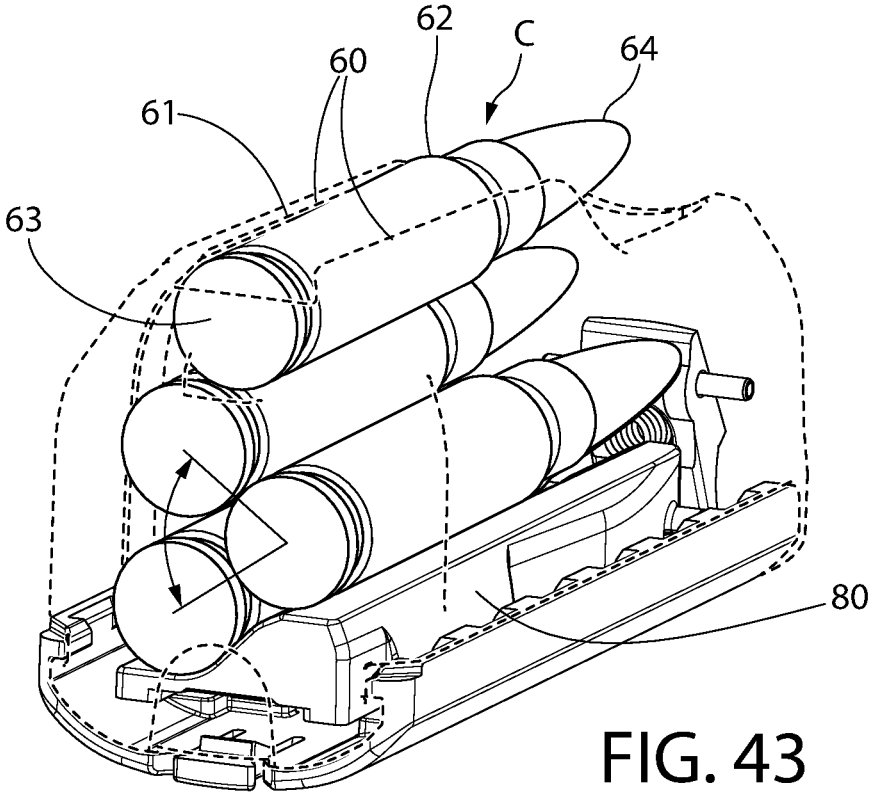
FIG. 43 is a rear perspective view of the magazine showing the cartridge stacking arrangement of the magazine.

As the cartridges C advance upwards in the magazine to the top position in the stack ready for chambering, the uppermost cartridge will fall and be centered on the vertical centerline axis Cv of the magazine as shown in FIG. 44. Cartridges below the uppermost cartridge in the stack will be laterally offset to one side or the other of axis Cv. In one embodiment of a magazine 50 having a four round capacity, two cartridges C below the uppermost one will offset to one side of axis Cv and a single cartridge will be offset to the opposite side of axis CV as shown in FIG. 43.

The housing 53 of the magazine 20 may have a horizontally elongated rectangular shape having a greater length than height. Housing 53 comprises a partially open top end 55, open bottom end 56, front wall 57, rear wall 58, and pair of opposing spaced part sidewalls 59 extending therebetween along the longitudinal axis. The walls 57-59 may be configured such that opposite walls (e.g. sidewalls 59 and the front and rear walls 57, 58) may be orthogonally oriented and parallel to each other. The magazine housing 53 may be formed of a suitable preferably lightweight but durable metallic or non-metallic material such as without limitation a metal (e.g. aluminum) or preferably a polymer/plastic in one non-limiting embodiment.

The top end 55 of the magazine is substantially open and includes a pair of laterally spaced and inwardly angled or curved cartridge feed lips 60. The feed lips are configured to engage and retain the uppermost cartridge 30 in the stack. This prevents the column or stack of cartridges C from being vertically ejected from the magazine by the spring feed mechanism further described herein. The feed lips 60 thus define an opening therebetween smaller than the lateral width of the cartridge.

Figure 46:
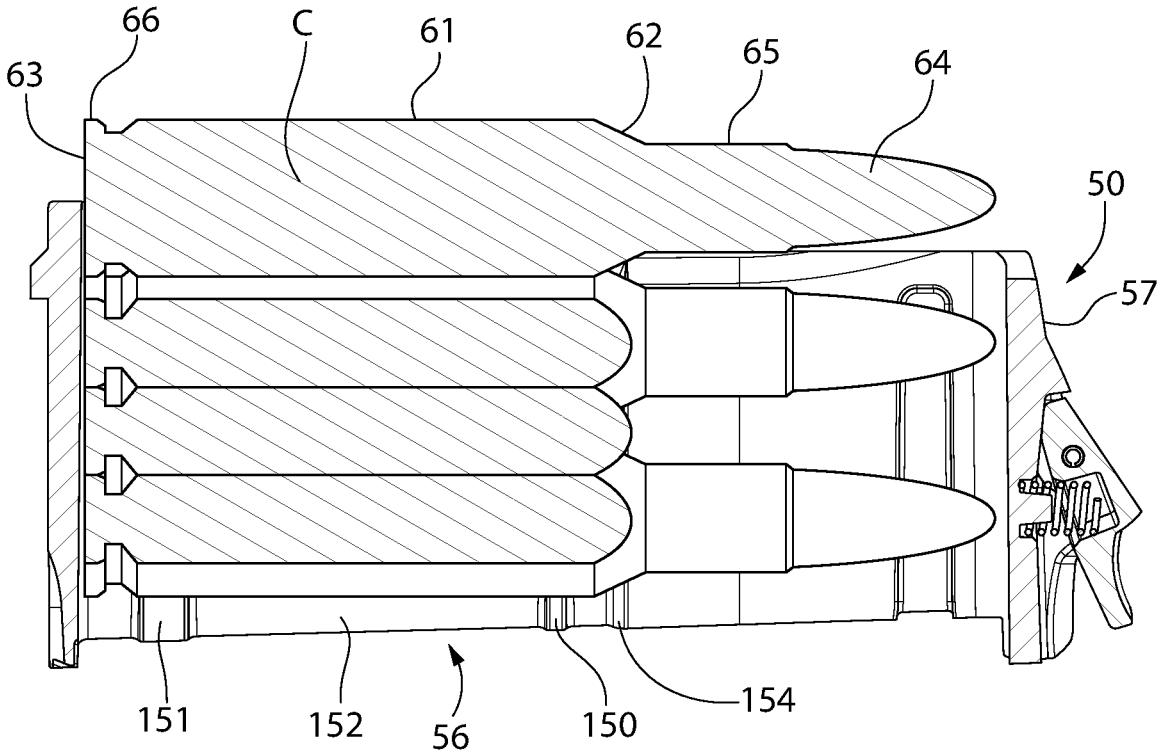
FIG. 46 is a side cross-sectional view of the magazine showing the stack of cartridges.
Figure 47:
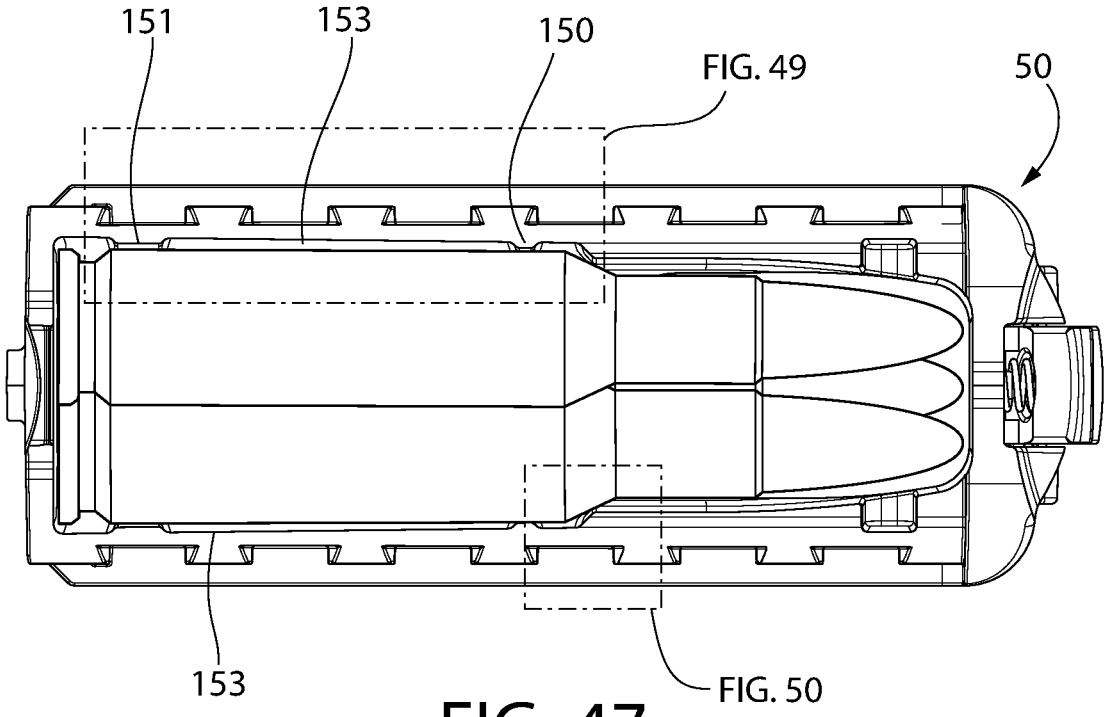
FIG. 47 is a top view thereof.
Figure 48:
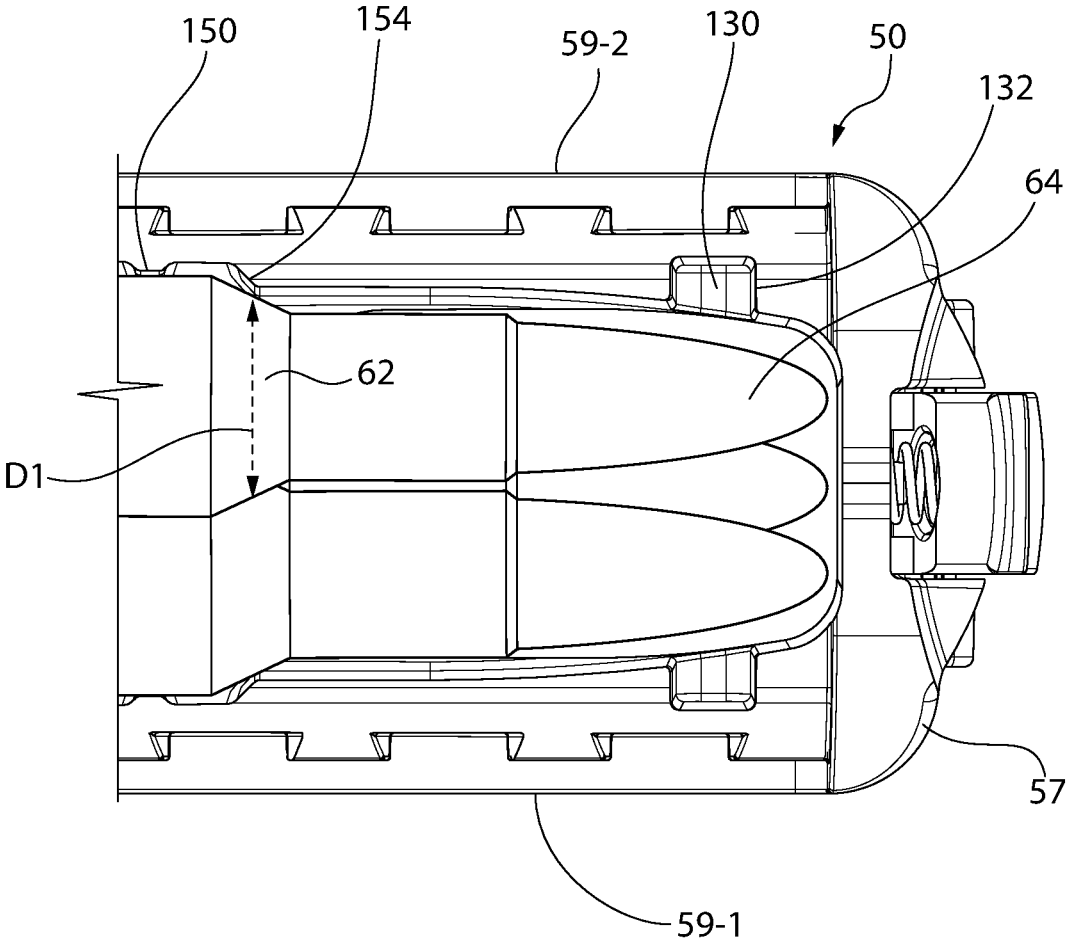
FIG. 48 is an enlarged view taken from FIG. 47 showing details of fronts of the cartridge and front wall of the magazine.

The cartridges C may be a centerfire type cartridges as illustrated in some embodiments. Referring to FIG. 46, cartridge C includes a rear head or base 63 having an annular extraction rim 66 and a centered primer cap (not shown), a bottle-shaped case including a longitudinally straight rear portion 61 adjacent to the base, diametrically narrow neck 65 at front, and stepped or angled shoulder 62 at the transition therebetween. A projectile 64 (e.g. slug or bullet) is inserted and mounted in the open neck end of the cartridge. Other configurations and/or types of cartridges such as rimfire cartridges may be used.

Figure 53:
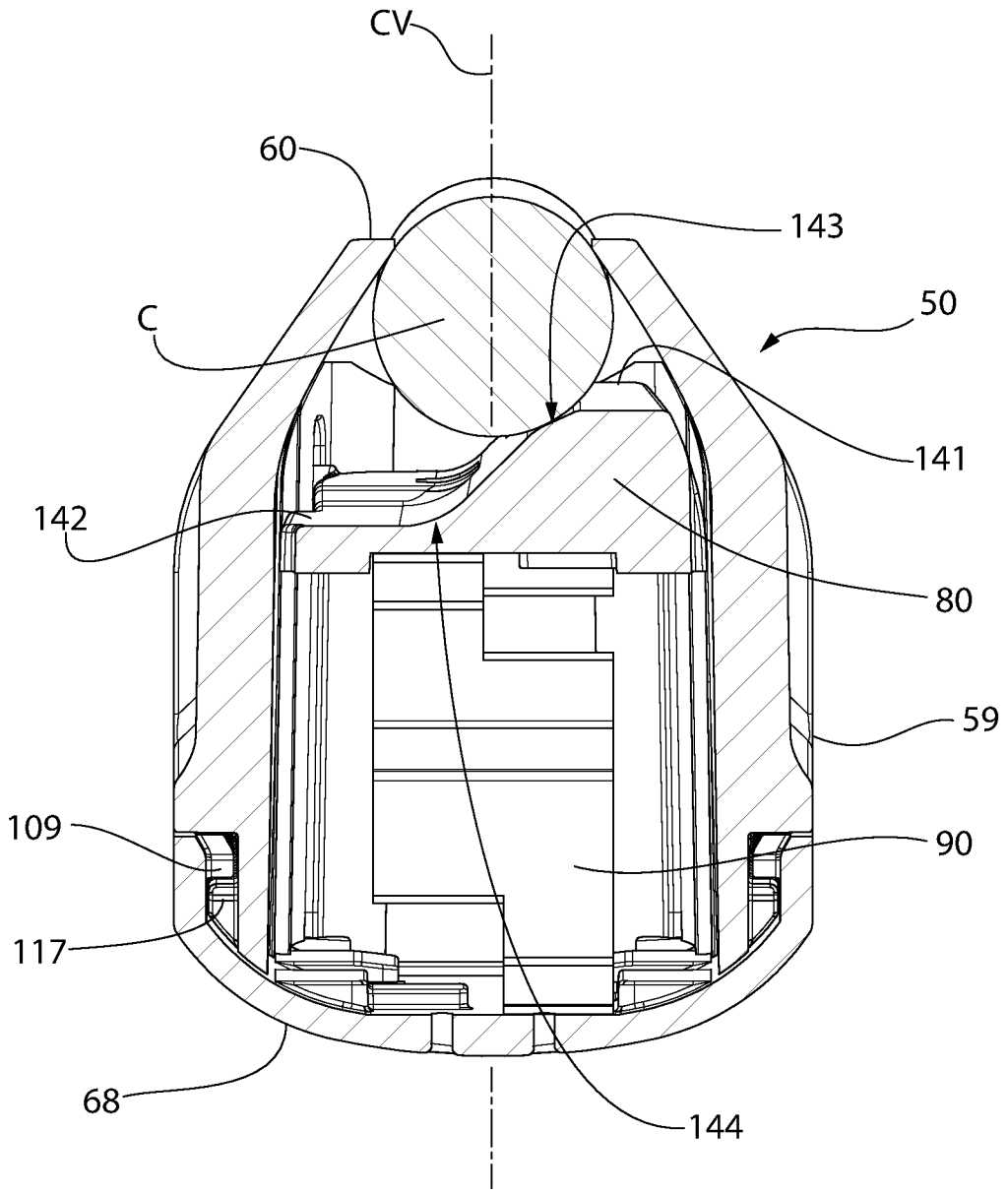
FIG. 53 is a third sequential view thereof.

In one embodiment, best shown in FIGS. 43-44 and 53, the feed lips 60 may be configured and positioned to engage the generally parallel and longitudinally straight opposing upper side portions 61 of the cartridge case between the shoulders and the base 63. In one embodiment, the feed lips 60 may be formed integrally with the housing 53 as a unitary structural portion thereof. In such an embodiment, the upper portions of housing sidewalls 59 may gradually converge inwardly toward vertical centerline axis Cv of the magazine to form feed lips 60. In other possible constructions, the feed lips 60 may be separate elements rigidly affixed to the upper portions of the magazine sidewalls. In either case, the magazine housing 53 and feed lips 60 are preferably rigid in structure to prevent the feed lips from bending and inadvertently allowing the uppermost cartridge in the stack to escape vertically between the lips.

The feed lips 28 extend axially forward from a point proximate to the rear wall 58 of magazine housing 53 and terminate at a point spaced rearward from the front wall 57 by a sufficient horizontal distance to allow the cartridges to be axially/horizontally stripped from or inserted into the magazine beneath the feed lips 60. In one embodiment, the feed lips may terminate approximately midway between the front and rear walls of the magazine. Such arrangements of feed lips are well known in the art.

According to one aspect of the invention, magazine 50 includes a unique internal spring feed mechanism for automatically uploading cartridges into the breech area of the firearm 20 for chambering and firing. Referring initially to FIGS. 2, 5-7, 18-32, and 40-42, the spring feed mechanism is disposed in the cavity 54 of the magazine housing 53. The feed mechanism may include an axially/horizontally elongated follower 80, main spring 90, and bottom floor plate 68 which attaches to the bottom end of the magazine housing 53, as further described herein. The spring 90 biases the follower and stack of cartridges supported thereon upwards towards the open top end 23 of the magazine. These components are further described below.

Figure 21:
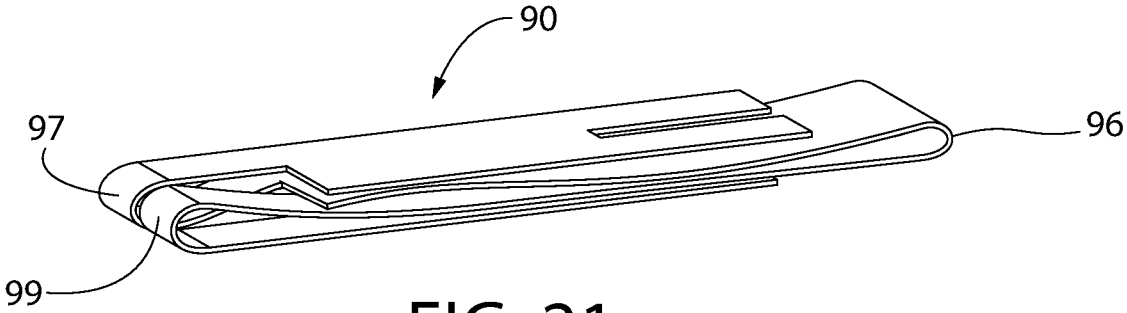
FIG. 21 is a side view of the present spring.
Figure 22:
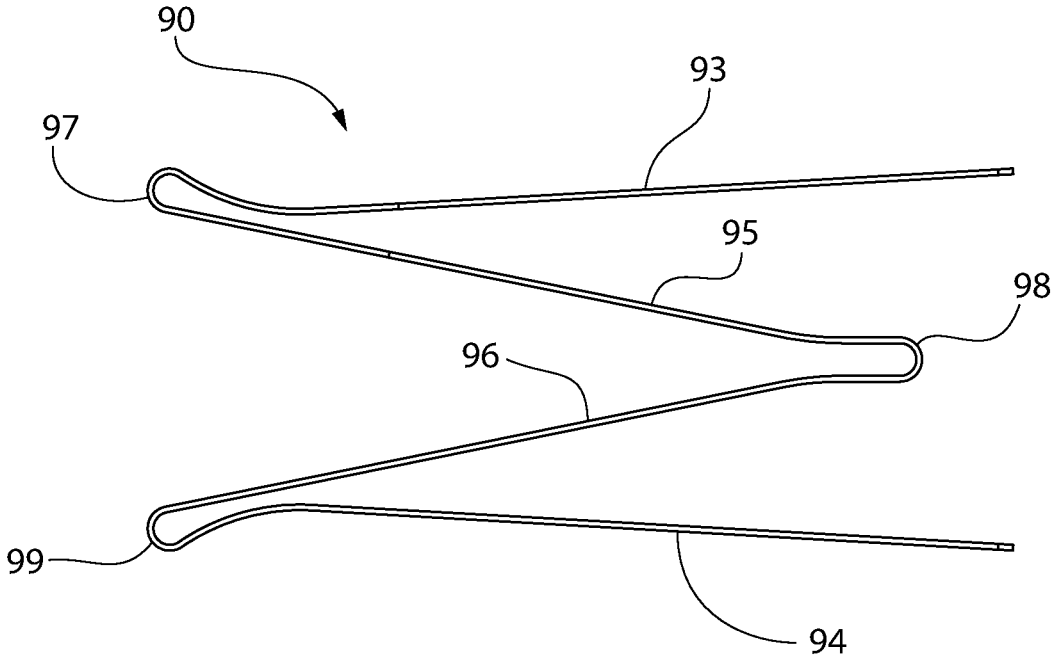
FIG. 22 is a front perspective view thereof.
Figure 23:
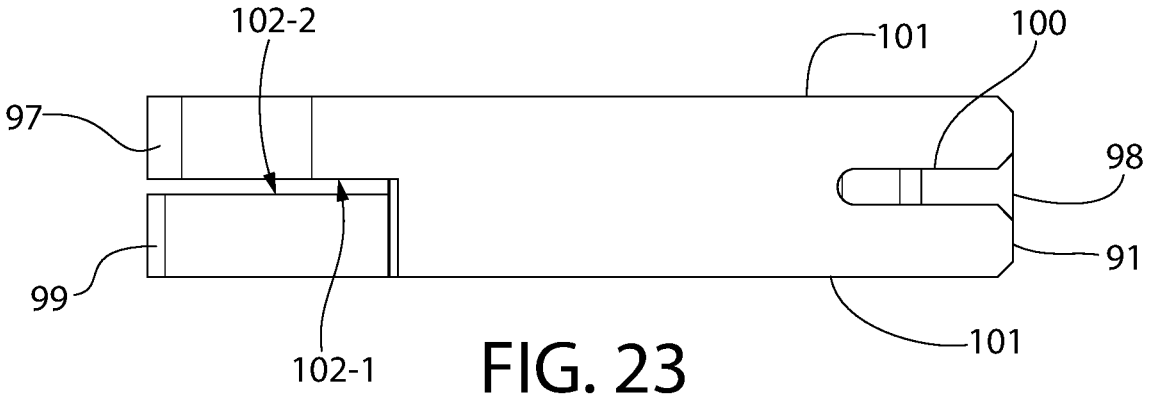
FIG. 23 is a top view thereof.
Figure 24:
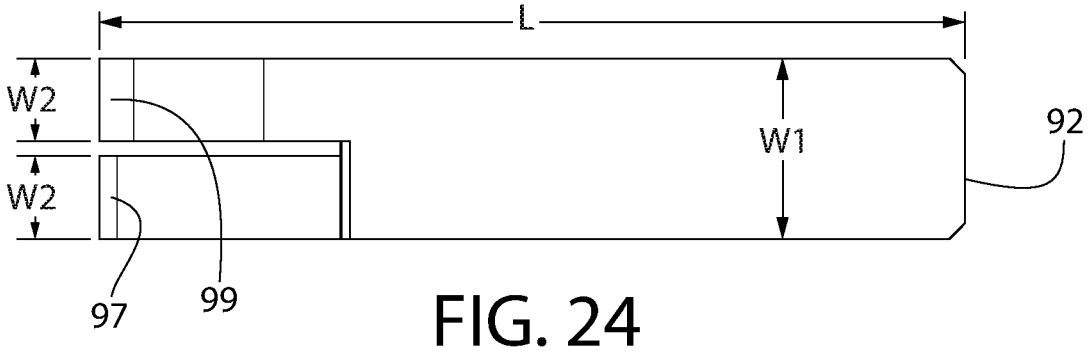
FIG. 24 is a bottom view thereof.
Figure 25:
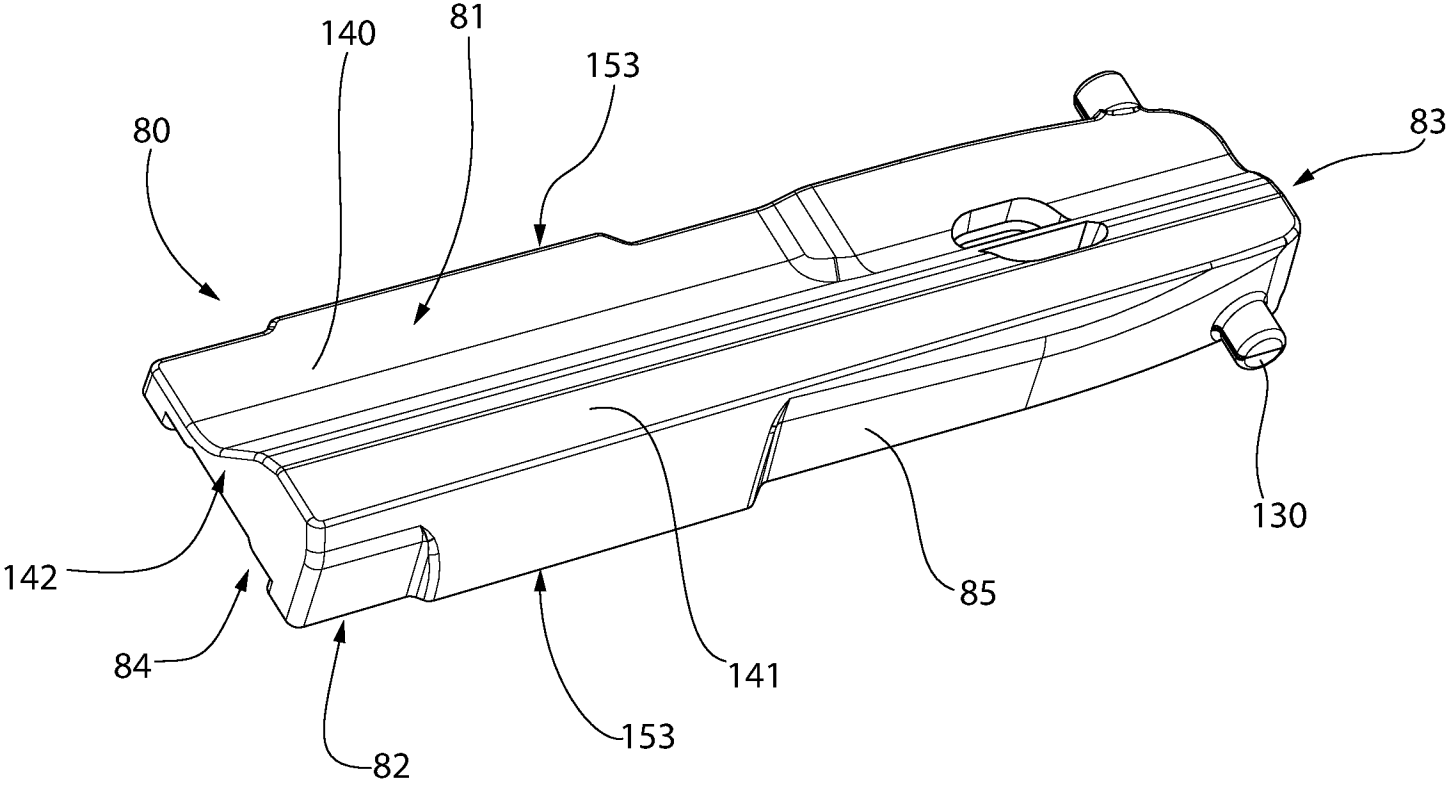
FIG. 25 is a top perspective view of the tiltable follower.
Figure 27:
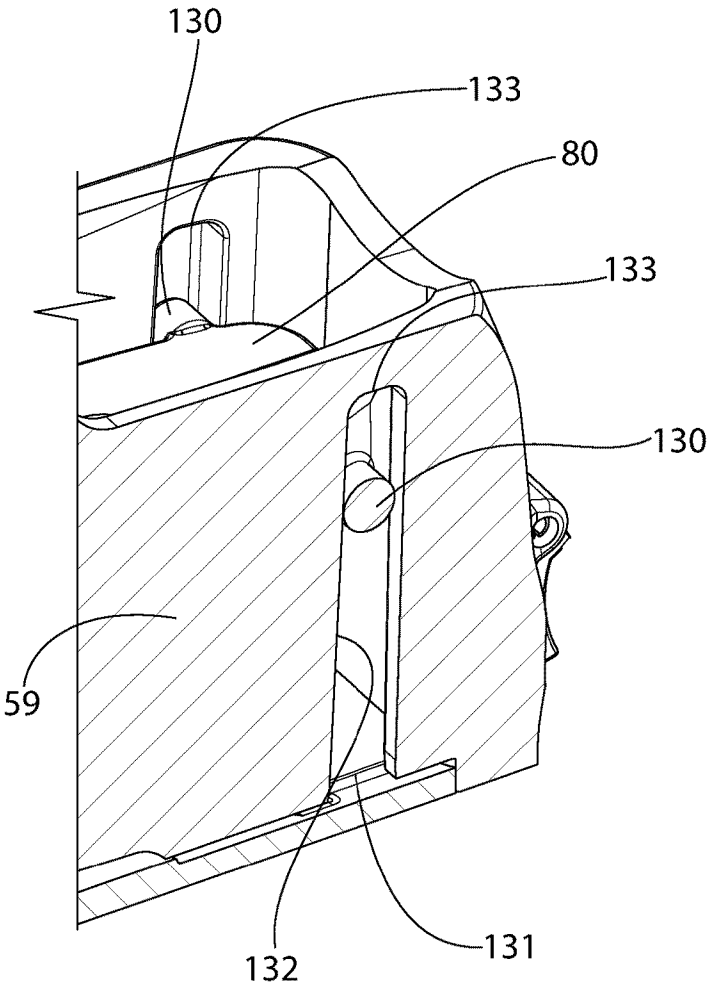
FIG. 27 is a second cross-sectional perspective view thereof showing the follower guide/tilting in a second lower position.
Figure 26:
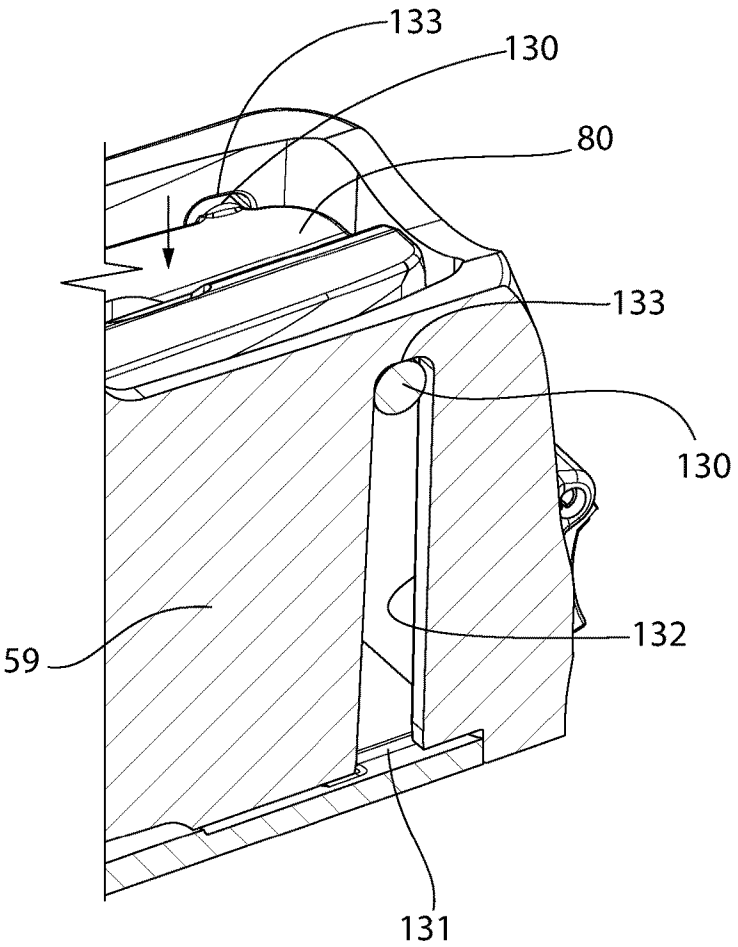
FIG. 26 is a first cross-sectional perspective view of the magazine showing the follower guide/tilting mechanism in a first fully upper position.

One desirable aspect of the present magazine design is that it preferably should be substantially a flush fit to the pre-existing stock (see, e.g. FIG. 2). This means that space is at premium inside the internal cavity of the magazine for housing the internal spring feed mechanism components. One thing that limits amount of available space inside the magazine for holding cartridges is the solid height of the main spring when in a fully compressed condition. In a traditional flat wire magazine spring (see, e.g. FIG. 18), the solid height is limited by the folds which end up stacking on top of each other, thereby detrimentally increasing the compressed height of the spring with a fully loaded magazine. In order to decrease the solid height of the spring in a way which maintains the desired cartridge capacity of the magazine and provide for substantially flush underside mounting to the stock, the magazine main spring 90 in the present magazine includes cutaway parts of the spring fold described below (see, e.g. FIGS. 19-24). This advantageously allows the otherwise stacked spring folds to rest instead side to side next to each other, thereby cutting the compressed solid height in approximately half (compare FIG. 21 present design to FIG. 18 standard design). These cutout features are also advantageously used to control and limit the front to back movement of the spring 90 in the final assembly and interaction with the floor plate and follower.

FIGS. 19-24 and 31-32 show magazine main spring 90 isolated from other components of the magazine. In one embodiment, as depicted, the main spring 90 may be an accordion or corrugated type contractible and expandable flat spring having a continuous structure and undulating zig-zag configuration formed from a triple folded single flat piece of spring material having a greater width than thickness. The spring 90 is configured such that no portion or segment of the spring crosses another portion or segment in the same horizontal reference plane when in a fully expanded condition. In some embodiments, the spring 40 may be a constant force spring; however, variable force springs may be used as well. Spring 90 includes a single bottom terminal end 92 and a single top terminal end 91 each of which are fixedly attached to the floor plate 68 and follower 80 respectively as further described below.

The main spring 90 has a body with a folded length L, full width W1, and a uniform thickness T. Specially located partial width portions with a width W2 less than width W1 are provided and associated with a special flat-folding feature of the invention further described herein. Widths W1 and W2 may each be greater than the thickness T. In the flat condition prior to bending, spring 90 has a rectangular shape with opposing straight or linear longitudinally-extending parallel sides 101 preferably uninterrupted by any recesses or cutouts. After bending to the accordion shape by any suitable spring bending/forming method, the longitudinal sides 101 remain free of any recesses or cutouts. Spring 90 may be formed of any metallic spring material suitable for the application.

Spring 90 includes an axially (horizontally) elongated top leg 93, an axially elongated bottom leg 94, an axially elongated upper intermediate leg 95 joined to the top leg by a recurvant top bend 97, and an axially elongated lower intermediate leg 96 joined to the bottom leg by a recurvant bottom bend 99, and a recurvant intermediate bend 98 disposed between bends 97, 99 joining the upper and lower intermediate legs together. Top and bottom bends 97 and 99 are partial width bends having a width W2 less than the full width intermediate bend 98. In one embodiment, width W2 at bends 97, 99 and immediately adjoining portions of the spring body as shown is about ½ the full width W1 of the spring. Bends 97, 99 are located adjacently at one end of the spring (i.e. rear end when mounted in the magazine) and full width bend 98 is located at the opposite end of the spring.

In one embodiment, the foregoing reduced partial width bends and portions of the spring 90 are formed by inwardly open lateral cutouts 102. A mated pair of cutouts 102 are provided which advantageously allows adjacently located bends top and bottom bends 97, 99 of the spring to nest together laterally in a side to side relationship when the spring is in a fully compressed condition (see, e.g. FIG. 20). In prior art flat accordion or corrugated type springs shown in FIG. 18 and described above, adjacent bends are vertically stacked one above the other which increases the folded height of the spring and reduces magazine cartridge capacity without increasing the height of the magazine case which is contrary to providing a magazine capable of flush mounting with the underside of the stock. By stark contrast, the present spring 90 with cutout 102 allows adjacent bends of the spring body to lie in the same horizontal reference plane in lateral side to side relation, which dramatically reduces the folded height of the spring thereby facilitating the goal of flush magazine mounting to the stock.

The spring cutouts 102 include a right cutout 102-1 laterally open to the right lateral sidewall 59-1 of the magazine housing 53 and an adjacent left cutout 102-2 laterally open to the left lateral sidewall 59-2 of the housing. The paired cutouts 102 face laterally inwards towards each other and are arranged in direct opposing relationship to each other. Right cutout 102-1 is formed at rear bottom bend 99 and immediately adjoining portions of the spring body in the intermediate lower leg 96 and bottom leg 94. Left cutout 102-2 is formed at rear top bend 97 and immediately adjoining portions of the spring body in the intermediate upper leg 95 and top leg 93. Both cutouts may have a rectilinear shape. The cutouts 102 may be formed by any suitable method such as cutting, stamping, or other.

Referring now generally to FIGS. 9, 19-24, 30, and 40-42, the front terminal end 91 of the spring top leg 93 is affixed to the underside or bottom surface of the follower 80. In one embodiment, the end of the top leg 93 may be bifurcated and includes an endwise and forwardly open mounting slot 100 which is axially elongated. Slot 100 may be centered on the end. The slot 100 slideably receives and engages a spring retention protrusion 104 formed on the bottom surface 82 of the follower 80 for securing the top end 91 of the spring. Protrusion 104 may have an inverted T-shape in one embodiment. The top leg 93 slides underneath a laterally broadened bottom portion of the retention protrusion 104 and is trapped between the protrusion and the underside of the follower. A transversely oriented top abutment surface 105 may be provided forward of the retention protrusion 104 on the underside of the follower 80. Surface 105 forms a hard stop which is arranged to engage the terminal front end 91 of the spring top leg 93 and prevent over-insertion of the leg beneath the protrusion. A transversely oriented rear abutment surface 119 may be formed on follower 80 which is positioned to engage the upper cutout 102-2 on spring 90. Abutment surface 119 forms a rear hard stop which restricts possible front to rear movement of the top spring leg 93 to prevent removing the spring leg from beneath the front retention protrusion 104 when the spring is fully compressed or when installing the spring and follower assembly in the magazine.

The bottom leg 94 of the spring is affixed to the top of the floor plate 68. In one mounting arrangement, with particular emphasis on FIGS. 5-8 and 30, the floor plate 68 includes a pair of laterally spaced apart and inwardly extending retention tabs 106 proximate to the front end of the plate that slideably engage the bottom leg 94 of the spring 90 for securing the spring thereto. The tabs 106 are configured to form a recess underneath which engages the lateral longitudinal edges of the spring bottom leg 94. Transversely oriented bottom abutment surface 107 formed on the floor plate 68 abuttingly engages the terminal front end 92 of the spring bottom leg 94 when the spring is inserted beneath the retention tabs 106. This limits the insertion of spring bottom leg 94 beneath the retention tabs to ensure proper fixation and mounting of the spring with the floor plate. A pair of laterally spaced apart guide tabs 108 may be formed rearward of retention tabs 106 on floor plate 68 to keep the rear portion of the spring bottom leg 94 centered on floor plate. In addition, a transversely oriented rear abutment surface 120 may be formed on floor plate 68 which is positioned to engage the lower cutout 102-2 on spring 90. Abutment surface 120 forms a rear hard stop which restricts possible front to rear movement of the bottom spring leg 94 to prevent removing the spring leg from beneath the front retention tabs 106 when the spring is fully compressed or when installing the spring and floor plate assembly in the magazine.

Figure 30:
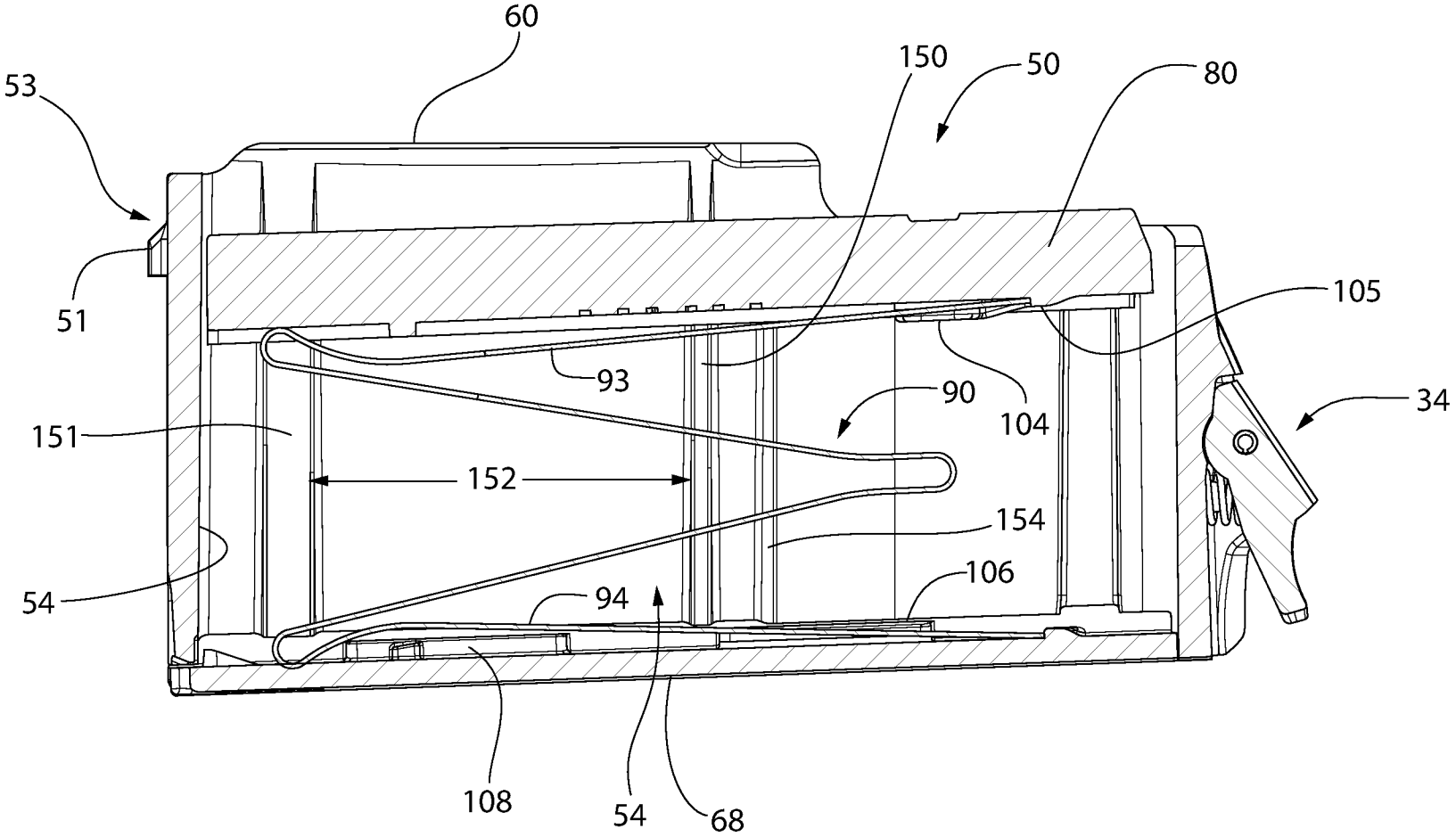
FIG. 30 is a side cross-sectional view of the magazine.
Figure 31:
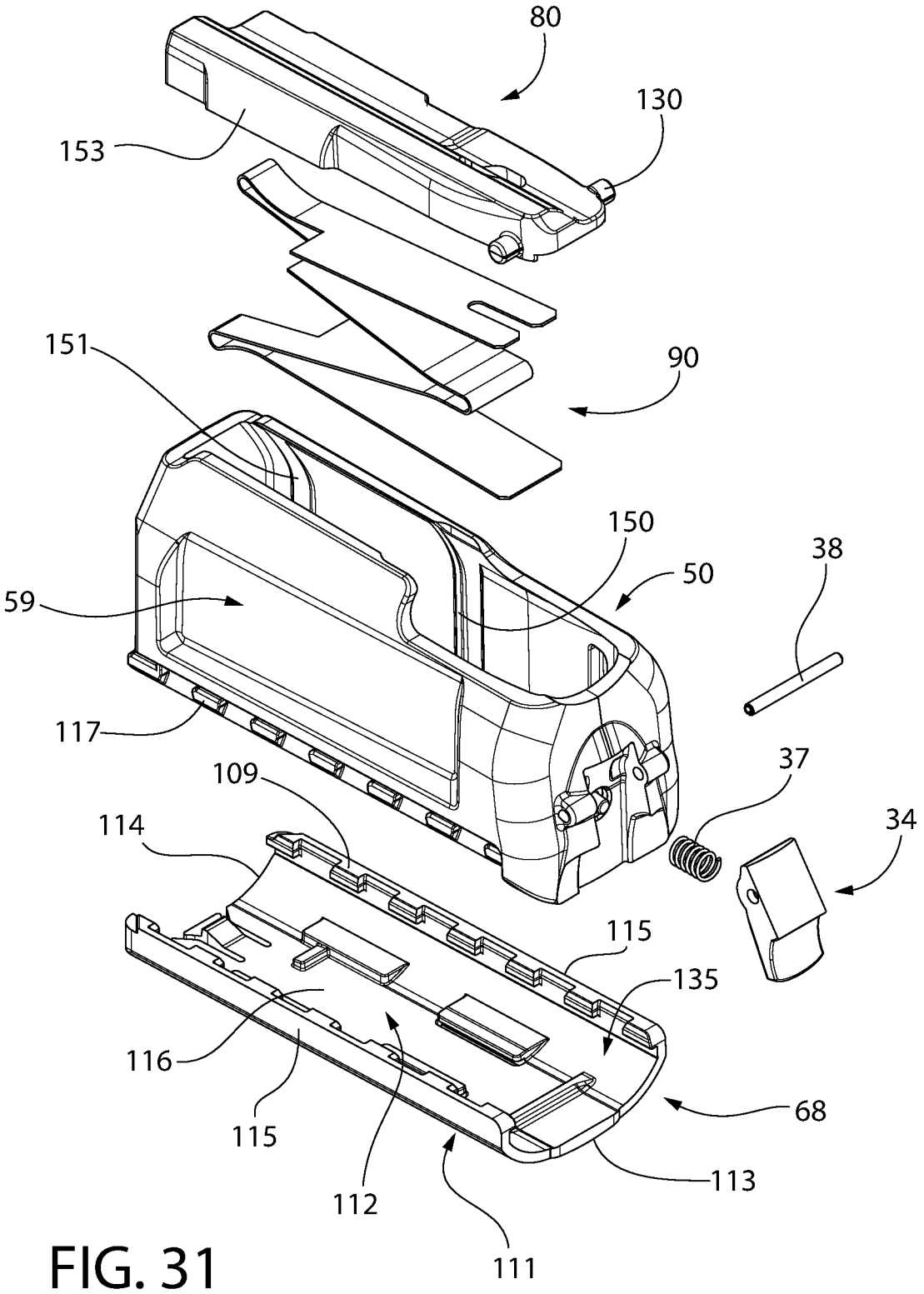
FIG. 31 is a fully exploded top perspective view thereof.
Figure 32:
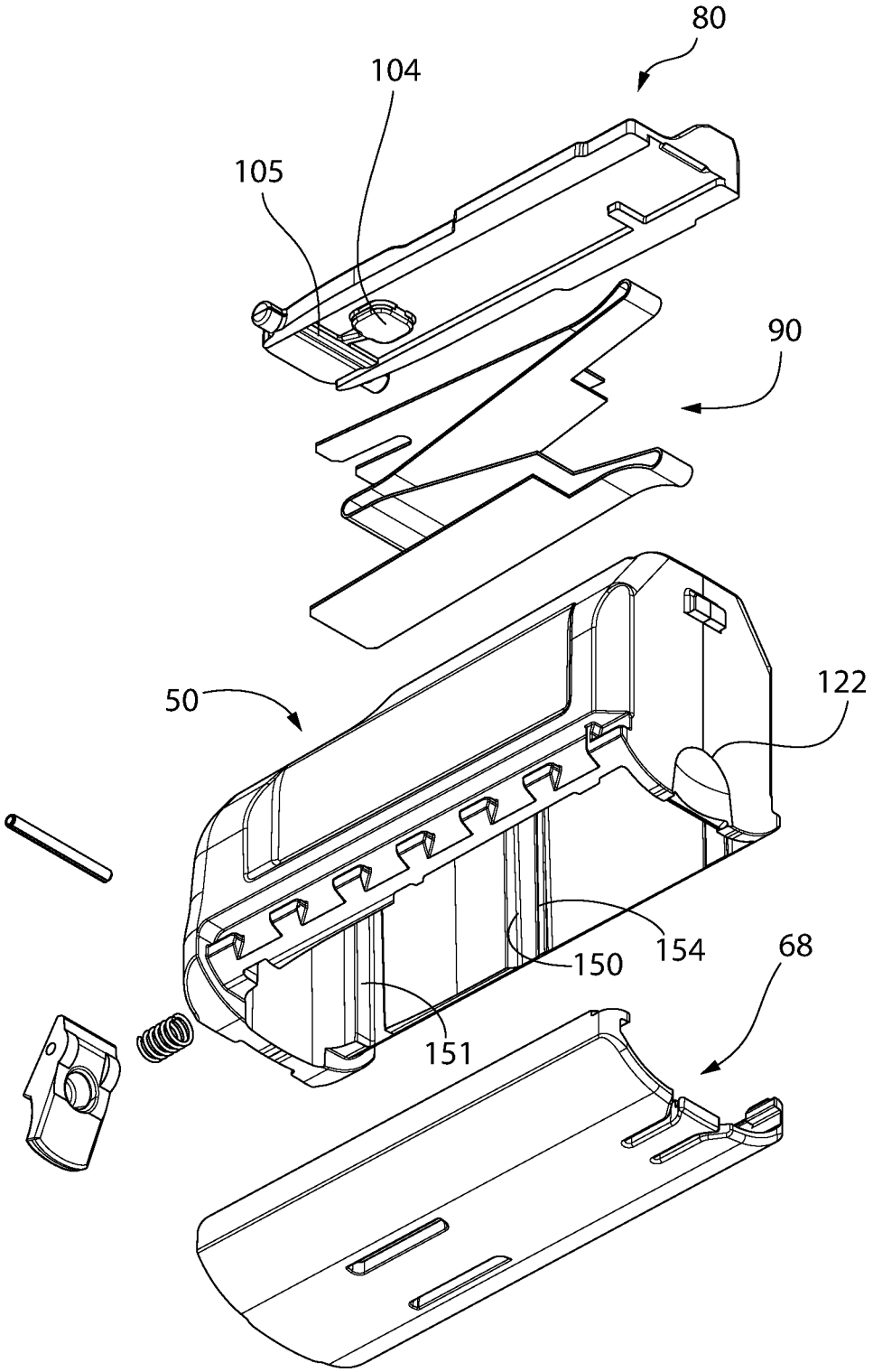
FIG. 32 is a fully exploded bottom perspective view thereof.
Figure 33:
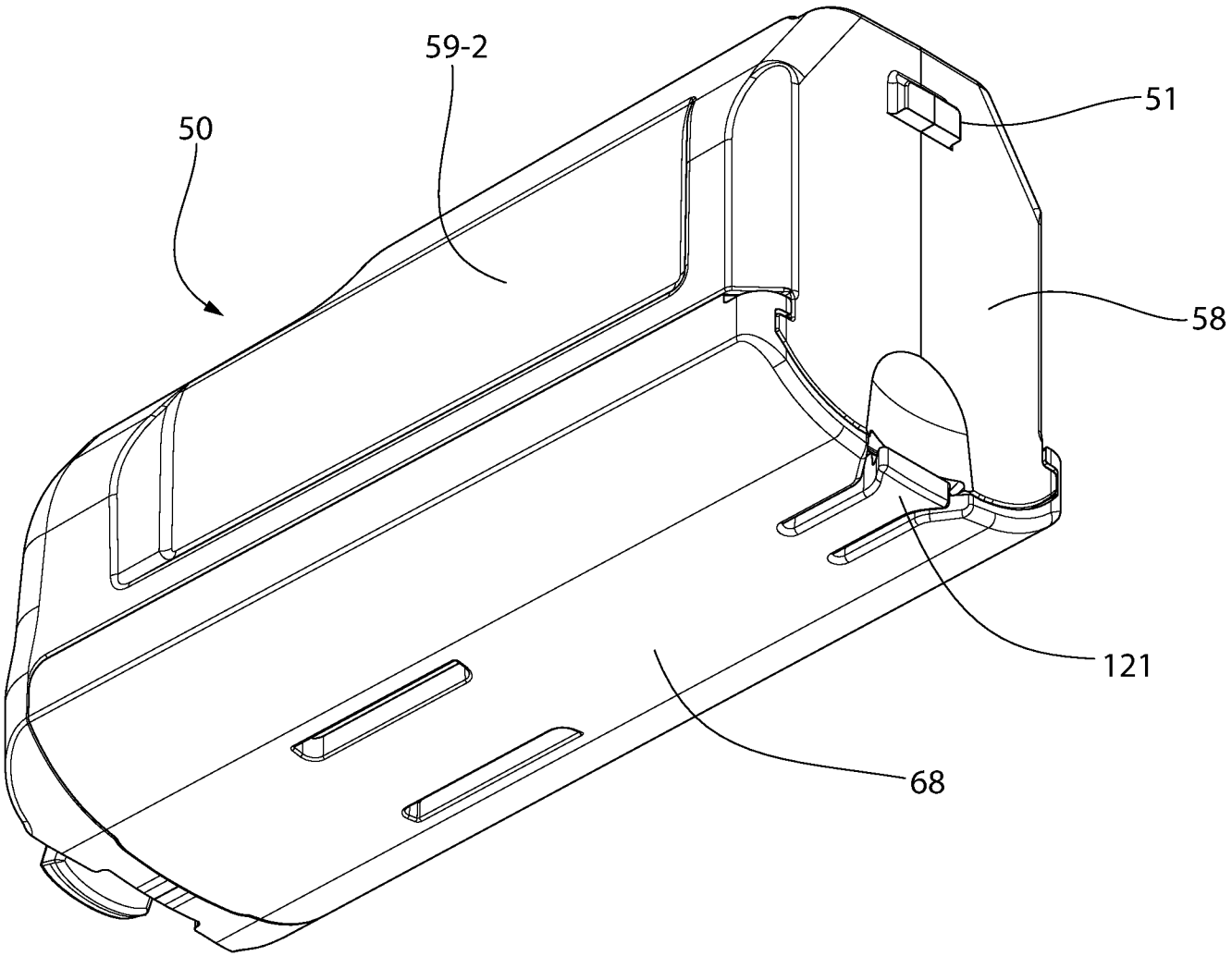
FIG. 33 is a bottom perspective view of the magazine.
Figure 34:
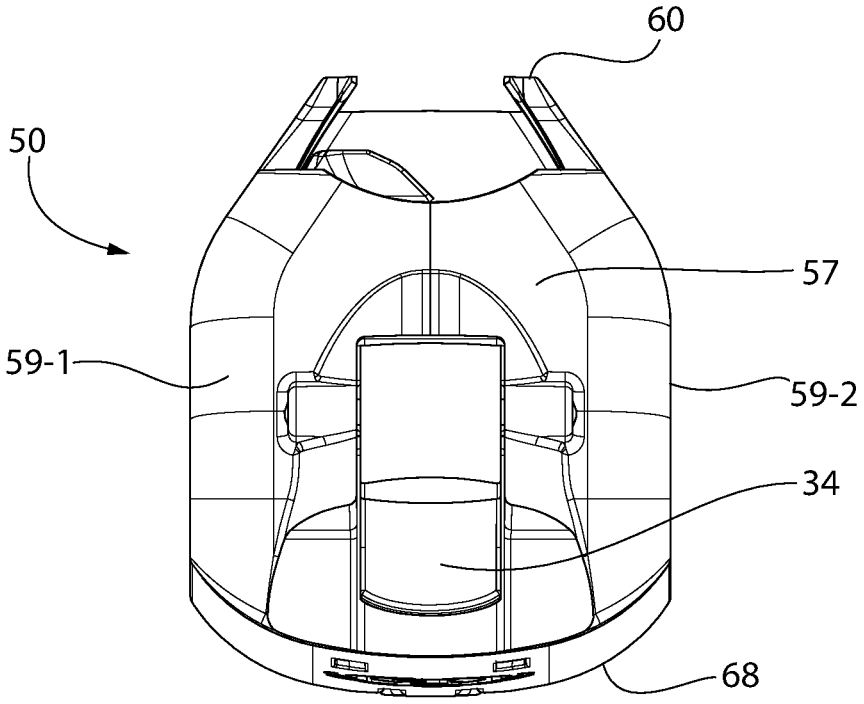
FIG. 34 is a front view thereof.
Figure 35:
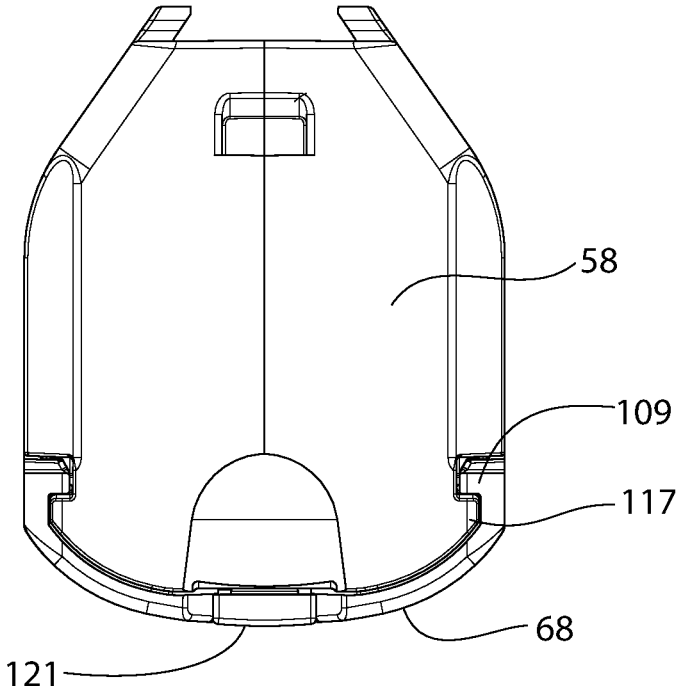
FIG. 35 is a rear view thereof.
Figure 36:
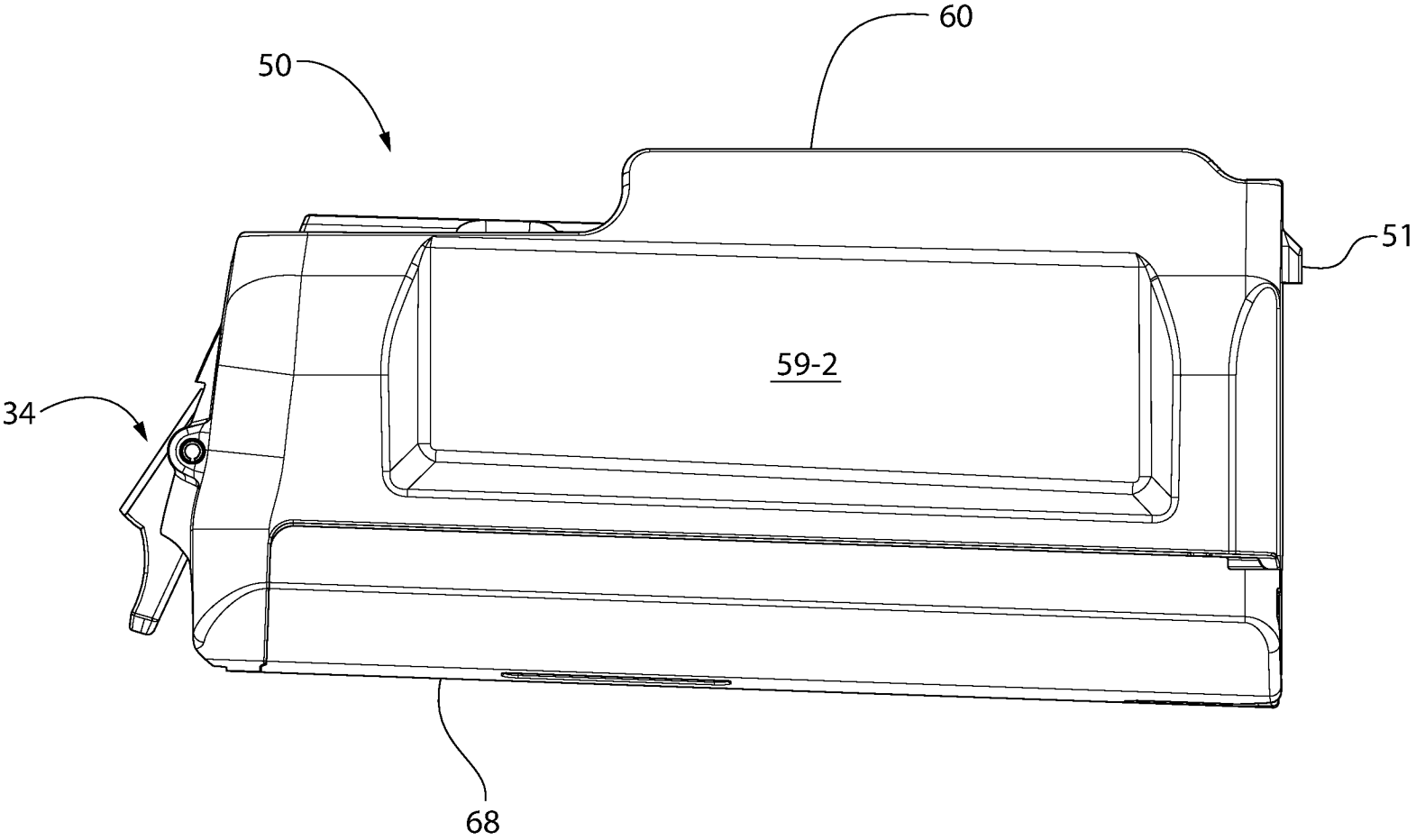
FIG. 36 is a left side view thereof.
Figure 37:
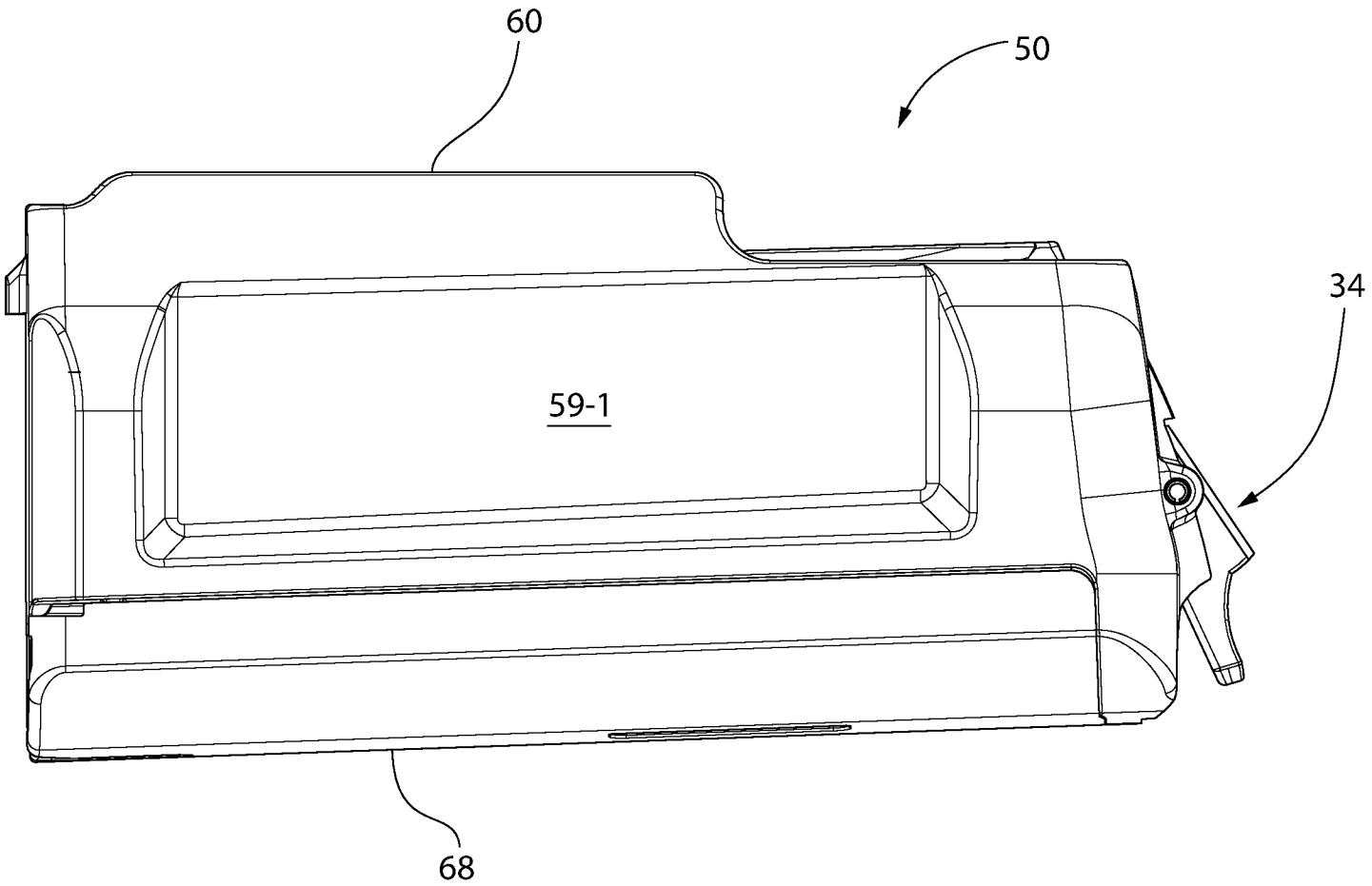
FIG. 37 is a right side view thereof.
Figure 38:
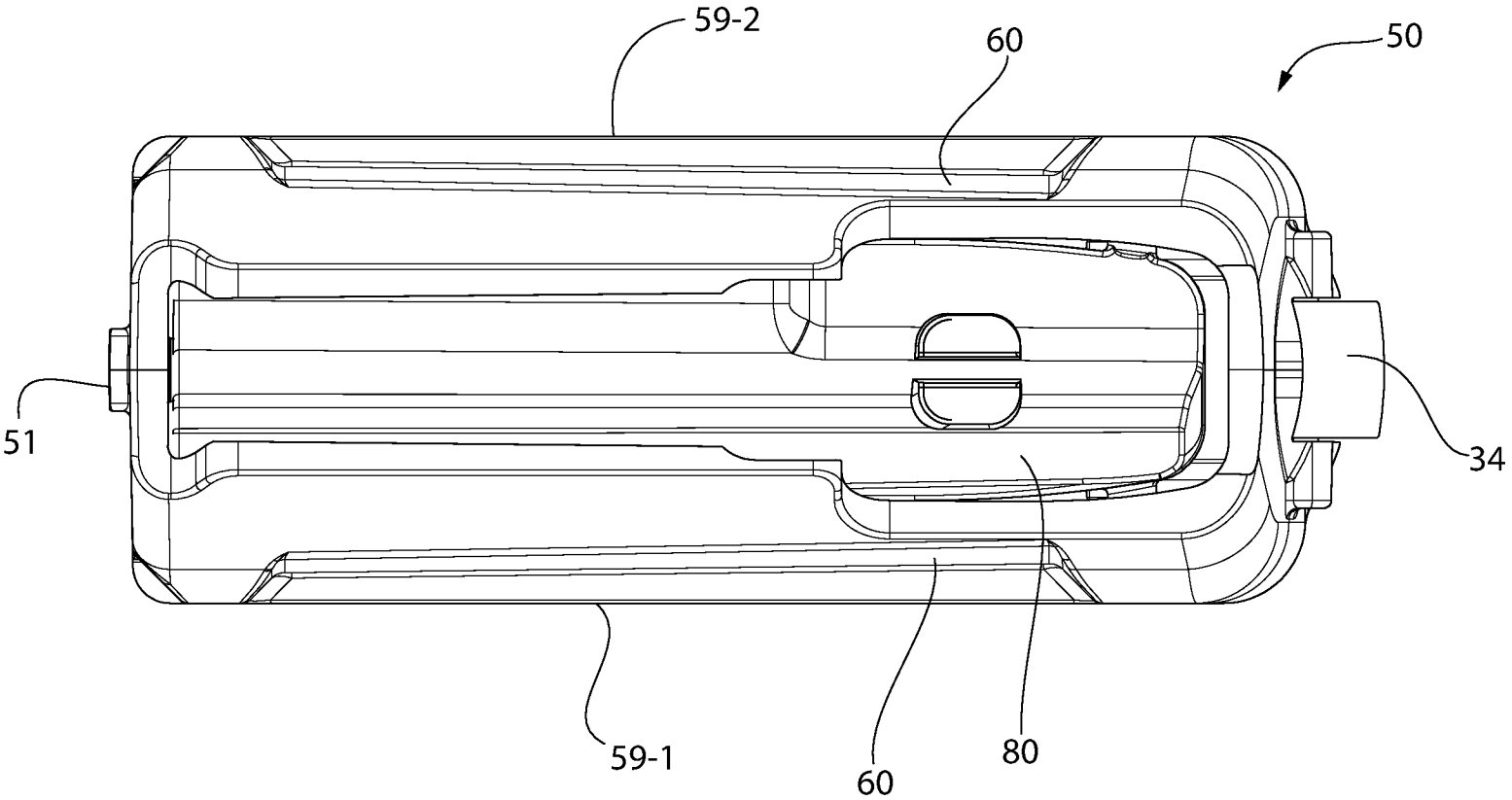
FIG. 38 is a top view thereof.
Figure 39:
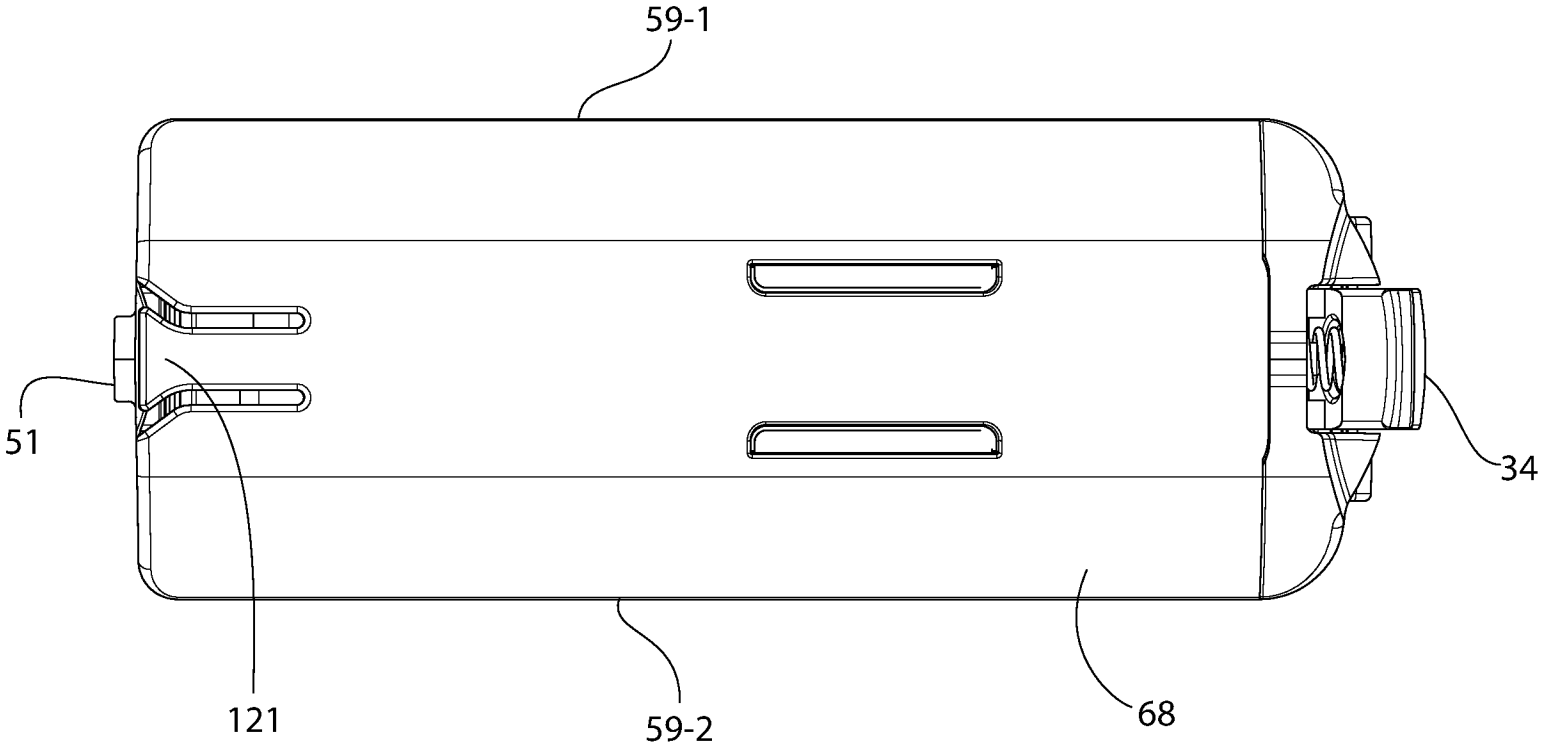
FIG. 39 is a bottom view thereof.
Figure 40:
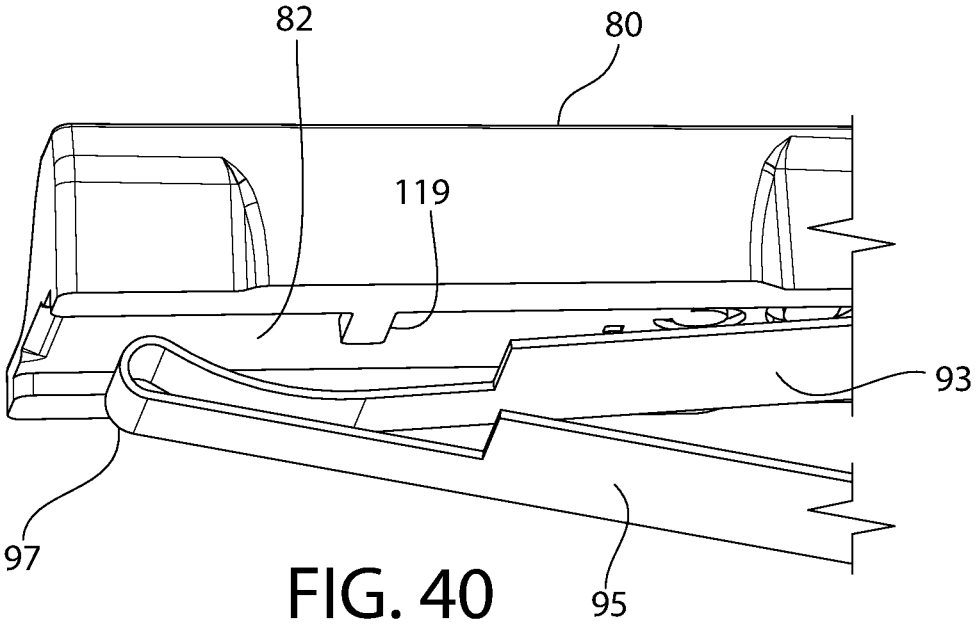
FIG. 40 is a side rear perspective view showing interaction between the follower and rear portion of the spring.
Figure 41:
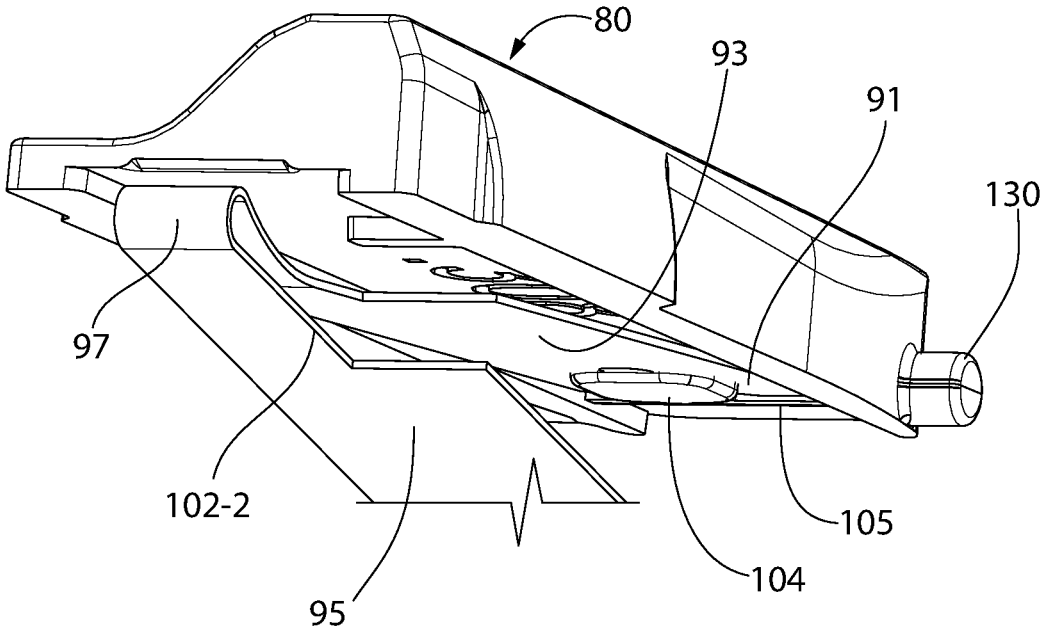
FIG. 41 is a bottom rear perspective view thereof.

It bears noting that the two rear bends 97, 99 and remaining portions of spring 90 rearward of the fixedly secured front terminal ends 91, 92 are not secured to either the follower 80 or floor plate 68. This increases the flexibility of the spring thereby providing a greater angular degree of tilt possible with the tiltable follower 80. Accordingly, the present main spring 90 has only two points of fixation to the magazine assembly. Both the top terminal end 91 and bottom terminal end 92 are substantially vertically aligned and secured to the magazine assembly nearest the front wall of the magazine 50 as seen in FIG. 30. The rear bends 97, 99 similarly are substantially vertically aligned to allow assumption of their nested positioning when the spring is fully compressed.

Both the top and bottom legs 93, 93 of main spring 90 may be fixedly (but releasably in some embodiments) attached to the follower 90 and floor plate 68 outside of the magazine 50. This allows the completed spring, follower, and floor plate assembly to be assembled and inserted upwardly into cavity 54 of magazine 50 as a unit.

Other suitable types of spring may be used in other embodiments to bias the follower upwards in the magazine towards the top end, including without limitation coil or compressions type springs formed from oblong or circular spring coils or flat spring coils. Some embodiments may also include more than one spring. Accordingly, various other aspects of the invention are not limited necessarily by the type or number of springs used. These alternate type of springs generally cannot fold as flat as present main spring 90 due to its unique design, however, and may therefore reduce the cartridge holding capacity of the magazine.

It bears noting that by eliminating a separate retainer plate as used in some magazine designs to attach the spring to the floor plate, the height of the magazine advantageously may be reduced thereby forming a more compact design which contributes to flush mounting of the magazine with the underside of the stock adjacent to the magazine well. This also reduces the number and cost of components of the magazine. In other possible embodiments, a spring retainer plate may be used if needed.

Floor plate 68 has a horizontally elongated flattened U-shaped body in transverse cross section. Floor plate 68 includes a front end 113, rear end 114, opposing vertical lateral sidewalls 115 extending between the ends, and a bottom wall 116 defining a top surface 112 and opposing bottom surface 111. Sidewalls 115 extend upwardly from bottom wall 116 at its peripheral edges and define an upwardly open receptacle 68-1 configured for receiving the bottom edge of the magazine housing 53 (see, e.g. FIG. 11). The bottom wall 116 which may be slightly arcuately curved in transverse cross section from side to side to create a smooth profile and flush fit-up with the underside of the stock 21. The floor plate 68 is configured for attachment to the bottom end 24 of the magazine housing 21 and closes the otherwise open bottom end. In one embodiment, the floor plate 50 may be detachably mounted to the magazine.

According to another aspect of the invention, the floor plate 68 is detachably secured to the bottom end 24 of magazine 50 via a unique slideable and interlocking coupling mechanism. Referring generally to FIGS. 5-17, 31-32, 45, and 51, the bottom end 56 of magazine housing 53 and mating top end of floor plate 68 may be castellated in configuration to form the interlocked and meshed coupling between the floor plate and housing. In one non-limiting embodiment, each lateral sidewall 115 of floor plate 68 includes a plurality of laterally and inwardly extending mounting flanges or teeth 109 which interlock with mating plurality of laterally and outwardly extending flanges or teeth 117 formed on the bottom end of each lateral side 59 of the magazine housing 53 (see, e.g. FIG. 11). Floor plate 68 and housing 53 thus each include two laterally spaced and longitudinally-extending linear arrays or rows of mating mounting teeth. Laterally open insertion cutouts or gaps 110 and 118 are formed between each set of adjacent teeth 109 and 117, respectively. Gaps 110 are vertically and inwardly open. Gaps 118 are vertically and outwardly open. The gaps allow vertical insertion of the floor plate teeth 109 between and through the housing teeth 117, and vice-versa for interlocking the teeth as further described herein. Teeth 109 and 117 may be rectilinear shaped in one embodiment such as generally rectangular cuboids.

Each of the two linear arrays or rows of mounting teeth 109, 117 on the floor plate 68 and magazine housing 53 respectively each include at least two mounting teeth, and preferably at least three mounting teeth. In one non-limiting embodiment, as depicted, each row may include seven mounting teeth 109, 117. The number of teeth on the floor plate and magazine housing may be the same in some embodiments.

The floor plate 68 is longitudinally slideable forward and rearward on the magazine housing 53 between a locked position in which the mounting teeth 109 of the floor plate are engaged with the mounting teeth 117 of the housing, and an unlocked position in which the mounting teeth of the floor plate are disengaged from the mounting teeth of the housing. In the locked position, teeth 109 of the floor plate are located between gaps 118 and positioned directly above the teeth 117 of the housing vertically floor plate creating an interference which prevents removal of the floor plate from the housing. In the unlocked position, the teeth 109 of the floor plate are located directly above gaps 118 and between the teeth 117 of the housing which allows the floor plate to be withdrawn downwards between the housing teeth and removed form the housing.

The coupling mechanism further includes a cantilevered and resiliently flexible "snap-fit" tab 121 at the rear end 114 of the floor plate 68. The snap fit tab 121 may be integral to the rear of the floor plate and formed as a unitary structural part thereof in one embodiment. In other embodiments, the tab 121 may be separate component affixed to the floor plate. Tab 121 has a front end anchored to bottom wall 116 of the floor plate 68 and an opposite rear operating end accessible to the user even when the floor plate is fully mounted to the magazine 50. A rearwardly open recess 122 formed in the rear wall 58 of the magazine housing 53 provides access. In one embodiment, snap fit tab 121 may be centered between the sidewalls 115 of the floor plate 68 (best shown in FIG. 8). Tab 121 may be formed as an integral unitary structural part of the floor plate 68 as shown.

In other possible implementations, it bears noting that the magazine mounting teeth 117 may protrude laterally inwards towards magazine cavity 54 (instead of outwards as previously described herein) and the floor plate mounting teeth 109 may protrude laterally outwards (instead of inwards). The invention is thus not limited to any particular one of these arrangements.

Figure 49:
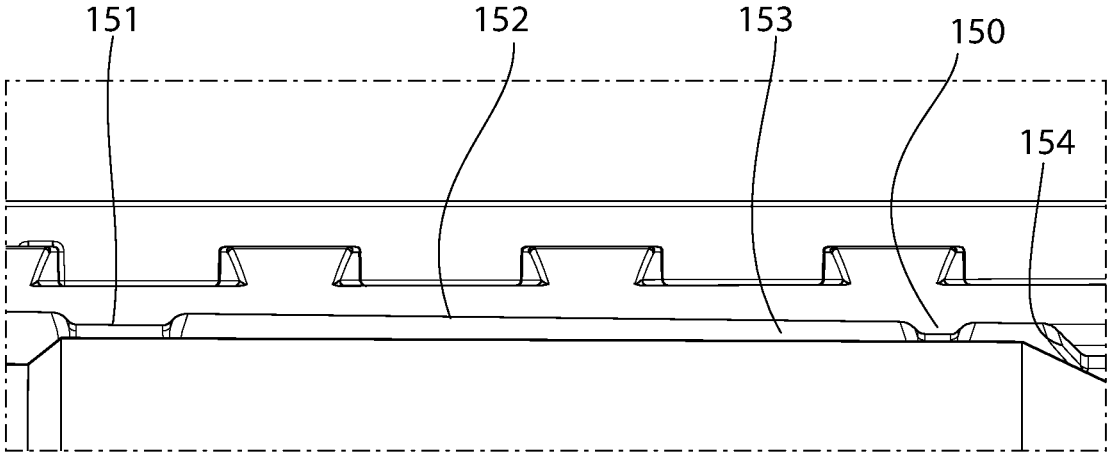
FIG. 49 is a first enlarged detail taken from FIG. 47.

A method for assembling magazine 50 will now be described. In one embodiment, the main spring 90 preferably may be first attached to the follower 80 and floor plate 68. The first step of assembly is for the user to slide the bottom leg 94 of main spring 90 under the retention tabs 106 in the floor plate until it reaches the hard stop abutment surface 107 at the front (see, e.g. FIGS. 6 and 7). The spring 90 is prevented from moving rearward relative to the floor plate by the abutment surface 120 at the rear. The next assembly step is to attach the main spring 90 to the follower 80 by sliding the top leg 93 of the main spring under the retention protrusion 104 on the follower until it hits the hard stop abutment surface 105 at the front (see, e.g. FIGS. 9 and 49). The spring 90 is prevented from moving rearward relative to the follower by the abutment surface 119 at the rear. It bears noting that in some sequences, the spring may be attached to the follower first before the floor plate. Since the floor plate 68 is a larger and wider structure than the follower 80, it facilitates assembly by attaching the spring to the floor plate first.

Now that the floor plate, follower, and main spring are assembled, they can be mated to the main body or housing 53 of magazine 50 as a sub-assembly or unit. This is done by sliding the sub-assembly upwards through open bottom end 56 into cavity 54 of the magazine housing 53, preferably making sure to align and insert the pair of laterally protruding guide bosses 130 on the front of the follower 80 into their respective pair of mating vertical open guide tracks or slots 132 formed on the interior of housing sidewalls 59 in magazine cavity 54 (see, e.g. FIG. 10). Slots 132 each have downwardly open bottom ends 131 for this purpose and are further described elsewhere herein. The main spring 90 will push the follower 80 up into the body until it reaches a hard stop formed by the closed top ends 133 of the slots 132 abuttingly engaging guide bosses 130 (see, e.g. FIG. 3).

Figure 11:
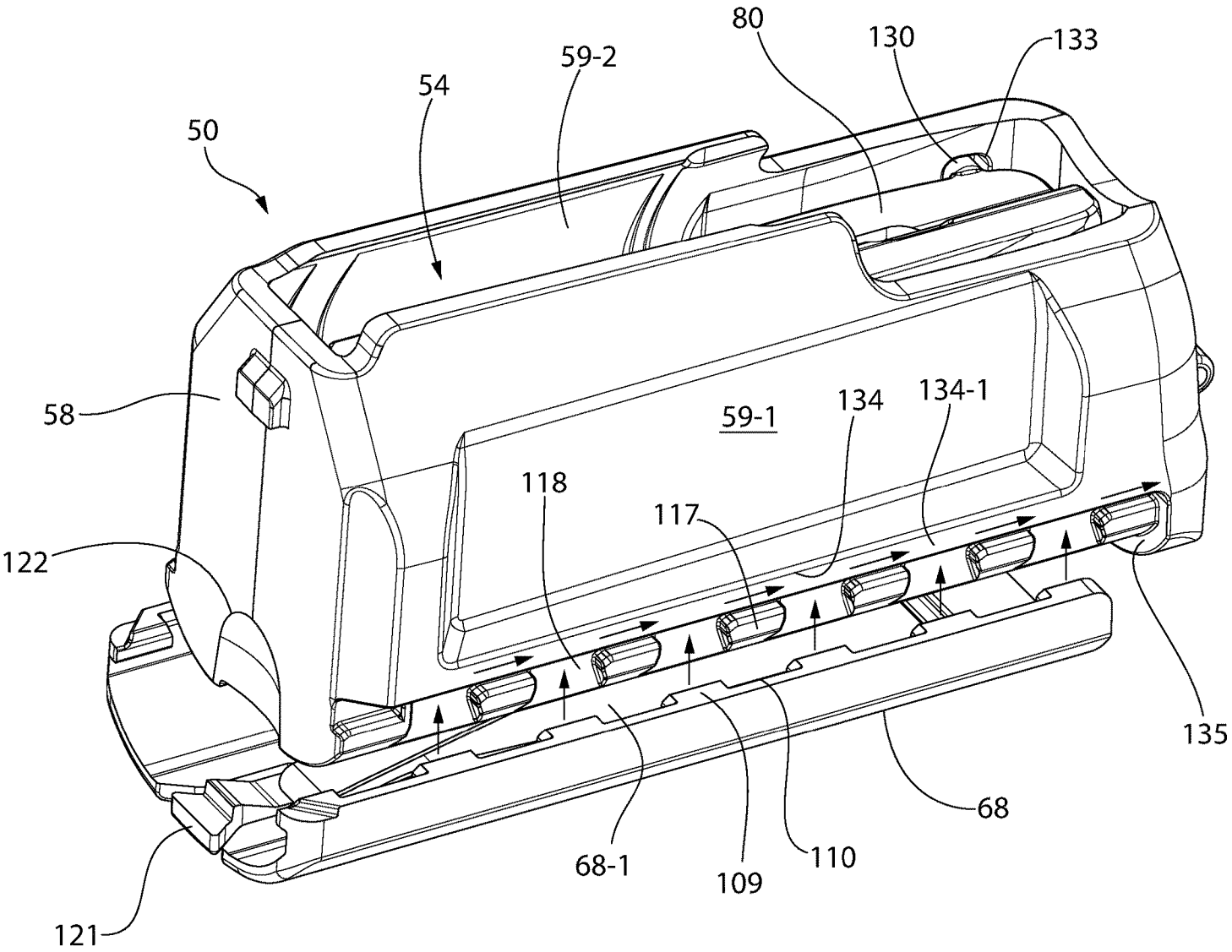
FIG. 11 is a first sequential perspective view of a system for coupling the floor plate to the magazine housing.

FIGS. 11-15 are sequential views shows the remaining steps for assembling the floor plate 68 to magazine housing 53 using the foregoing slideable and interlocking coupling mechanism. Referring to FIG. 11, the next step in the process is to vertically align the teeth 109 on the floor plate 68 with the vertically open gaps 118 between the teeth 117 on the spring housing 53. The floor plate is positioned beneath the housing 53 such that the rear of the plate ajar and protrudes rearward slightly beyond the rear wall 58 of the housing as shown. This aligns the forward-most pair of teeth 109 on the floor plate 68 with the forward-most pair of gaps 118 on the magazine housing.

Figure 3:
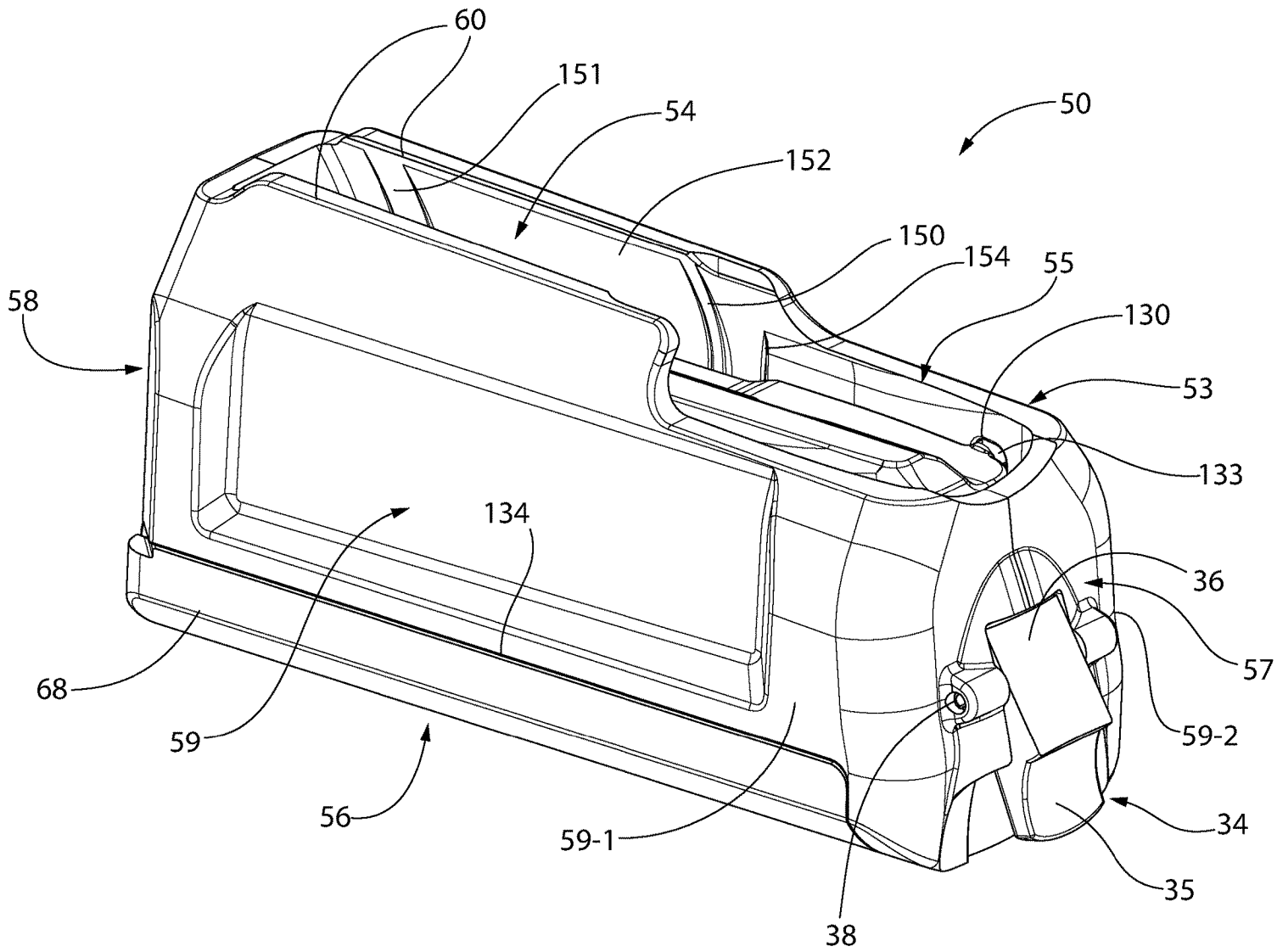
FIG. 3 is a front perspective view of the magazine.
Figure 4:
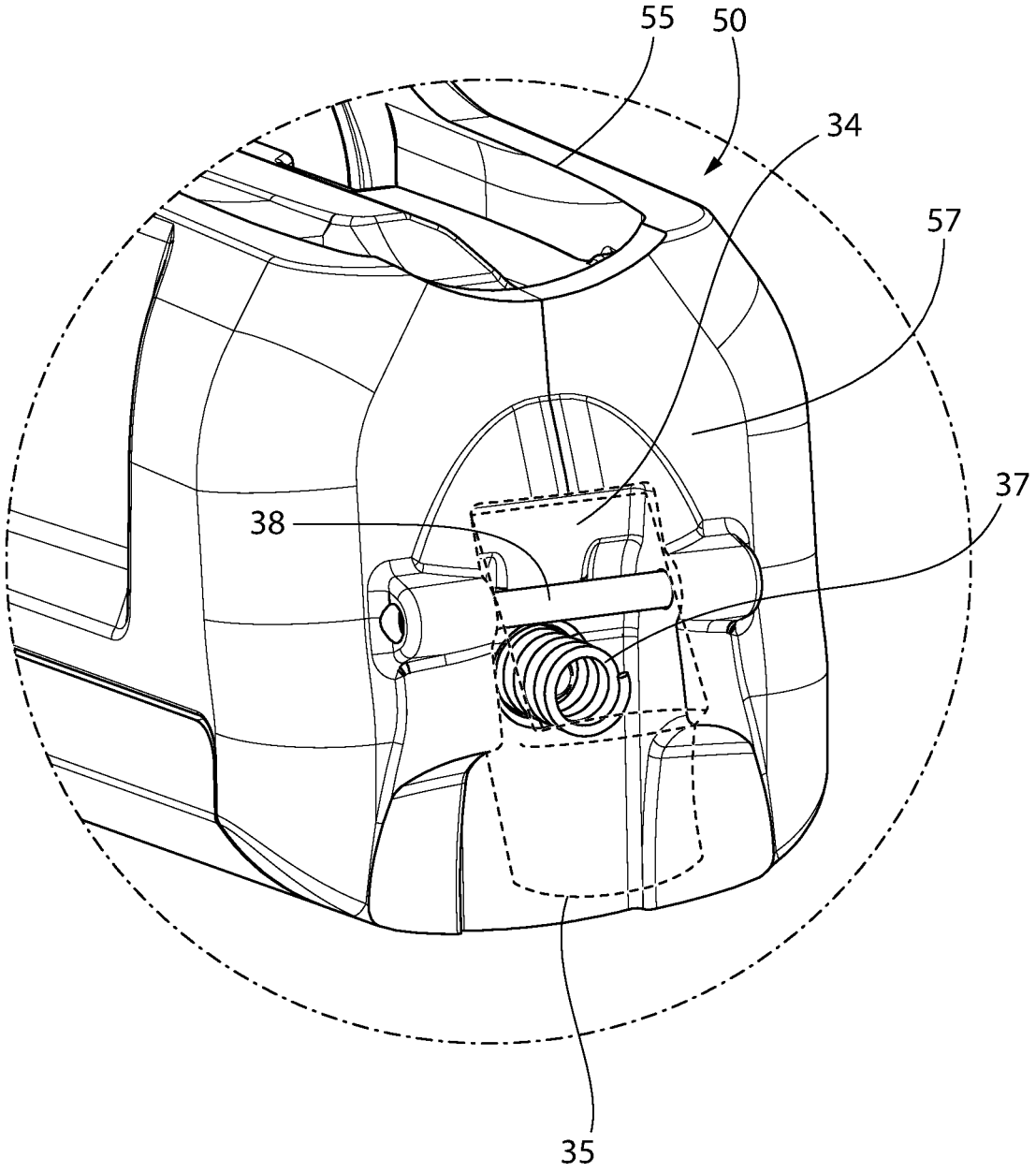
FIG. 4 is a front close-up view of the magazine showing the latching mechanism.

The floor plate is then pushed upwards to pass the floor plate teeth 109 through the housing gaps 118 to a position above the housing teeth 117 (see vertical directional arrows in FIG. 11) until the floor plate teeth abuttingly engage a downward facing and longitudinally-extending horizontal stop surface 134 formed on each sidewall 59 of magazine housing 53. The stop surface 134 is spaced from and located at a position above the housing teeth 117. This defines a longitudinally-extending mounting channel 134-1 between the teeth 117 and stop surface 134 for sliding the floor plate teeth 109 forward/rearward during the mounting sequence. Stop surface 134 extends for a majority of the entire length of the magazine and ensures the proper full vertical insertion depth of the magazine into the upwardly open receptacle 68-1 of the floor plate 68. This conveniently allows the user to simply push the floor plate 68 onto the bottom end of the housing 53 to the maximum extent possible until contact is made with the stop surface 134, thereby making any vertical adjustments to the positioning unnecessary. When the floor plate 68 is fully coupled to the magazine housing 53 as shown in FIG. 3, the stop surface 134 will engage the top longitudinal edges of the floor plate sidewalls 115 to form a flush fit-up.

Figure 50:
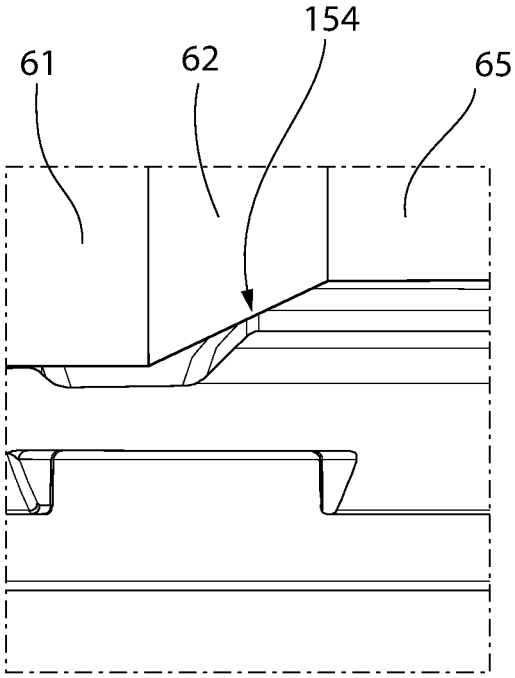
FIG. 50 is a second enlarged detail taken from FIG. 48.

Once the floor plate 68 is fully inserted on the magazine housing 53, the user then slides the floor plate forward towards the front of the magazine (see horizontal directional arrows in FIG. 11) until it reaches a rear facing hard stop surface 135 formed on the front end of the magazine housing 53. Stop surface 135 abuttingly engages the front end 113 of the floor plate 68. In this fully forward position of the floor plate 68, each of the floor plate teeth 109 becomes positioned immediately above a corresponding one of the magazine teeth 117, thereby trapping teeth 109 above teeth 117 in an interlocked relationship (see also FIG. 50). This physical interference prevents downwards removal of floor plate 68 from the magazine housing 53 without first sliding the floor plate rearward.

Figure 12:
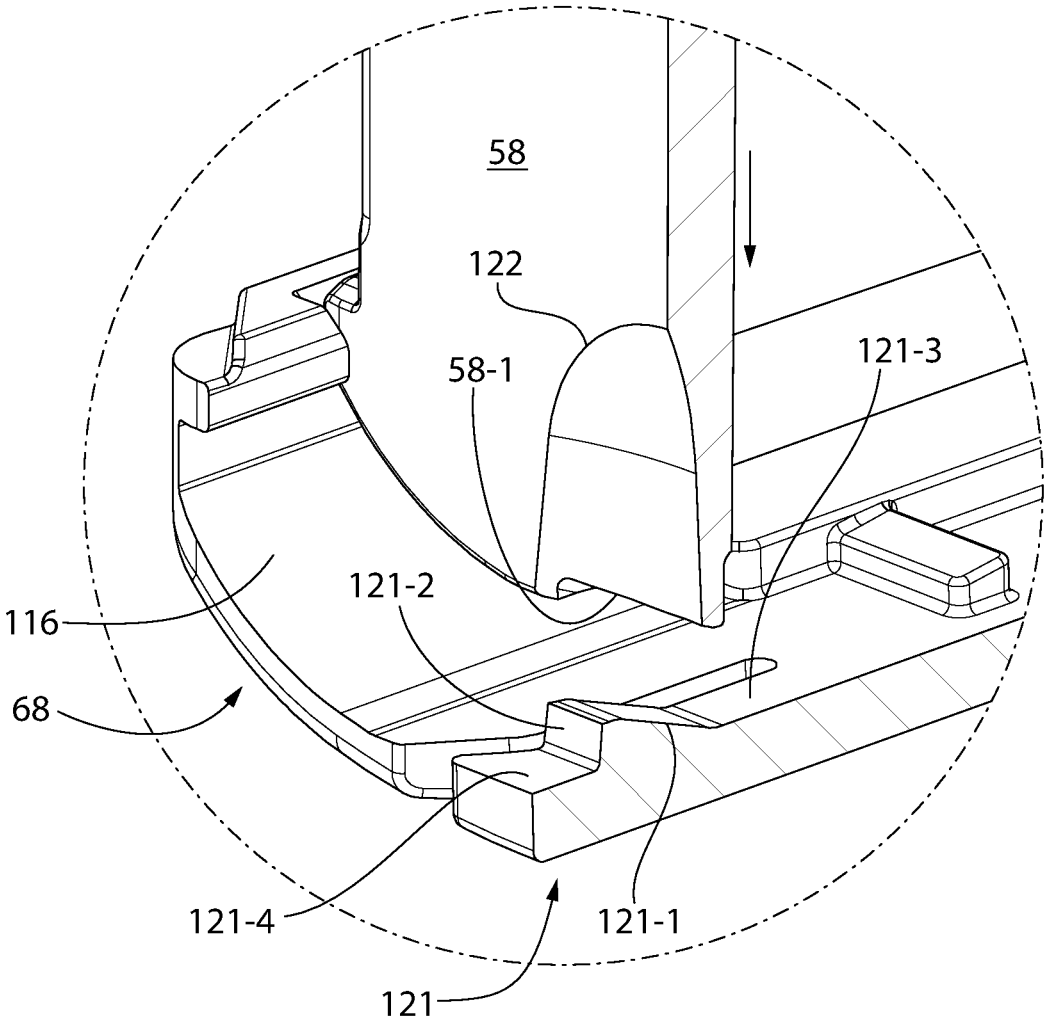
FIG. 12 is a second sequential perspective view thereof showing a resiliently flexible snap fit tab of the floor plate interaction with the rear wall of the magazine in detail.
Figure 13:
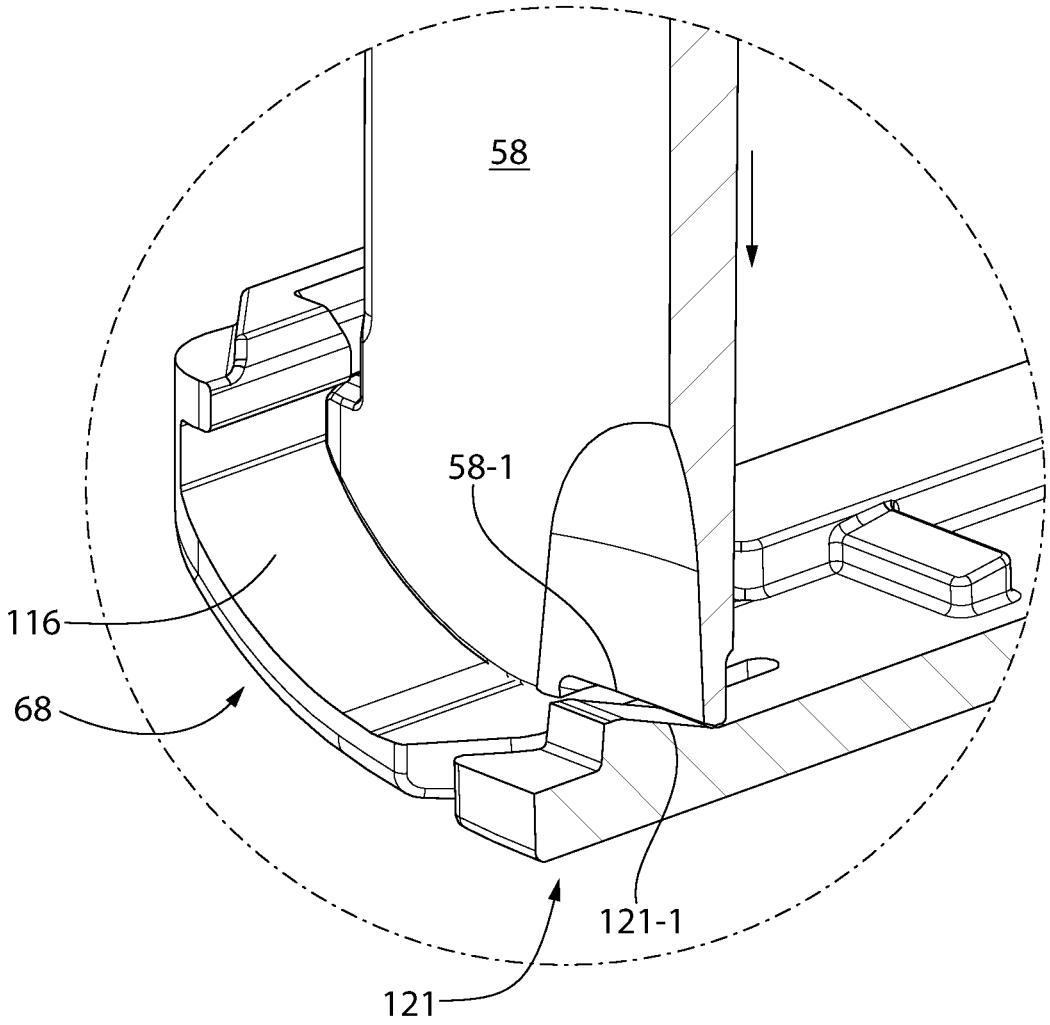
FIG. 13 is a third sequential perspective view thereof.
Figure 14:
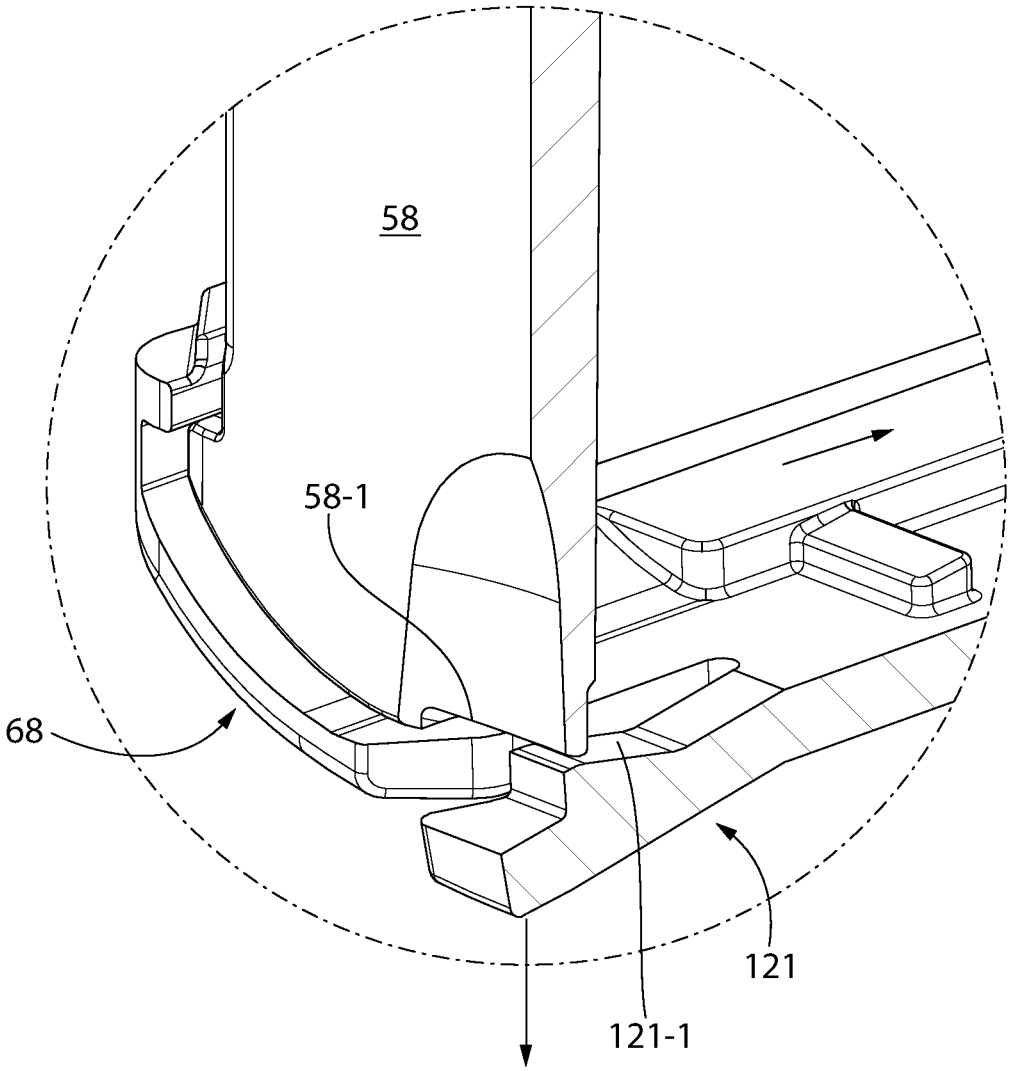
FIG. 14 is a fourth sequential perspective view thereof.
Figure 15:
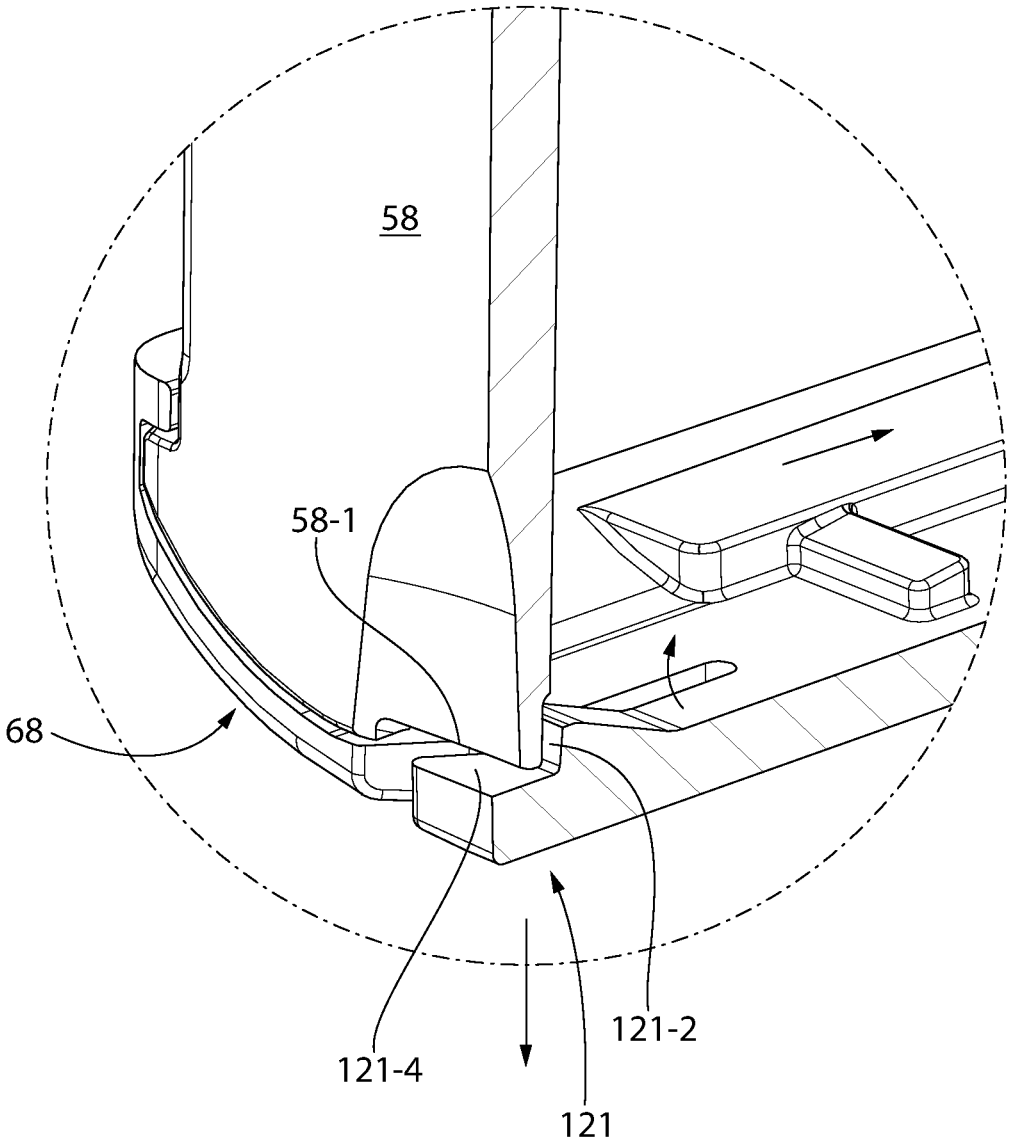
FIG. 15 is a fifth sequential perspective view thereof showing the floor plate detachably locked to the magazine housing.

Concurrently with the floor plate 68 engaging stop surface 135, an audible "click" sound is heard by the user which signals that the floor plate 68 is secured and locked to the magazine housing 53. The "click" heard during assembly is created by the elastically and resiliently deformable "snap fit" tab 121 previously described herein lockingly engaging the magazine housing. FIGS. 12-15 are sequential views showing the sub-process of engaging the snap fit tab 121 with the magazine housing. FIG. 12 shows the floor plate 68 the magazine housing 53 being moved vertically towards engagement with the floor plate (or vice-versa) during the vertical insertion step already described above (see directional arrows). The rear wall 58 of magazine housing 53 next makes contact with the top surface 121-3 of the snap fit tab 121 immediately forward of a forward sloping inclined ramp 121-1 as shown in FIG. 13. This engagement occurs concurrently with the magazine housing 53 being fully inserted inside the sidewalls 115 of the floor plate 68 at the conclusion of the vertical insertion step. The floor plate 68 is next slid forward on the housing 53 during the horizontal sliding step already described above (see directional arrows). During that process, the bottom edge 58-1 of the magazine rear wall 58 begins to slide upwards on snap fit tab ramp 121-1, which pushes and resiliently deflects or bends the snap fit tab 121 downwards at an angle as shown in FIG. 14. During assembly of the magazine, the snap fit tab is therefore automatically actuated without intervention by the user. As the floor plate continues to be pushed forward, the rear wall bottom edge 58-1 breaks contact with the ramp 121-1, thereby causing the snap fit tab 121 to spring back upwards to its original undeflected horizontal position (see, e.g. FIG. 15). This causes the audible "click" heard by the user. The bottom edge 58-1 of magazine housing rear wall 58 now assumes a position behind a rear facing abutment surface 121-2 formed at the back edge of the ramp 121-1. The bottom edge 58-1 engages an upward facing horizontal rear surface 121 on the snap fit tab immediately adjoining the rear end of the ramp. The floor plate 68 is now releasably locked to the magazine housing 53 via the snap fit tab 121. The floor plate 68 cannot be axially slid in a rearward direction relative to the magazine housing to uncouple the floor plate due to interference between the bottom edge 58-1 of the rear housing wall and abutment surface 121-2 of the snap fit tab.

Figure 16:
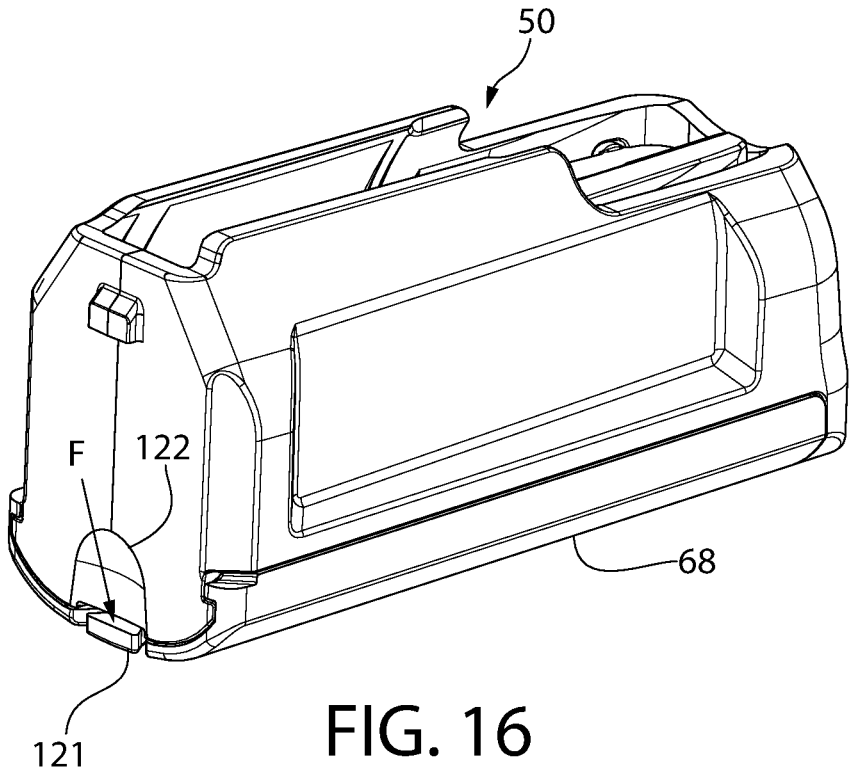
FIG. 16 is first sequential perspective view of the magazine showing a first step of unlocking the floor plate from the magazine housing.
Figure 17:
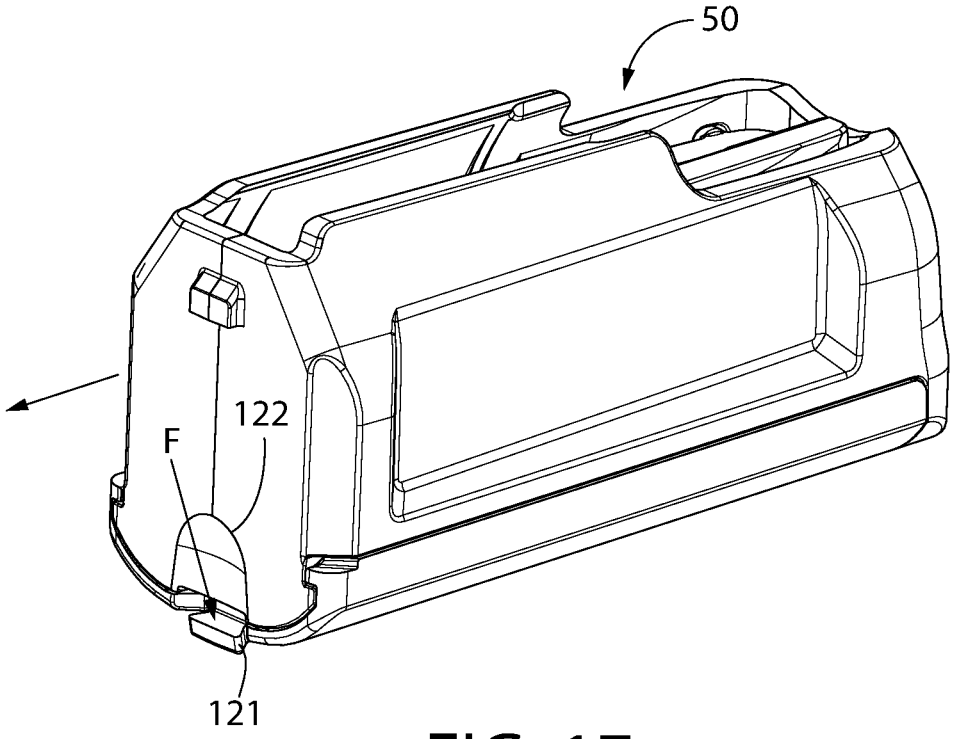
FIG. 17 is a second sequential thereof showing the snap fit tab actuated by a user to unlock the floor plate and magazine housing.
Figure 18:
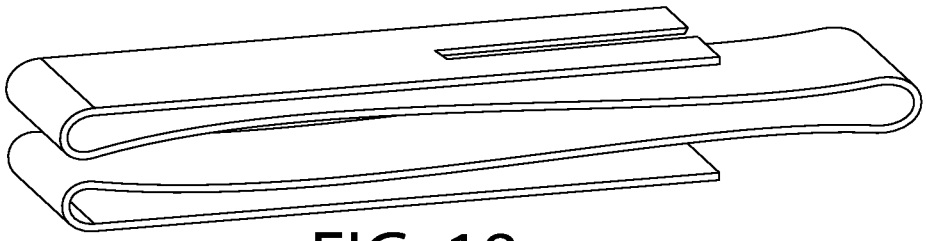
FIG. 18 (PRIOR ART)
FIG. 18 is a perspective view of a known accordion type magazine flat spring in a fully compressed and folded condition.
Figure 19:
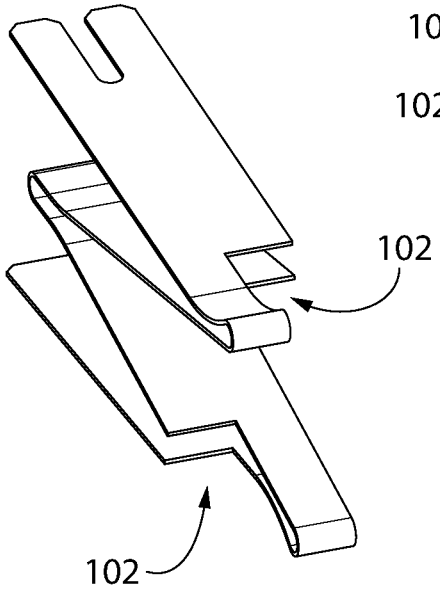
FIG. 19 is a rear perspective view of an improved accordion type flat spring according to the present disclosure.
Figure 20:
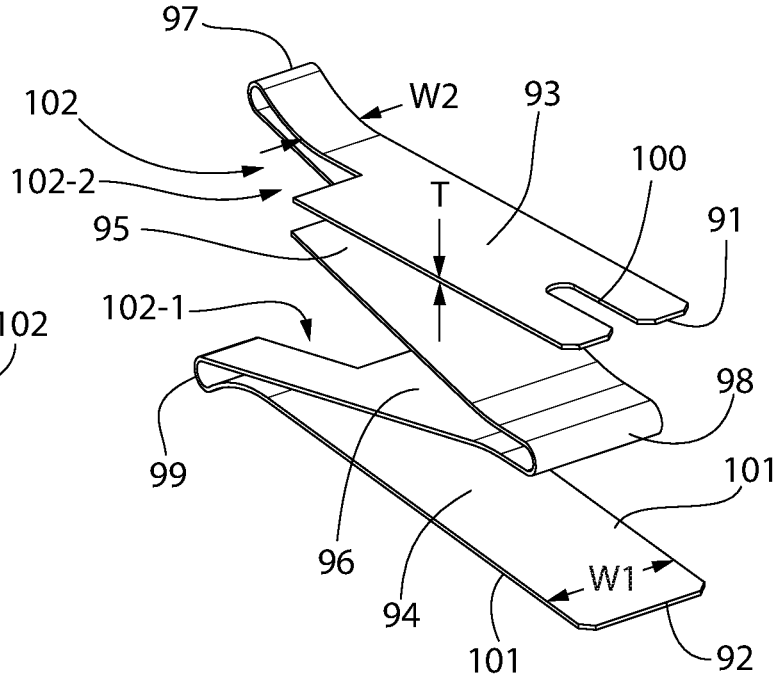
FIG. 20 is a perspective view thereof showing the spring in a fully compressed and folded condition.

To disassemble the magazine and floor plate, an external rear end portion of the snap fit tab 121 remains accessible via recess 122 formed in the rear wall 58 of the magazine housing 53 as shown in FIG. 16. The tab 121 is can then be manually actuated by applying a downward force F on the tab with a finger or object until the snap fit tab is clear of the bottom edge 58-1 of the magazine housing rear wall 58 as shown in FIG. 17. This breaks engagement between the bottom edge and blocking surface 121-2 of snap fit tab 121 so that the floor plate 68 can be freely slid rearwards to uncoupled the floor plate from the magazine housing 53. This provides a unique and easy method of disassembling the magazine.

According to another aspect of the invention, the present follower 80 and magazine body or housing 53 are cooperatively configured to allow the follower to tilt during the action of dispensing cartridges or loading new cartridges into the magazine 50. Allowing the follower to tilt advantageously permits the magazine to adapt to and accommodate a variety of cartridges with different body tapers. However, allowing a follower to tilt in general may sometimes inadvertently allow the follower 80 to jump out of the front of the magazine at the open top forward of the feed lips 60 if pressed downwards in the rear due to the biasing action of the main spring 90. The follower 80 in the present magazine is able to tilt, but also is provided with a follower retention feature which prevents it from jumping out of the magazine.

Referring to FIGS. 25-32 and 48, the follower retention feature includes a pair of laterally protruding guide projections or bosses 130 disposed on the front of the follower 80. One guide boss 130 protrudes outwards from each one of a pair of lateral sides 85 of the follower; each guide boss slideably engaging a corresponding vertical guide slot 132 formed in the sidewalls 59 of the housing within the magazine cavity 54. The guide bosses 130 are disposed proximate to a front end 83 of the follower and the guide slots 132 are disposed proximate to the front wall 57 of the magazine. The guide bosses 130 are cylinder and round in cross section thereby advantageously increasing the angle to which the follower 80 can be tilted without being impeded by the guide slot 132.

The guide slots 132 are inwardly open towards magazine cavity 54 and preferably extend partially but not completely through the sidewalls 59 of the magazine in one embodiment. Guide slots 132 include an open bottom end 131 for inserting the bosses 130 into the slots when assembling the follower 80 to the magazine housing 53 (see, e.g. FIGS. 10 and 26-27), and a closed top end 133 for retaining the bosses in the slot against the upward biasing force imparted to the follower by main spring 90 (see, e.g. FIGS. 3 and 26-27). The follower 80 is angularly tiltable relative to the housing 53 of the magazine 50 about a lateral pivot axis defined by the guide bosses 130. Because the guide bosses 130 travel upwards/downwards in the guide slots 132, the pivot axis may be considered to be vertically movable and adjustable depending on the position of the bosses in the slots.

Figure 28:
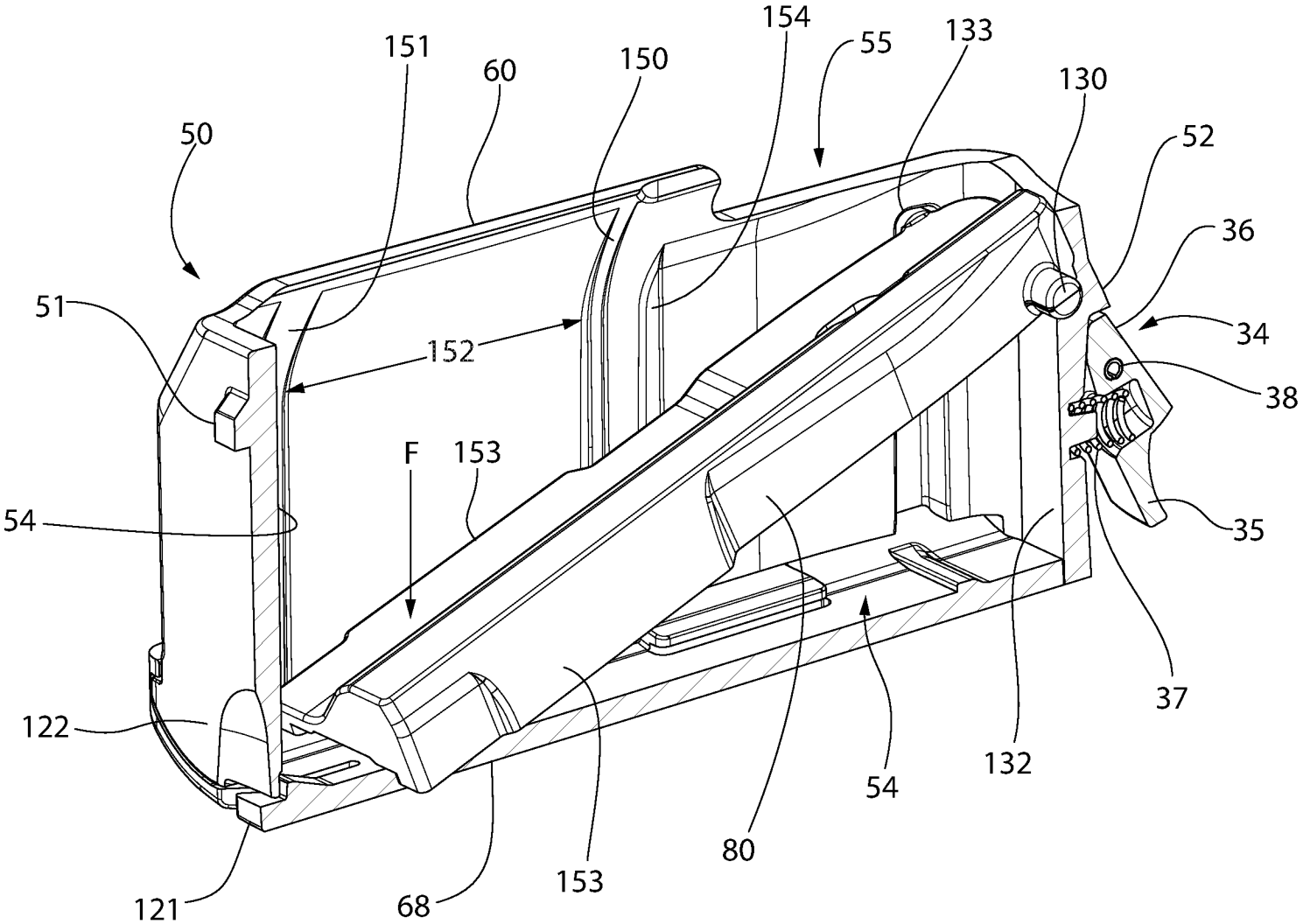
FIG. 28 is a first cross-sectional perspective view showing the magazine with follower in a titled position.
Figure 29:
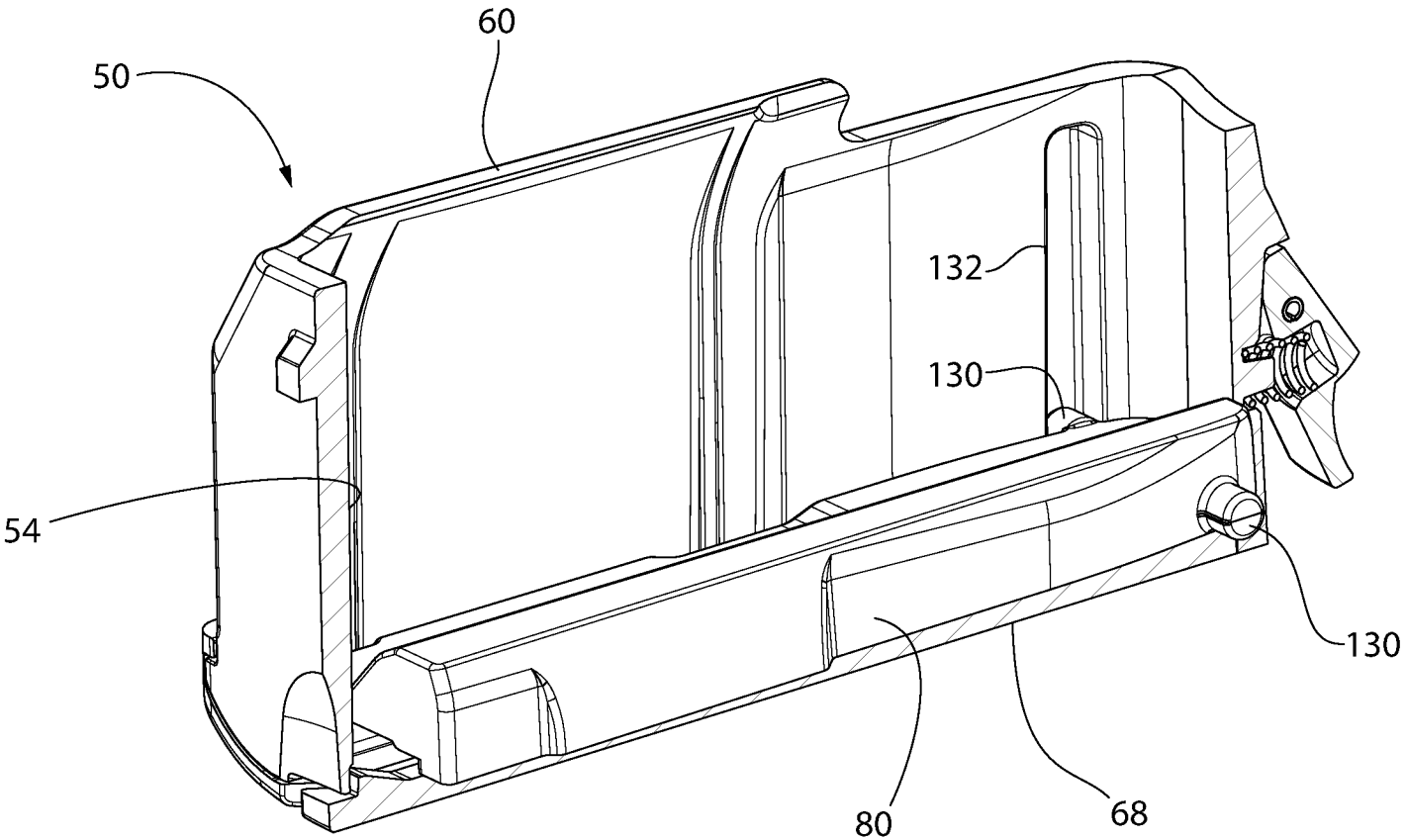
FIG. 29 is a second cross-sectional perspective view showing the magazine with follower in a lowermost horizontal position.

It bears noting that the guide slots 132 serve not only to retain the follower 80 in the magazine cavity 54, but also act for smoothly guiding upwards and downwards movement of the follower therein. Interaction between the guide bosses 130 and slots 132 also control the front of the follower 80 when the rear of the follower is tilted all the way down (see, e.g. FIG. 28). In the maximum angle of tilt of the follower 80, the rear end 84 of the follower may contact the floor plate 68 and the forward end 83 is adjacent the top opening 55 of magazine 50 with the guide bosses 130 contacting the closed top ends 133 of the guide slots 132 as shown. This occurs when a downward force F is applied to the rear portion of the follower 80 such as when loading the first cartridge C into an empty magazine as seen in FIG. 28. When the magazine 50 is fully loaded with cartridges, follower 80 assumes a horizontal position at the bottom of magazine cavity 54 contacting the floor plate 68 (see, e.g. FIGS. 29 and 43-45). Because the front pivot axis of the follower 80 defined by the lateral bosses 130 is vertically movable relative to the magazine and not fixed in position, the follower may move while maintaining the horizontal position upwards and downwards in the magazine cavity 54, or alternatively an angle position during the action of dispensing cartridges to the breech or loading cartridges into the magazine.

Figure 42:
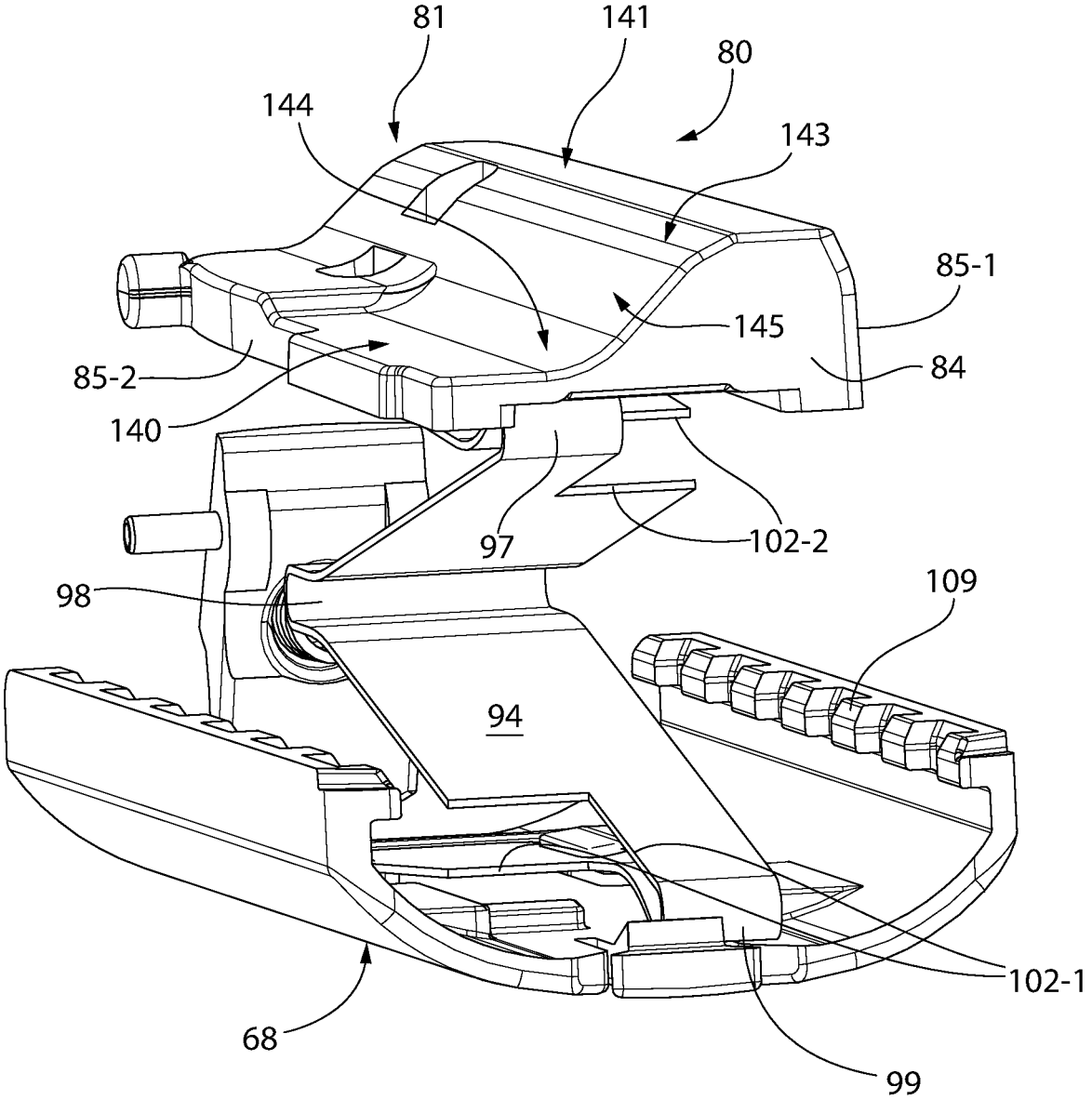
FIG. 42 is a front perspective view of the follower, spring, and floor plate.

Other aspects of the follower 80 including its interaction with the cartridge stack will now be further described with general reference to FIGS. 25-29, 42-48, and 51-53. Follower 80 has a body that is axially elongated in the direction of the longitudinal axis LA and horizontal centerline axis Ch of the magazine 50 when mounted therein. The follower 80 includes a multi-tiered top surface 81, bottom surface 82, front end 83, rear end 84, and pair of opposed lateral sides 85 extending axially along the longitudinal axis between the front and rear ends. As shown in FIG. 42, the right lateral side 85-1 may have a greater height than the left lateral side 85-2 due to the arcuately curving top profile of the top surface 81. The follower body may be made of any suitably durable material for reliable operation and dispensing of cartridges from the magazine 50. In some embodiments, the follower 80 may be formed of metal or polymer/plastic.

Figure 45:
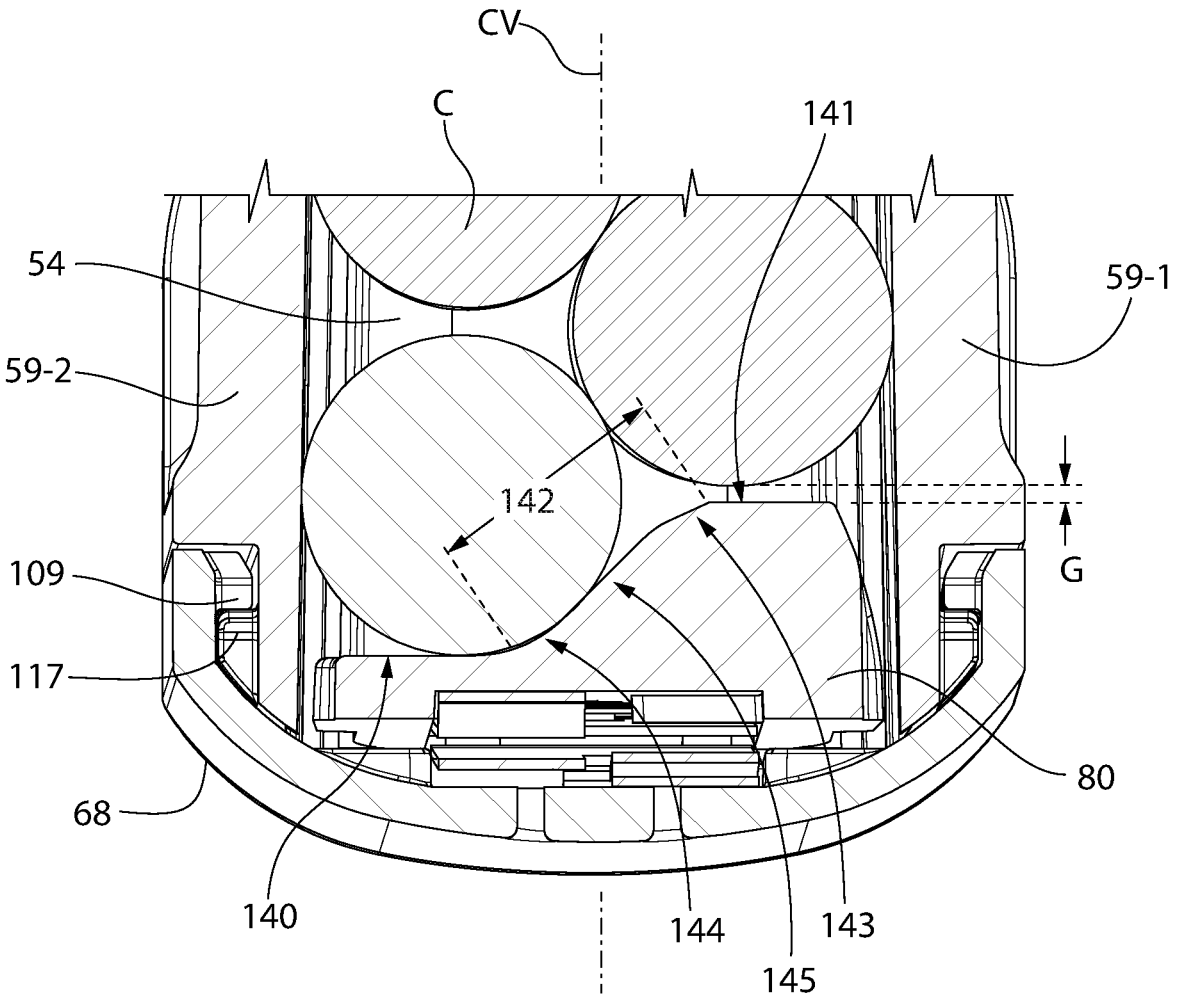
FIG. 45 is a detail view taken from FIG. 44.
Figure 51:
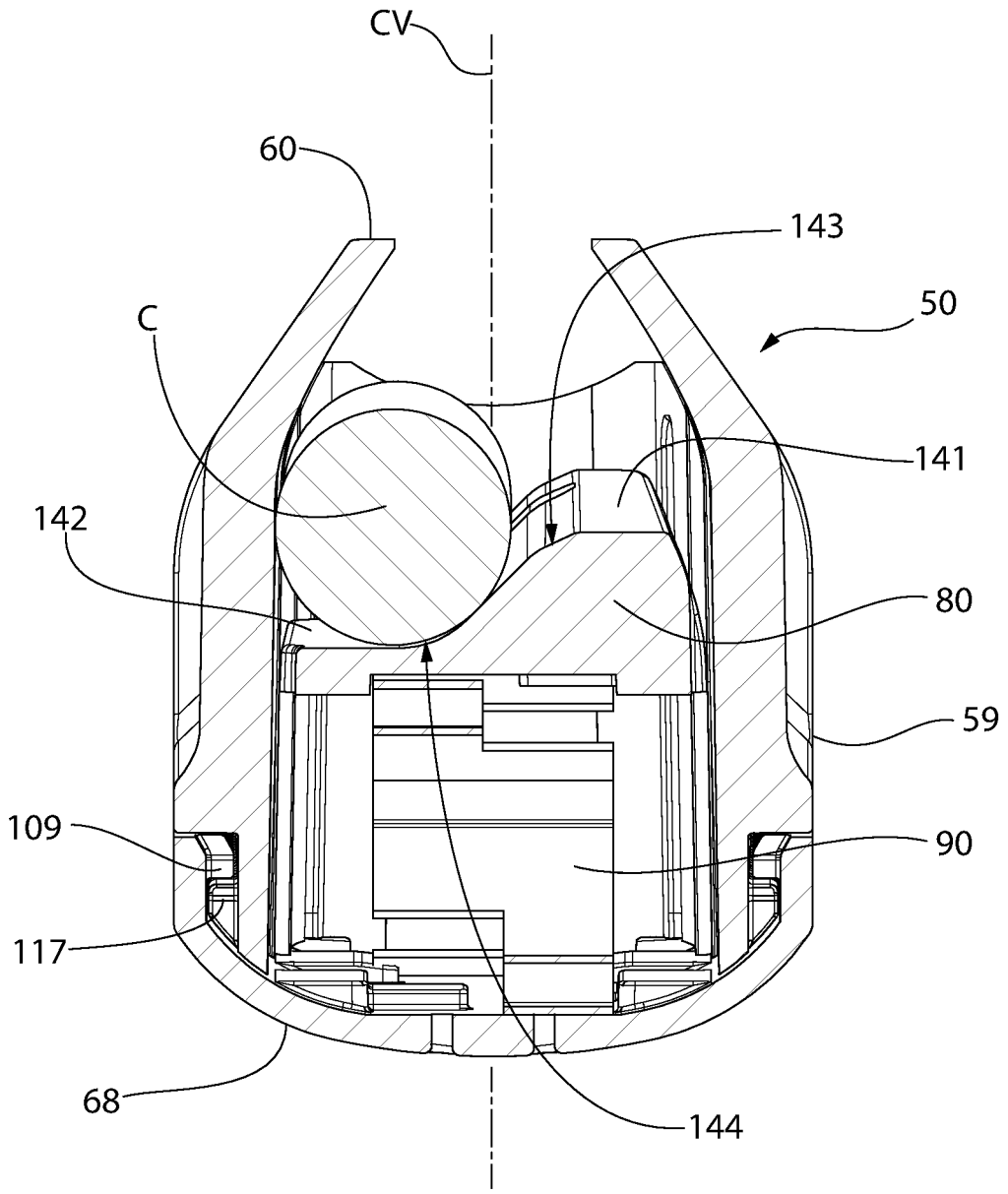
FIG. 51 is a first sequential view showing interaction between the follower and last cartridge in the magazine.
Figure 52:
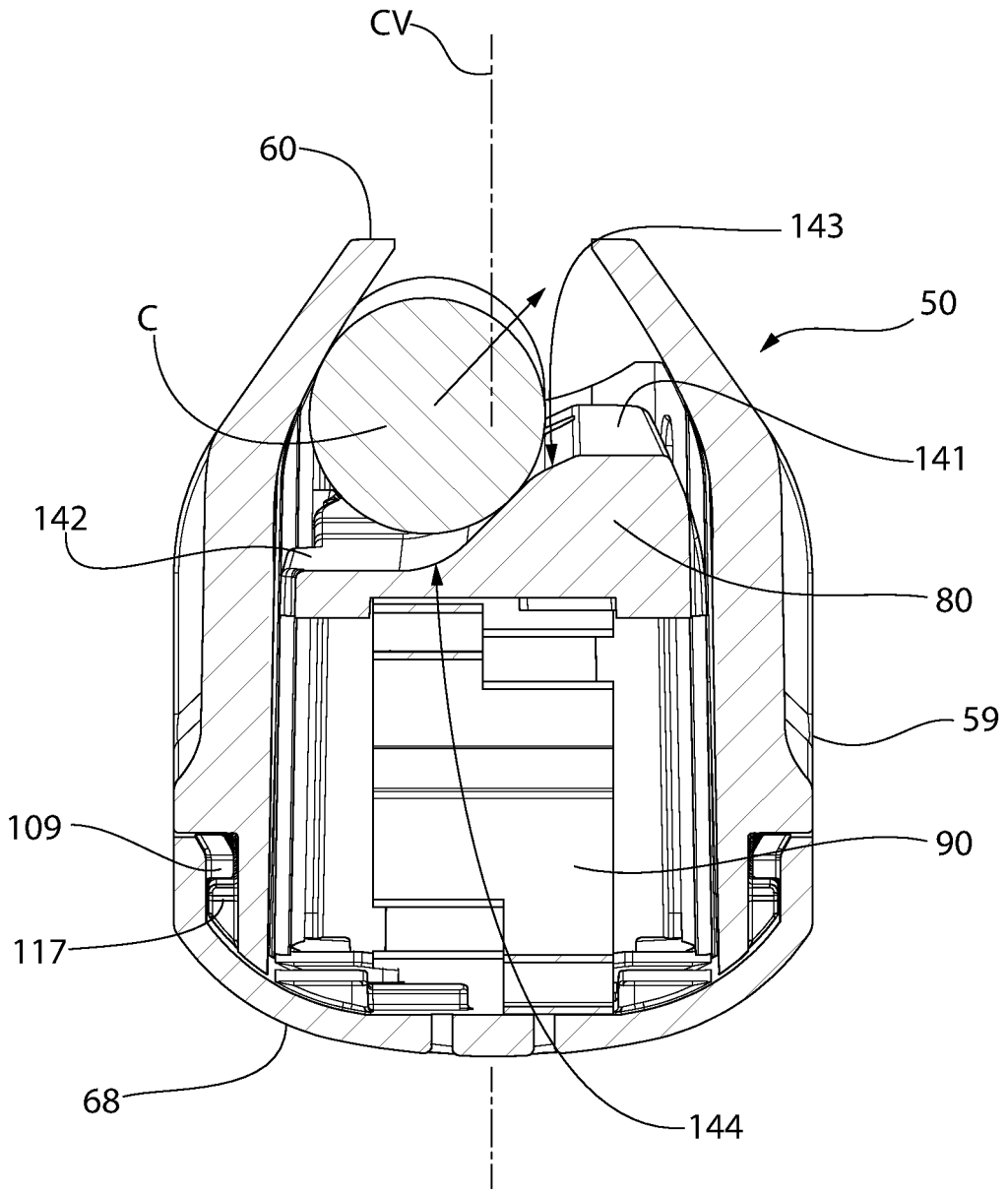
FIG. 52 is a second sequential view thereof.

The multi-tiered top surface 81 of the follower 80 is configured to support the lowermost cartridge C in the stack and may have a stepped configuration from side to side for holding the stack of cartridges in a double staggered stack relationship (see, e.g. FIGS. 43-45). This arrangement advantageously increases the capacity of the magazine. Accordingly, top surface 81 includes an upper sub-surface 141, a lower sub-surface 140, and an arcuately curved intermediate sub-surface 142 adjoining and extending between the upper and lower sub-surfaces. Intermediate sub-surface 142 may be considered to have a generally flattened S-shape including a concave arcuately curved lower transition surface 144 contiguously adjoining the lower sub-surface 140, a convex arcuately curved upper transition surface 143 contiguously adjoining the upper sub-surface 141, and an angled flat surface 145 therebetween (see also FIG. 51. The upper sub-surface 141 and lower sub-surface 140 may each substantially flat or planar. These surfaces 140, 141 are horizontally oriented and parallel to the horizontal centerline axis Ch of the magazine 50 when the follower is in a horizontal position Both the upper and lower sub-surfaces 141, 140 are each laterally offset from the vertical centerline axis Vc of the magazine 50 as shown in FIGS. 44, 45, and 51-53. Note that the feed lips 60 of the magazine are centered about axis Cv. The intermediate sub-surface 142 is intersected by axis Cv. In operation when the plurality of cartridges C are loaded into the magazine by the follower 80, the follower and housing are cooperatively configured such that the cartridges do not engage the flat upper sub-surface 141. This creates a gap G between the lowermost cartridge and follower 80 which is maintained while the cartridges are dispensed and the stack travels vertically upwards in the magazine 50 as seen in FIGS. 43 and 44. The lateral pressure applied to the stack of cartridges forces each cartridge outwards to create positive engagement with the interior surface of the magazine cavity 54 and maintains gap G. Even when a single cartridge is left in the magazine as shown in FIGS. 51-53 and dispensed, the cartridge does not engage the upper sub-surface 141 of the follower due to the offset positioning of upper sub-surface 141 to axis Cv. The single cartridge is held beneath the feed lips by the convex upper transition surface 143, which may be considered to define a feed surface laterally offset form vertical centerline axis Vc of the magazine 50.

To smoothly allow the stack of cartridges C to advance upwards in the magazine 50 under the biasing force of main spring 90, the interaction between the interior surfaces of magazine cavity 54 is controlled by a plurality of raised cartridge contact surfaces. Referring to FIGS. 28-30 and 45-50, the cavity of the housing includes a pair of laterally opposing and vertically extending raised front ribs 150 which define front cartridge contact surfaces, and a pair of laterally opposing and vertically-extending raised rear ribs 151 which define rear cartridge contact surfaces. The ribs 150, 151 are disposed on each sidewall 159 of magazine housing 53 and may be extend vertically from the feed lips 60 down to the bottom end of the magazine housing 53 for the full height of the cavity 54 in some embodiments as shown. Ribs 150, 151 are located to contact only the diametrically enlarged rear case of the cartridges rearward of the stepped shoulder. The cartridges C only contact the sidewalls 59 of magazine housing 53 on each side front and rear cartridge contact surfaces of ribs 150, 151 in a lateral direction when moving upwards or downwards in the cavity. This controls the dispensing of the cartridges and smooth feeding by reducing sliding friction forces between the cartridge cases and magazine. Each pair of front and rear ribs 150, 151 thus creates two lateral points of sliding contact with the case of the cartridges.

The interior surfaces of the magazine cavity 54 may gradually converge going from the bottom of the magazine moving to the top of the magazine towards the feed lips 60 for better centering and positioning of the uppermost cartridge C for stripping by the action (i.e. bolt) and chambering. The opening in the top end 55 of magazine 20 below the feed lips 60 may be slightly larger than the width of a single cartridge for positive dispensing action.

Referring to FIG. 44, another aspect of the present magazine worth noting is that the top portions of the raised front and rear ribs 150, 151 which engage the cartridge case at the portions of foregoing convergence may be shaped to form a continually variable curving spline 160 in shape or profile preferably free from any angled corners or straight portions to smoothly guide and transitions the cartridge up to the feed lips 60. Many known magazines may use straight lines and tight angles or radii which can create potential dwell points for cartridges that prevent the round from properly rising upwards without snags or impedance thereby causing feeding jams. The present spline-shaped upper portions of the raised ribs 150, 151 prevent cartridges from snagging and provide smooth feeding and dispensing from the magazine. Portions of the front and rear ribs 150, 151 below the upper curved spline parts may be vertically straight and parallel to each other.

In one embodiment, the space created in magazine cavity 54 between the front and rear ribs 150, 151 define an inwardly open recess 152. Follower 80 may include a pair of laterally protruding guide wings 153 which are each received in one of the recesses 152. The wings 153 may be axially elongated having a greater width than the width of the ribs 150, 151. Wings 153 slide upward and downward within the recesses as the follower moves up and down. Interaction between the wings 153 and corresponding recesses 152 help prevent lateral twisting of the follower 80 from side to side in the magazine cavity 54 to maintain an axially straight follower to prevent binding the follower particularly when in a tilted position as it moves in a guided manner upwards/downwards in the cavity.

Referring to FIGS. 28-32 and 48-50, the interior surface of the magazine housing 53 further includes a vertically-extending stepped shoulder 154 which engages the shoulder 62 of each cartridge C at the headspace diameter D1 in the stack to set the headspace at the rear of the barrel chamber. Shoulder 154 may extend from the bottom end 56 of the magazine 50 (see, e.g. FIG. 32) upwards and terminate at a point proximate to the feed lip near top end 55 (see, e.g. FIG. 3). Magazine shoulder 154 also serves to restrain axial forward movement or shifting of the cartridges in the interior magazine 50 also maintains spacing between the tips of the projectiles 64 and front wall 57 of the magazine inside cavity 54 which prevents cartridge snagging and feed jams.

While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made within the scope of the present disclosure. One skilled in the art will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents.

What is claimed is:

1. A magazine for a firearm comprising:

a housing defining a horizontal centerline axis, a vertical centerline axis perpendicular thereto, and an interior cavity configured to hold a plurality of ammunition cartridges;

the housing including an open top end, a bottom end, a front wall, a rear wall, and pair of opposing lateral right and left sidewalls extending between the front and rear walls;

a compressible main spring disposed in the cavity;

an elongated follower disposed in the cavity and biased in an upwards direction by the main spring, the follower being moveable between a lower position and an upper position for dispensing cartridges;

a guide boss protruding laterally outwards from each one of a pair of lateral sides of the follower, each guide boss slideably engaging a corresponding vertical guide slot formed in the sidewalls of the housing for guiding upwards and downwards movement of the follower;

wherein the follower is angularly tiltable relative to the housing of the magazine about a lateral pivot axis defined by the guide bosses;

wherein each vertical guide slot has a closed top end to restrict a vertical range of movement of the follower and an open bottom end for insertion of the guide bosses into the guide slots.

2. The magazine according to claim 1, wherein the guide bosses are cylindrical and the follower is movable between a horizontal position and an angled position.

3. The magazine according to claim 1, wherein the guide bosses are disposed proximate to a front end of the follower and the guide slots are disposed proximate to the front wall of the magazine.

4. The magazine according to claim 3, wherein a front end of the follower is angularly tiltable independently of a rear of the follower allowing the follower to assume positions wherein the front end of the follower may be lower than a rear end of the follower, and vice-versa.

5. The magazine according to claim 1, further comprising a pair of inwardly turned feed lips adjoining the open top end of the housing configured to prevent an uppermost one of the cartridges from being ejected from the magazine by the main spring, the feed lips symmetrically configured and arranged around the vertical centerline axis of the magazine.

6. The magazine according to claim 1, wherein the follower has a cartridge support surface comprising a upper sub-surface, a lower sub-surface laterally offset from the upper sub-surface, and an arcuately curved intermediate sub-surface adjoining and extending between the upper and lower sub-surfaces.

7. The magazine according to claim 6, further comprising a concave arcuately curved transition surface formed between the lower sub-surface and a contiguously adjoining convex arcuately curved transition surface formed between the intermediate sub-surface and the upper sub-surface.

8. The magazine according to claim 6, wherein the upper sub-surface and lower sub-surface are each substantially flat and horizontal when the follower is in a horizontal position.

9. The magazine according to claim 8, wherein when the plurality of cartridges is fed upwards in the magazine by the follower towards the top end of the housing, the cartridges do not engage the upper sub-surface.

10. A magazine for a firearm comprising:

a housing defining a horizontal centerline axis, a vertical centerline axis perpendicular thereto, and an interior cavity configured to hold a plurality of ammunition cartridges;

the housing including an open top end, a bottom end, a front wall, a rear wall, and pair of opposing lateral right and left sidewalls extending between the front and rear walls;

a compressible main spring disposed in the cavity;

an elongated follower disposed in the cavity and biased in an upwards direction by the main spring, the follower being moveable between a lower position and an upper position for dispensing cartridges;

a guide boss protruding laterally outwards from each one of a pair of lateral sides of the follower, each guide boss slideably engaging a corresponding vertical guide slot formed in the sidewalls of the housing for guiding upwards and downwards movement of the follower;

wherein the follower is angularly tiltable relative to the housing of the magazine about a lateral pivot axis defined by the guide bosses;

wherein the main spring is an accordion type flat spring formed from a triple folded flat spring material in which no portion of the spring crosses another portion in the same horizontal reference plane.

11. The magazine according to claim 10, wherein the main spring comprises a pair of laterally open cutouts which allows adjacently located bends of the spring to nest together in a side to side relationship when the spring is in a fully compressed condition.

12. The magazine according to claim 11, where the cutouts include a right cutout laterally open to the right lateral sidewall of the housing of the magazine and a left cutout laterally open to the left lateral sidewall of the housing of the magazine.

13. The magazine according to claim 12, wherein the cutouts are arranged directly opposite to each other on opposing sides of the spring.

14. The magazine according to claim 11, wherein:

the spring includes an axially elongated top leg, an axially elongated bottom leg, an axially elongated upper intermediate leg joined to the top leg by a recurvant first bend, and an axially elongated lower intermediate leg joined to the bottom leg by a recurvant second bend, and a recurvant third bend joining the upper and lower intermediate legs together; and the cutouts are formed in the upper and lower intermediate legs at the first and second bends respectively.

15. The magazine according to claim 14, wherein the first and second bends each have a lateral width less than a full lateral width of the main spring in portions without the cutouts.

16. The magazine according to claim 15, wherein the third bend has a lateral width greater than the first and second bends.

17. A magazine for a firearm comprising:

a housing defining a horizontal centerline axis, a vertical centerline axis perpendicular thereto, and an interior cavity configured to hold a plurality of ammunition cartridges;

the housing including an open top end, a bottom end, a front wall, a rear wall, and pair of opposing lateral right and left sidewalls extending between the front and rear walls;

a compressible main spring disposed in the cavity;

an elongated follower disposed in the cavity and biased in an upwards direction by the main spring, the follower being moveable between a lower position and an upper position for dispensing cartridges;

a guide boss protruding laterally outwards from each one of a pair of lateral sides of the follower, each guide boss slideably engaging a corresponding vertical guide slot formed in the sidewalls of the housing for guiding upwards and downwards movement of the follower;

wherein the follower is angularly tiltable relative to the housing of the magazine about a lateral pivot axis defined by the guide bosses;

wherein the cavity of the housing includes a pair of opposing vertically extending raised front ribs which define front cartridge contact surfaces, and a pair of opposing vertically-extending raised rear ribs which define rear cartridge contact surfaces, and wherein the cartridges only contact the front and rear cartridge contact surfaces in a lateral direction when moving upwards or downwards in the cavity.

18. The magazine according to claim 17, further comprising an inwardly open recess formed between each pair of front and rear ribs which slideably receives a laterally projecting guide protrusion formed on each lateral side of the follower.

19. The magazine according to claim 17, wherein interior upper portions of the raised front and rear ribs converge towards each other at the top end of the magazine housing and have a continuously curving variable spline configuration which guides the cartridge upwards towards the feed lips.

20. The magazine according to claim 19, wherein lower portions of the raised front and rear ribs below the curving variable spline configuration are parallel to each other.

21. A magazine for a firearm comprising:

a housing defining a horizontal centerline axis, a vertical centerline axis perpendicular thereto, and an interior cavity configured to hold a plurality of ammunition cartridges;

the housing including an open top end, a bottom end, a front wall, a rear wall, and pair of opposing lateral right and left sidewalls extending between the front and rear walls;

a compressible main spring disposed in the cavity;

an elongated follower disposed in the cavity and biased in an upwards direction by the main spring, the follower being moveable between a lower position and an upper position for dispensing cartridges;

a guide boss protruding laterally outwards from each one of a pair of lateral sides of the follower, each guide boss slideably engaging a corresponding vertical guide slot formed in the sidewalls of the housing for guiding upwards and downwards movement of the follower;

wherein the follower is angularly tiltable relative to the housing of the magazine about a lateral pivot axis defined by the guide bosses;

wherein the housing is horizontally elongated having a greater horizontal length than a vertical height.

22. A magazine for a firearm comprising:

a housing defining a horizontal centerline axis, a vertical centerline axis perpendicular thereto, and an interior cavity configured to hold a plurality of ammunition cartridges;

the housing including an open top end, a bottom end, a front wall, a rear wall, and pair of opposing lateral right and left sidewalls extending between the front and rear walls;

a compressible main spring disposed in the cavity;

an elongated follower disposed in the cavity and biased in an upwards direction by the main spring, the follower being moveable between a lower position and an upper position for dispensing cartridges;

a guide boss protruding laterally outwards from each one of a pair of lateral sides of the follower, each guide boss slideably engaging a corresponding vertical guide slot formed in the sidewalls of the housing for guiding upwards and downwards movement of the follower;

wherein the follower is angularly tiltable relative to the housing of the magazine about a lateral pivot axis defined by the guide bosses;

wherein a bottom surface of the magazine sits substantially flush with underside surfaces of a stock of the firearm adjacent to the magazine when the magazine is fully mounted in the firearm.

23. A magazine for a firearm comprising:

a housing defining a longitudinal axis, a vertical centerline axis, and an interior cavity configured to hold a spring biased stack of ammunition cartridges;

the housing including an open top end, a bottom end, a front wall, a rear wall, and pair of opposing lateral sidewalls extending between the front and rear walls;

the sidewalls of the housing each including a plurality of longitudinally spaced apart mounting teeth;

a floor plate detachably coupled to the bottom end of the magazine, the floor plate including a plurality of longitudinally spaced apart mounting teeth mutually engageable with the mounting teeth on each of the sidewalls of the magazine;

the floor plate longitudinally slideable forward and rearward on the housing between a locked position in which the mounting teeth of the floor plate are engaged with the mounting teeth of the housing, and an unlocked position in which the mounting teeth of the floor plate are disengaged from the mounting teeth of the housing;

wherein the floor plate is removable form the housing when in the unlocked position, and the floor plate is not removable from the housing when in the locked position.

24. The magazine according to claim 23, wherein:

when the floor plate is in the locked position, the mounting teeth of the floor plate are positioned directly above the mounting teeth of the housing creating an interference which prevents removal of the floor plate from the housing; and when the floor plate is in the unlocked position, the mounting teeth of the floor plate are positioned directly above gaps formed between the mounting teeth of the housing which allows the floor plate to be withdrawn downwards between the mounting teeth of the housing and removed.

25. The magazine according to claim 23, wherein the floor plate includes a resiliently deformable snap fit tab, the snap fit tab configured and operable for lockingly engaging the rear wall of the housing when the floor plate is fully coupled to the housing to prevent sliding the floor plate forward and rearward on the housing.

26. The magazine according to claim 24, wherein the mounting teeth of the floor plate are disposed above the mounting teeth of the housing in a longitudinally-extending mounting channel in each sidewall of the housing, the mounting teeth of the floor plate being slideable forward and rearward in the channel to move the floor plate between the locked and unlocked positions.

27. The magazine according to claim 23, wherein the mounting teeth of the floor plate are configured to be vertically insertable between the mounting teeth of housing for coupling the floor plate to the housing.

28. The magazine according to claim 27, further comprising a longitudinally-extending and downward facing stop surface formed on each sidewall of the housing and spaced above the mounting teeth of the housing, the stop surface positioned to engage the mounting teeth of floor plate when inserted vertically between the mounting teeth of the housing.

29. The magazine according to claim 23, wherein the mounting teeth of the housing extend laterally outwards from a bottom end of the sidewalls of the housing, and the mounting teeth of the floor plate extend laterally inwards from each of two opposing sidewalls of the floor plate.

30. The magazine according to claim 29, wherein the floor plate has a flattened U-shape.

31. A method for assembling a firearm magazine comprising:

providing a magazine housing defining a horizontal centerline axis, a vertical centerline axis, and an interior cavity configured to hold a spring biased stack of ammunition cartridges, the housing comprising a front wall, a rear wall, and a pair of opposing lateral sidewalls each including a first plurality of first mounting teeth separated by first gaps;

providing a floor plate comprising opposing lateral sidewalls each including a second plurality of second mounting teeth separated by second gaps;

positioning the floor plate below the magazine housing;

vertically inserting the second teeth of the floor plate through the first gaps of the magazine housing by moving the floor plate and magazine housing together;

sliding the floor plate forward on the magazine housing; and positioning the second teeth of the floor plate above the first teeth of the magazine housing;

wherein the floor plate cannot be vertically withdrawn from the magazine housing.

* * * * *